US009320976B2

(12) United States Patent
Weston

(10) Patent No.: US 9,320,976 B2
(45) **Date of Patent: *Apr. 26, 2016**

(54) WIRELESS TOY SYSTEMS AND METHODS FOR INTERACTIVE ENTERTAINMENT

(71) Applicant: MQ Gaming, LLC, Irvine, CA (US)

(72) Inventor: Denise Chapman Weston, Wakefield, RI (US)

(73) Assignee: MQ Gaming, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/621,711

(22) Filed: Feb. 13, 2015

(65) Prior Publication Data

US 2015/0328556 A1 Nov. 19, 2015

Related U.S. Application Data

(63) Continuation of application No. 14/226,127, filed on Mar. 26, 2014, now Pat. No. 8,961,260, which is a continuation of application No. 12/355,489, filed on Jan. 16, 2009, now Pat. No. 8,753,165, which is a (Continued)

(51) Int. Cl.

| | |
|---|---|
| ***A63H 3/00*** | (2006.01) |
| ***A63H 3/48*** | (2006.01) |
| ***A63H 3/02*** | (2006.01) |

(52) U.S. Cl.

CPC .. *A63H 3/48* (2013.01); *A63H 3/00* (2013.01); *A63H 3/02* (2013.01); *A63H 2200/00* (2013.01)

(58) Field of Classification Search

CPC ..... G06K 7/086; A63H 33/00; A63H 3/28; A63H 2200/00; A63F 2009/2489

See application file for complete search history.

(56) References Cited

U.S. PATENT DOCUMENTS

| | | | |
|---|---|---|---|
| 973,105 | A | 10/1910 | Chamberlain, Jr. |
| 1,661,058 | A | 2/1928 | Theremin |

(Continued)

FOREIGN PATENT DOCUMENTS

| | | |
|---|---|---|
| CN | 1032246 | 4/1989 |
| CN | 2113224 U | 2/1992 |

(Continued)

OTHER PUBLICATIONS

"HyperScan", release date Oct. 2006. Source http://www.giantbomb.com/hyperscan/3045-1 041.

(Continued)

*Primary Examiner* — Jay Liddle
*Assistant Examiner* — Alex F. R. P. Rada, II
(74) *Attorney, Agent, or Firm* — Knobbe, Martens, Olson & Bear, LLP

(57) ABSTRACT

A playmate toy or similar children's toy is provided having associated wireless, batteryless ID tag that can be read from and/or written to using a radio-frequency communication protocol. The tag is mounted internally within a cavity of the toy and thereby provides wireless communication of stored information without requiring removal and reinsertion of the tag. In this manner, a stuffed animal or other toy can be quickly and easily identified non-invasively, without damaging the toy. Additional information (e.g., unique personality traits, special powers, skill levels, etc.) can also be stored on the ID tag, thus providing further personality enhancement, input/output programming, simulated intelligence and/or interactive gaming possibilities.

20 Claims, 20 Drawing Sheets

Related U.S. Application Data continuation of application No. 11/241,812, filed on Sep. 30, 2005, now Pat. No. 7,488,231, which is a continuation of application No. 10/045,582, filed on Oct. 22, 2001, now Pat. No. 7,066,781.

(60) Provisional application No. 60/241,893, filed on Oct. 20, 2000.

(56) References Cited

U.S. PATENT DOCUMENTS

| | | | |
|---|---|---|---|
| 1,789,680 | A | 1/1931 | Gwinnett |
| 2,001,366 | A | 5/1935 | Mittelman |
| 2,752,725 | A | 7/1956 | Unsworth |
| 2,902,023 | A | 9/1959 | Waller |
| 3,135,512 | A | 6/1964 | Taylor |
| 3,336,030 | A | 8/1967 | Martell et al. |
| 3,395,920 | A | 8/1968 | Moe |
| 3,454,920 | A | 7/1969 | Mehr |
| 3,456,134 | A | 7/1969 | Ko |
| 3,468,533 | A | 9/1969 | House, Jr. |
| 3,474,241 | A | 10/1969 | Kuipers |
| D220,268 | S | 3/1971 | Kliewer |
| 3,572,712 | A | 3/1971 | Vick |
| 3,633,904 | A | 1/1972 | Kojima |
| 3,660,648 | A | 5/1972 | Kuipers |
| 3,707,055 | A | 12/1972 | Pearce |
| 3,795,805 | A | 3/1974 | Swanberg et al. |
| 3,843,127 | A | 10/1974 | Lack |
| 3,949,364 | A | 4/1976 | Clark et al. |
| 3,949,679 | A | 4/1976 | Barber |
| 3,973,257 | A | 8/1976 | Rowe |
| 3,978,481 | A | 8/1976 | Angwin et al. |
| 3,997,156 | A | 12/1976 | Barlow et al. |
| 4,009,619 | A | 3/1977 | Snyman |
| 4,038,876 | A | 8/1977 | Morris |
| 4,055,341 | A | 10/1977 | Martinez |
| 4,063,111 | A | 12/1977 | Dobler et al. |
| 4,153,250 | A | 5/1979 | Anthony |
| 4,166,406 | A | 9/1979 | Maughmer |
| 4,171,737 | A | 10/1979 | McLaughlin |
| 4,175,665 | A | 11/1979 | Dogliotti |
| 4,205,785 | A | 6/1980 | Stanley |
| 4,231,077 | A | 10/1980 | Joyce et al. |
| 4,240,638 | A | 12/1980 | Morrison et al. |
| 4,282,681 | A | 8/1981 | McCaslin |
| 4,287,765 | A | 9/1981 | Kreft |
| 4,296,929 | A | 10/1981 | Meyer et al. |
| 4,303,978 | A | 12/1981 | Shaw |
| 4,318,245 | A | 3/1982 | Stowell et al. |
| 4,321,678 | A | 3/1982 | Krogmann |
| 4,325,199 | A | 4/1982 | McEdwards |
| 4,337,948 | A | 7/1982 | Breslow |
| 4,342,985 | A | 8/1982 | Desjardins |
| 4,402,250 | A | 9/1983 | Baasch |
| 4,412,205 | A | 10/1983 | Von Kemenczky |
| 4,425,488 | A | 1/1984 | Moskin |
| 4,443,866 | A | 4/1984 | Burgiss |
| 4,450,325 | A | 5/1984 | Luque |
| 4,503,299 | A | 3/1985 | Henrard |
| 4,514,600 | A | 4/1985 | Lentz |
| 4,514,798 | A | 4/1985 | Lesche |
| 4,540,176 | A | 9/1985 | Baer |
| 4,546,551 | A | 10/1985 | Franks |
| 4,558,604 | A | 12/1985 | Auer |
| 4,561,299 | A | 12/1985 | Orlando |
| 4,575,621 | A | 3/1986 | Dreifus |
| 4,578,674 | A | 3/1986 | Baker et al. |
| 4,595,369 | A | 6/1986 | Downs |
| 4,623,887 | A | 11/1986 | Welles |
| 4,623,930 | A | 11/1986 | Oshima |
| 4,627,620 | A | 12/1986 | Yang |
| 4,645,458 | A | 2/1987 | Williams |
| 4,672,374 | A | 6/1987 | Desjardins |
| 4,678,450 | A | 7/1987 | Scolari et al. |
| 4,695,058 | A | 9/1987 | Carter, III et al. |
| 4,695,953 | A | 9/1987 | Blair et al. |
| 4,699,379 | A | 10/1987 | Chateau et al. |
| 4,739,128 | A | 4/1988 | Grisham |
| 4,750,733 | A | 6/1988 | Foth |
| 4,761,540 | A | 8/1988 | McGeorge |
| 4,776,253 | A | 10/1988 | Downes |
| 4,787,051 | A | 11/1988 | Olson |
| 4,816,810 | A | 3/1989 | Moore |
| 4,817,950 | A | 4/1989 | Goo |
| 4,819,182 | A | 4/1989 | King et al. |
| 4,837,568 | A | 6/1989 | Snaper et al. |
| 4,839,838 | A | 6/1989 | LaBiche et al. |
| 4,843,568 | A | 6/1989 | Krueger et al. |
| 4,846,568 | A | 7/1989 | Usui |
| 4,849,655 | A | 7/1989 | Bennett |
| 4,851,685 | A | 7/1989 | Dubgen |
| 4,858,390 | A | 8/1989 | Kenig |
| 4,858,930 | A | 8/1989 | Sato |
| 4,862,165 | A | 8/1989 | Gart |
| 4,882,717 | A | 11/1989 | Hayakawa et al. |
| 4,891,032 | A | 1/1990 | Davis |
| 4,904,222 | A | 2/1990 | Gastgeb et al. |
| 4,910,677 | A | 3/1990 | Remedio et al. |
| 4,914,598 | A | 4/1990 | Krogmann |
| 4,918,293 | A | 4/1990 | McGeorge |
| 4,924,358 | A | 5/1990 | VonHeck |
| 4,932,917 | A | 6/1990 | Klitsner |
| 4,957,291 | A | 9/1990 | Miffitt |
| 4,960,275 | A | 10/1990 | Magon |
| 4,961,369 | A | 10/1990 | McGill |
| 4,964,837 | A | 10/1990 | Collier |
| 4,967,321 | A | 10/1990 | Cimock |
| 4,969,647 | A | 11/1990 | Mical et al. |
| 4,980,519 | A | 12/1990 | Mathews |
| 4,988,981 | A | 1/1991 | Zimmerman et al. |
| 4,994,795 | A | 2/1991 | MacKenzie |
| 5,011,161 | A | 4/1991 | Galphin |
| 5,036,442 | A | 7/1991 | Brown |
| RE33,662 | E | 8/1991 | Blair et al. |
| 5,045,843 | A | 9/1991 | Hansen |
| 5,048,831 | A | 9/1991 | Sides |
| D320,624 | S | 10/1991 | Taylor |
| 5,058,480 | A | 10/1991 | Suzuki et al. |
| 5,059,958 | A | 10/1991 | Jacobs et al. |
| 5,062,696 | A | 11/1991 | Oshima |
| 5,068,645 | A | 11/1991 | Drumm |
| D322,242 | S | 12/1991 | Cordell |
| 5,076,584 | A | 12/1991 | Openiano |
| D325,225 | S | 4/1992 | Adhida |
| 5,114,155 | A | 5/1992 | Tillery et al. |
| 5,114,344 | A | 5/1992 | Fumagalli et al. |
| 5,124,938 | A | 6/1992 | Algrain |
| 5,127,657 | A | 7/1992 | Ikezawa et al. |
| 5,128,671 | A | 7/1992 | Thomas, Jr. |
| D328,463 | S | 8/1992 | King et al. |
| 5,136,222 | A | 8/1992 | Yamamoto |
| 5,138,154 | A | 8/1992 | Hotelling |
| 5,145,446 | A | 9/1992 | Kuo |
| D331,058 | S | 11/1992 | Morales |
| 5,166,502 | A | 11/1992 | Rendleman |
| 5,170,002 | A | 12/1992 | Suzuki et al. |
| 5,175,481 | A | 12/1992 | Kanno |
| 5,177,311 | A | 1/1993 | Suzuki et al. |
| 5,178,477 | A | 1/1993 | Gambaro |
| 5,181,181 | A | 1/1993 | Glynn |
| 5,184,830 | A | 2/1993 | Okada et al. |
| 5,188,368 | A | 2/1993 | Ryan |
| 5,190,285 | A | 3/1993 | Levy et al. |
| 5,192,082 | A | 3/1993 | Inoue et al. |
| 5,192,823 | A | 3/1993 | Suzuki et al. |
| 5,194,006 | A | 3/1993 | Zaenglein, Jr. |
| 5,194,048 | A | 3/1993 | Briggs |
| 5,202,844 | A | 4/1993 | Kamio |
| 5,207,426 | A | 5/1993 | Inoue et al. |
| 5,212,368 | A | 5/1993 | Hara |
| 5,213,327 | A | 5/1993 | Kitaue |
| 5,223,698 | A | 6/1993 | Kapur |
| 5,231,568 | A | 7/1993 | Cohen et al. |

(56) References Cited

U.S. PATENT DOCUMENTS

| | | | |
|---|---|---|---|
| D338,242 | S | 8/1993 | Cordell |
| 5,232,223 | A | 8/1993 | Dornbusch |
| 5,236,200 | A | 8/1993 | McGregor et al. |
| 5,247,651 | A | 9/1993 | Clarisse |
| D340,042 | S | 10/1993 | Copper et al. |
| 5,259,626 | A | 11/1993 | Ho |
| 5,262,777 | A | 11/1993 | Low et al. |
| D342,256 | S | 12/1993 | Payne et al. |
| 5,277,645 | A | 1/1994 | Kelley et al. |
| 5,279,513 | A | 1/1994 | Connelly |
| 5,280,744 | A | 1/1994 | DeCarlo |
| D345,164 | S | 3/1994 | Grae |
| 5,290,964 | A | 3/1994 | Hiyoshi et al. |
| 5,292,124 | A | 3/1994 | Carpenter |
| 5,292,254 | A | 3/1994 | Miller et al. |
| 5,296,871 | A | 3/1994 | Paley |
| 5,299,967 | A | 4/1994 | Gilbert |
| 5,307,325 | A | 4/1994 | Scheiber |
| 5,310,192 | A | 5/1994 | Miyake |
| 5,317,394 | A | 5/1994 | Hale |
| 5,319,548 | A | 6/1994 | Germain |
| 5,320,358 | A | 6/1994 | Jones |
| 5,320,362 | A | 6/1994 | Bear et al. |
| 5,329,276 | A | 7/1994 | Hirabayashi |
| 5,332,322 | A | 7/1994 | Gambaro |
| 5,339,095 | A | 8/1994 | Redford |
| D350,736 | S | 9/1994 | Takahashi et al. |
| D350,782 | S | 9/1994 | Barr |
| D351,430 | S | 10/1994 | Barr |
| 5,354,057 | A | 10/1994 | Pruitt et al. |
| 5,356,343 | A | 10/1994 | Lovetere |
| 5,357,267 | A | 10/1994 | Inoue |
| 5,359,321 | A | 10/1994 | Ribic |
| 5,359,348 | A | 10/1994 | Pilcher et al. |
| 5,363,120 | A | 11/1994 | Drumm |
| 5,365,214 | A | 11/1994 | Angott et al. |
| 5,366,229 | A | 11/1994 | Suzuki |
| 5,369,580 | A | 11/1994 | Monji |
| 5,369,889 | A | 12/1994 | Callaghan |
| 5,372,365 | A | 12/1994 | McTeigue et al. |
| 5,373,857 | A | 12/1994 | Travers et al. |
| 5,378,197 | A | 1/1995 | Briggs |
| 5,382,026 | A | 1/1995 | Harvard et al. |
| 5,392,613 | A | 2/1995 | Bolton et al. |
| 5,393,074 | A | 2/1995 | Bear et al. |
| 5,396,227 | A | 3/1995 | Carroll et al. |
| 5,396,265 | A | 3/1995 | Ulrich et al. |
| 5,403,238 | A | 4/1995 | Baxter et al. |
| 5,405,294 | A | 4/1995 | Briggs |
| 5,411,269 | A | 5/1995 | Thomas |
| 5,416,535 | A | 5/1995 | Sato et al. |
| 5,421,575 | A | 6/1995 | Triner |
| 5,421,590 | A | 6/1995 | Robbins |
| 5,422,956 | A | 6/1995 | Wheaton |
| 5,429,361 | A | 7/1995 | Raven et al. |
| 5,430,435 | A | 7/1995 | Hoch |
| 5,432,864 | A | 7/1995 | Lu et al. |
| 5,435,561 | A | 7/1995 | Conley |
| 5,435,569 | A | 7/1995 | Zilliox |
| D360,903 | S | 8/1995 | Barr et al. |
| 5,439,199 | A | 8/1995 | Briggs et al. |
| 5,440,326 | A | 8/1995 | Quinn |
| 5,443,261 | A | 8/1995 | Lee et al. |
| 5,452,893 | A | 9/1995 | Faulk et al. |
| 5,453,053 | A | 9/1995 | Danta et al. |
| 5,453,758 | A | 9/1995 | Sato |
| D362,870 | S | 10/1995 | Oikawa |
| 5,459,489 | A | 10/1995 | Redford |
| 5,469,194 | A | 11/1995 | Clark et al. |
| 5,481,957 | A | 1/1996 | Paley |
| 5,482,510 | A | 1/1996 | Ishii et al. |
| 5,484,355 | A | 1/1996 | King |
| 5,485,171 | A | 1/1996 | Copper et al. |
| 5,488,362 | A | 1/1996 | Ullman et al. |
| 5,490,058 | A | 2/1996 | Yamasaki |
| 5,498,002 | A | 3/1996 | Gechter |
| 5,502,486 | A | 3/1996 | Ueda |
| 5,506,605 | A | 4/1996 | Paley |
| 5,509,806 | A | 4/1996 | Ellsworth |
| 5,512,892 | A | 4/1996 | Corballis et al. |
| 5,516,105 | A | 5/1996 | Eisenbrey et al. |
| 5,517,183 | A | 5/1996 | Bozeman |
| 5,523,800 | A | 6/1996 | Dudek |
| 5,524,637 | A | 6/1996 | Erickson |
| 5,526,022 | A | 6/1996 | Donahue et al. |
| 5,528,265 | A | 6/1996 | Harrison |
| 5,531,443 | A | 7/1996 | Cruz |
| 5,533,933 | A | 7/1996 | Garnjost et al. |
| 5,541,860 | A | 7/1996 | Takei et al. |
| 5,550,721 | A | 8/1996 | Rapisarda |
| 5,551,701 | A | 9/1996 | Bouton et al. |
| 5,554,033 | A | 9/1996 | Bizzi et al. |
| 5,554,980 | A | 9/1996 | Hashimoto et al. |
| 5,561,543 | A | 10/1996 | Ogawa |
| 5,563,628 | A | 10/1996 | Stroop |
| 5,569,085 | A | 10/1996 | Igarashi et al. |
| D375,326 | S | 11/1996 | Yokoi et al. |
| 5,573,011 | A | 11/1996 | Felsing |
| 5,574,479 | A | 11/1996 | Odell |
| 5,579,025 | A | 11/1996 | Itoh |
| D376,826 | S | 12/1996 | Ashida |
| 5,580,319 | A | 12/1996 | Hamilton |
| 5,581,484 | A | 12/1996 | Prince |
| 5,585,584 | A | 12/1996 | Usa |
| 5,586,767 | A | 12/1996 | Bohland |
| 5,587,558 | A | 12/1996 | Matsushima |
| 5,587,740 | A | 12/1996 | Brennan |
| 5,594,465 | A | 1/1997 | Poulachon |
| 5,598,187 | A | 1/1997 | Ide et al. |
| 5,602,569 | A | 2/1997 | Kato |
| 5,603,658 | A | 2/1997 | Cohen |
| 5,605,505 | A | 2/1997 | Han |
| 5,606,343 | A | 2/1997 | Tsuboyama |
| 5,611,731 | A | 3/1997 | Bouton et al. |
| 5,613,913 | A | 3/1997 | Ikematsu et al. |
| 5,615,132 | A | 3/1997 | Horton |
| 5,621,459 | A | 4/1997 | Ueda |
| 5,623,581 | A | 4/1997 | Attenberg |
| 5,624,117 | A | 4/1997 | Ohkubo et al. |
| 5,627,565 | A | 5/1997 | Morishita et al. |
| 5,629,981 | A | 5/1997 | Nerlikar |
| 5,632,878 | A | 5/1997 | Kitano |
| D379,832 | S | 6/1997 | Ashida |
| 5,640,152 | A | 6/1997 | Copper |
| 5,641,288 | A | 6/1997 | Zaenglein, Jr. |
| 5,642,931 | A | 7/1997 | Gappelberg |
| 5,643,087 | A | 7/1997 | Marcus et al. |
| 5,645,077 | A | 7/1997 | Foxlin |
| 5,645,277 | A | 7/1997 | Cheng |
| 5,647,796 | A | 7/1997 | Cohen |
| 5,649,867 | A | 7/1997 | Briggs |
| 5,651,049 | A | 7/1997 | Easterling et al. |
| 5,655,053 | A | 8/1997 | Renie |
| 5,662,332 | A | 9/1997 | Garfield |
| 5,662,525 | A | 9/1997 | Briggs |
| 5,666,138 | A | 9/1997 | Culver |
| 5,667,217 | A | 9/1997 | Kelly et al. |
| 5,667,220 | A | 9/1997 | Cheng |
| 5,670,845 | A | 9/1997 | Grant |
| 5,670,988 | A | 9/1997 | Tickle |
| 5,672,090 | A | 9/1997 | Liu |
| 5,674,128 | A | 10/1997 | Holch et al. |
| 5,676,450 | A | 10/1997 | Sink et al. |
| 5,676,673 | A | 10/1997 | Ferre et al. |
| 5,679,004 | A | 10/1997 | McGowan et al. |
| 5,682,181 | A | 10/1997 | Nguyen et al. |
| 5,685,776 | A | 11/1997 | Stambolic et al. |
| 5,685,778 | A | 11/1997 | Sheldon et al. |
| 5,694,340 | A | 12/1997 | Kim |
| 5,698,784 | A | 12/1997 | Hotelling et al. |
| 5,701,131 | A | 12/1997 | Kuga |
| 5,702,232 | A | 12/1997 | Moore |
| 5,702,305 | A | 12/1997 | Norman et al. |
| 5,702,323 | A | 12/1997 | Poulton |

(56) References Cited

U.S. PATENT DOCUMENTS 5,703,623 A 12/1997 Hall et al.
5,716,216 A 2/1998 O'Loughlin et al.
5,716,281 A 2/1998 Dote
5,724,106 A 3/1998 Autry et al.
5,724,497 A 3/1998 San et al.
5,726,675 A 3/1998 Inoue
5,733,131 A 3/1998 Park
5,734,371 A 3/1998 Kaplan
5,734,373 A 3/1998 Rosenberg
5,734,807 A 3/1998 Sumi
D393,884 S 4/1998 Hayami
5,736,970 A 4/1998 Bozeman
5,739,811 A 4/1998 Rosenberg et al.
5,741,182 A 4/1998 Lipps et al.
5,741,189 A 4/1998 Briggs
5,742,233 A 4/1998 Doe et al.
5,742,331 A 4/1998 Uomori
5,745,226 A 4/1998 Gigioli
D394,264 S 5/1998 Sakamoto et al.
5,746,602 A 5/1998 Kikinis
5,751,273 A 5/1998 Cohen
5,752,880 A 5/1998 Gabai et al.
5,752,882 A 5/1998 Acres et al.
5,757,305 A 5/1998 Xydis
5,757,354 A 5/1998 Kawamura
5,757,360 A 5/1998 Nitta et al.
D395,464 S 6/1998 Shiibashi et al.
5,764,224 A 6/1998 Lilja et al.
5,769,719 A 6/1998 Hsu
5,770,533 A 6/1998 Franchi
5,771,038 A 6/1998 Wang
5,772,508 A 6/1998 Sugita et al.
D396,468 S 7/1998 Schindler et al.
5,775,998 A 7/1998 Ikematsu et al.
5,779,240 A 7/1998 Santella
5,785,317 A 7/1998 Sasaki
5,785,592 A 7/1998 Jacobsen
5,785,952 A 7/1998 Taylor et al.
5,786,626 A 7/1998 Brady et al.
D397,162 S 8/1998 Yokoi et al.
5,791,648 A 8/1998 Hohl
5,794,081 A 8/1998 Itoh
5,796,354 A 8/1998 Cartabiano et al.
5,803,740 A 9/1998 Gesink et al.
5,803,840 A 9/1998 Young
5,806,849 A 9/1998 Rutkowski
5,807,284 A 9/1998 Foxlin
5,810,666 A 9/1998 Mero et al.
5,811,896 A 9/1998 Grad
5,819,206 A 10/1998 Horton et al.
5,820,462 A 10/1998 Yokoi et al.
5,820,471 A 10/1998 Briggs
5,820,472 A 10/1998 Briggs
5,822,713 A 10/1998 Profeta
5,825,298 A 10/1998 Walter
5,825,350 A 10/1998 Case, Jr. et al.
D400,885 S 11/1998 Goto
5,830,065 A 11/1998 Sitrick
5,831,553 A 11/1998 Lenssen et al.
5,833,549 A 11/1998 Zur et al.
5,835,077 A 11/1998 Dao et al.
5,835,156 A 11/1998 Blonstein et al.
5,835,576 A 11/1998 Katz
5,836,817 A 11/1998 Acres et al.
5,838,138 A 11/1998 Henty
5,841,409 A 11/1998 Ishibashi et al.
D402,328 S 12/1998 Ashida
5,847,854 A 12/1998 Benson, Jr.
5,850,624 A 12/1998 Gard
5,851,149 A 12/1998 Xidos et al.
5,853,327 A 12/1998 Gilboa
5,853,332 A 12/1998 Briggs
5,854,622 A 12/1998 Brannon
5,855,483 A 1/1999 Collins et al.
D405,071 S 2/1999 Gambaro
5,865,680 A 2/1999 Briggs
5,867,146 A 2/1999 Kim et al.
5,874,941 A 2/1999 Yamada
5,875,257 A 2/1999 Marrin et al.
D407,071 S 3/1999 Keating
D407,761 S 4/1999 Barr
5,893,562 A 4/1999 Spector
5,897,437 A 4/1999 Nishiumi
5,898,421 A 4/1999 Quinn
5,900,867 A 5/1999 Schindler et al.
5,901,246 A 5/1999 Hoffberg et al.
5,902,968 A 5/1999 Sato et al.
5,906,542 A 5/1999 Neumann
D410,909 S 6/1999 Tickle
5,908,996 A 6/1999 Litterst et al.
5,911,634 A 6/1999 Nidata et al.
5,912,612 A 6/1999 DeVolpi
5,913,019 A 6/1999 Attenberg
5,913,727 A 6/1999 Ahdoot
5,919,149 A 7/1999 Allen
5,923,317 A 7/1999 Sayler et al.
5,924,695 A 7/1999 Heykoop
5,926,780 A 7/1999 Fox et al.
5,929,782 A 7/1999 Stark et al.
5,929,841 A 7/1999 Fujii
5,929,848 A 7/1999 Albukerk et al.
D412,940 S 8/1999 Kato et al.
5,931,739 A 8/1999 Layer et al.
5,942,969 A 8/1999 Wicks
5,944,533 A 8/1999 Wood
5,946,444 A 8/1999 Evans et al.
5,947,789 A 9/1999 Chan
5,947,868 A 9/1999 Dugan
5,955,713 A 9/1999 Titus
5,955,988 A 9/1999 Blonstein
5,956,035 A 9/1999 Sciammarella
5,957,779 A 9/1999 Larson
5,961,386 A 10/1999 Sawaguchi
5,963,136 A 10/1999 O'Brien
5,964,660 A 10/1999 James et al.
5,967,898 A 10/1999 Takasaka et al.
5,967,901 A 10/1999 Briggs
5,971,270 A 10/1999 Barna
5,971,271 A 10/1999 Wynn et al.
5,973,757 A 10/1999 Aubuchon et al.
5,980,254 A 11/1999 Muehle et al.
5,982,352 A 11/1999 Pryor
5,982,356 A 11/1999 Akiyama
5,984,785 A 11/1999 Takeda et al.
5,984,788 A 11/1999 Lebensfeld et al.
5,986,570 A 11/1999 Black et al.
5,986,644 A 11/1999 Herder
5,987,421 A 11/1999 Chuang
5,989,120 A 11/1999 Truchsess
5,991,085 A 11/1999 Rallison et al.
5,991,693 A 11/1999 Zalewski
5,996,033 A 11/1999 Chiu-Hao
5,999,168 A 12/1999 Rosenberg
6,001,014 A 12/1999 Ogata
6,001,015 A 12/1999 Nishiumi et al.
6,002,394 A 12/1999 Schein
6,009,458 A 12/1999 Hawkins et al.
D419,199 S 1/2000 Cordell et al.
D419,200 S 1/2000 Ashida
6,010,406 A 1/2000 Kajikawa et al.
6,011,526 A 1/2000 Toyoshima et al.
6,012,980 A 1/2000 Yoshida et al.
6,012,984 A 1/2000 Roseman
6,013,007 A 1/2000 Root et al.
6,016,144 A 1/2000 Blonstein
6,019,680 A 2/2000 Cheng
6,020,876 A 2/2000 Rosenberg
6,024,647 A 2/2000 Bennett et al.
6,024,675 A 2/2000 Kashiwaguchi
6,025,830 A 2/2000 Cohen
6,037,882 A 3/2000 Levy
6,044,297 A 3/2000 Sheldon
6,049,823 A 4/2000 Hwang
6,052,083 A 4/2000 Wilson

(56) References Cited

U.S. PATENT DOCUMENTS

| | | | |
|---|---|---|---|
| 6,057,788 | A | 5/2000 | Cummings |
| 6,058,342 | A | 5/2000 | Orbach |
| 6,059,576 | A | 5/2000 | Brann |
| 6,060,847 | A | 5/2000 | Hettema et al. |
| 6,066,075 | A | 5/2000 | Poulton |
| 6,069,594 | A | 5/2000 | Barnes et al. |
| 6,072,467 | A | 6/2000 | Walker |
| 6,072,470 | A | 6/2000 | Ishigaki |
| 6,075,443 | A | 6/2000 | Schepps et al. |
| 6,075,575 | A | 6/2000 | Schein et al. |
| 6,076,734 | A | 6/2000 | Dougherty et al. |
| 6,077,106 | A | 6/2000 | Mish |
| 6,078,789 | A | 6/2000 | Bodenmann |
| 6,079,982 | A | 6/2000 | Meader |
| 6,080,063 | A | 6/2000 | Khosla |
| 6,081,819 | A | 6/2000 | Ogino |
| 6,084,315 | A | 7/2000 | Schmitt |
| 6,084,577 | A | 7/2000 | Sato et al. |
| 6,085,805 | A | 7/2000 | Bates |
| 6,087,950 | A | 7/2000 | Capan |
| 6,089,987 | A | 7/2000 | Briggs |
| 6,091,342 | A | 7/2000 | Janesch et al. |
| D429,718 | S | 8/2000 | Rudolph |
| 6,095,926 | A | 8/2000 | Hettema et al. |
| 6,102,406 | A | 8/2000 | Miles et al. |
| 6,110,000 | A | 8/2000 | Ting |
| 6,110,039 | A | 8/2000 | Oh |
| 6,110,041 | A | 8/2000 | Walker et al. |
| 6,115,028 | A | 9/2000 | Balakrishnan |
| 6,127,928 | A | 10/2000 | Issacman et al. |
| 6,127,990 | A | 10/2000 | Zwern |
| 6,129,549 | A | 10/2000 | Thompson |
| 6,132,318 | A | 10/2000 | Briggs |
| 6,137,457 | A | 10/2000 | Tokuhashi |
| D433,381 | S | 11/2000 | Talesfore |
| 6,142,870 | A | 11/2000 | Wada |
| 6,142,876 | A | 11/2000 | Cumbers |
| 6,144,367 | A | 11/2000 | Berstis |
| 6,146,278 | A | 11/2000 | Kobayashi |
| 6,148,100 | A | 11/2000 | Anderson et al. |
| 6,149,490 | A | 11/2000 | Hampton |
| 6,150,947 | A | 11/2000 | Shima |
| 6,154,723 | A | 11/2000 | Cox et al. |
| 6,155,926 | A | 12/2000 | Miyamoto et al. |
| 6,160,405 | A | 12/2000 | Needle |
| 6,160,540 | A | 12/2000 | Fishkin et al. |
| 6,160,986 | A | 12/2000 | Gabai et al. |
| 6,162,122 | A | 12/2000 | Acres et al. |
| 6,162,123 | A | 12/2000 | Woolston |
| 6,162,191 | A | 12/2000 | Foxlin |
| 6,164,808 | A | 12/2000 | Shibata |
| 6,171,190 | B1 | 1/2001 | Thanasack et al. |
| 6,174,242 | B1 | 1/2001 | Briggs et al. |
| 6,176,837 | B1 | 1/2001 | Foxlin |
| 6,181,253 | B1 | 1/2001 | Eschenbach et al. |
| 6,181,329 | B1 | 1/2001 | Stork et al. |
| 6,183,364 | B1 | 2/2001 | Trovato |
| 6,183,365 | B1 | 2/2001 | Tonomura et al. |
| 6,184,847 | B1 | 2/2001 | Fateh et al. |
| 6,184,862 | B1 | 2/2001 | Leiper |
| 6,184,863 | B1 | 2/2001 | Sibert |
| 6,186,902 | B1 | 2/2001 | Briggs |
| 6,191,774 | B1 | 2/2001 | Schena |
| 6,196,893 | B1 | 3/2001 | Casola et al. |
| 6,198,295 | B1 | 3/2001 | Hill |
| 6,198,470 | B1 | 3/2001 | Agam et al. |
| 6,198,471 | B1 | 3/2001 | Cook |
| 6,200,216 | B1 | 3/2001 | Peppel |
| 6,200,219 | B1 | 3/2001 | Rudell et al. |
| 6,200,253 | B1 | 3/2001 | Nishiumi |
| 6,201,554 | B1 | 3/2001 | Lands |
| 6,206,745 | B1 | 3/2001 | Gabai et al. |
| 6,206,782 | B1 | 3/2001 | Walker et al. |
| 6,210,287 | B1 | 4/2001 | Briggs |
| 6,211,861 | B1 | 4/2001 | Rosenberg et al. |
| 6,214,155 | B1 | 4/2001 | Leighton |
| 6,217,450 | B1 | 4/2001 | Meredith |
| 6,217,478 | B1 | 4/2001 | Vohmann |
| 6,220,171 | B1 | 4/2001 | Hettema et al. |
| 6,220,964 | B1 | 4/2001 | Miyamoto |
| 6,220,965 | B1 | 4/2001 | Hanna et al. |
| 6,222,522 | B1 | 4/2001 | Mathews |
| D442,998 | S | 5/2001 | Ashida |
| 6,224,486 | B1 | 5/2001 | Walker et al. |
| 6,224,491 | B1 | 5/2001 | Hiromi et al. |
| 6,225,987 | B1 | 5/2001 | Matsuda |
| 6,226,534 | B1 | 5/2001 | Aizawa |
| 6,227,966 | B1 | 5/2001 | Yokoi |
| 6,227,974 | B1 | 5/2001 | Eilat et al. |
| 6,231,451 | B1 | 5/2001 | Briggs |
| 6,234,803 | B1 | 5/2001 | Watkins |
| 6,238,289 | B1 | 5/2001 | Sobota et al. |
| 6,238,291 | B1 | 5/2001 | Fujimoto et al. |
| 6,239,806 | B1 | 5/2001 | Nishiumi et al. |
| RE37,220 | E | 6/2001 | Rapisarda et al. |
| 6,241,611 | B1 | 6/2001 | Takeda et al. |
| 6,243,491 | B1 | 6/2001 | Andersson |
| 6,243,658 | B1 | 6/2001 | Raby |
| 6,244,987 | B1 | 6/2001 | Ohsuga et al. |
| 6,245,014 | B1 | 6/2001 | Brainard et al. |
| 6,248,019 | B1 | 6/2001 | Mudie et al. |
| 6,254,101 | B1 | 7/2001 | Young |
| 6,254,394 | B1 | 7/2001 | Draper et al. |
| 6,261,180 | B1 | 7/2001 | Lebensfeld et al. |
| 6,264,202 | B1 | 7/2001 | Briggs |
| 6,264,558 | B1 | 7/2001 | Nishiumi et al. |
| 6,265,984 | B1 | 7/2001 | Molinaroli |
| 6,267,673 | B1 | 7/2001 | Miyamoto et al. |
| 6,273,425 | B1 | 8/2001 | Westfall et al. |
| 6,273,819 | B1 | 8/2001 | Strauss et al. |
| 6,276,353 | B1 | 8/2001 | Briggs et al. |
| 6,280,327 | B1 | 8/2001 | Leifer et al. |
| 6,280,328 | B1 | 8/2001 | Holch et al. |
| 6,283,862 | B1 | 9/2001 | Richter |
| 6,283,871 | B1 | 9/2001 | Briggs |
| 6,287,200 | B1 | 9/2001 | Sharma |
| 6,290,565 | B1 | 9/2001 | Galyean, III et al. |
| 6,290,566 | B1 | 9/2001 | Gabai et al. |
| 6,293,684 | B1 | 9/2001 | Riblett |
| 6,297,751 | B1 | 10/2001 | Fadavi-Ardekani |
| 6,301,534 | B1 | 10/2001 | McDermott |
| 6,302,793 | B1 | 10/2001 | Fertitta, III et al. |
| 6,302,796 | B1 | 10/2001 | Lebensfeld et al. |
| 6,304,250 | B1 | 10/2001 | Yang |
| 6,311,982 | B1 | 11/2001 | Lebensfeld et al. |
| 6,312,335 | B1 | 11/2001 | Tosaki et al. |
| 6,315,673 | B1 | 11/2001 | Kopera |
| 6,320,495 | B1 | 11/2001 | Sporgis |
| 6,322,365 | B1 | 11/2001 | Shechter et al. |
| 6,323,614 | B1 | 11/2001 | Palaxxolo |
| 6,323,654 | B1 | 11/2001 | Needle |
| 6,325,718 | B1 | 12/2001 | Nishiumi et al. |
| 6,328,648 | B1 | 12/2001 | Walker et al. |
| 6,328,650 | B1 | 12/2001 | Fukawa et al. |
| 6,329,648 | B1 | 12/2001 | Delatorre |
| 6,330,427 | B1 | 12/2001 | Tabachnik |
| 6,331,841 | B1 | 12/2001 | Tokuhashi |
| 6,331,856 | B1 | 12/2001 | VanHook |
| 6,332,840 | B1 | 12/2001 | Nishiumi et al. |
| 6,337,954 | B1 | 1/2002 | Soshi |
| 6,342,010 | B1 | 1/2002 | Slifer |
| 6,346,047 | B1 | 2/2002 | Sobota |
| 6,347,993 | B1 | 2/2002 | Kondo et al. |
| 6,347,998 | B1 | 2/2002 | Yoshitomi et al. |
| 6,350,199 | B1 | 2/2002 | Williams et al. |
| 6,352,478 | B1 | 3/2002 | Gabai et al. |
| 6,356,867 | B1 | 3/2002 | Gabai et al. |
| 6,361,396 | B1 | 3/2002 | Snyder |
| 6,361,507 | B1 | 3/2002 | Foxlin |
| D456,410 | S | 4/2002 | Ashida |
| 6,364,735 | B1 | 4/2002 | Bristow et al. |
| 6,368,177 | B1 | 4/2002 | Gabai et al. |
| 6,368,217 | B2 | 4/2002 | Kanno |
| 6,369,794 | B1 | 4/2002 | Sakurai et al. |

(56) References Cited

U.S. PATENT DOCUMENTS

| | | | |
|---|---|---|---|
| 6,369,908 | B1 | 4/2002 | Frey et al. |
| 6,371,375 | B1 | 4/2002 | Ackley et al. |
| 6,371,853 | B1 | 4/2002 | Borta |
| 6,375,566 | B1 | 4/2002 | Yamada |
| 6,375,569 | B1 | 4/2002 | Acres |
| 6,375,572 | B1 | 4/2002 | Masuyama et al. |
| 6,375,578 | B1 | 4/2002 | Briggs |
| 6,377,793 | B1 | 4/2002 | Jenkins |
| 6,377,906 | B1 | 4/2002 | Rowe |
| D456,854 | S | 5/2002 | Ashida |
| 6,383,079 | B1 | 5/2002 | Takeda et al. |
| 6,386,538 | B1 | 5/2002 | Mejia |
| 6,392,613 | B1 | 5/2002 | Goto |
| 6,394,904 | B1 | 5/2002 | Stalker |
| 6,400,480 | B1 | 6/2002 | Thomas |
| 6,400,996 | B1 | 6/2002 | Hoffberg et al. |
| 6,404,409 | B1 | 6/2002 | Solomon |
| 6,409,379 | B1 | 6/2002 | Gabathuler et al. |
| 6,409,604 | B1 | 6/2002 | Matsuno |
| 6,409,687 | B1 | 6/2002 | Foxlin |
| D459,727 | S | 7/2002 | Ashida |
| D460,787 | S | 7/2002 | Nishikawa |
| 6,414,589 | B1 | 7/2002 | Angott et al. |
| 6,415,223 | B1 | 7/2002 | Lin |
| 6,421,056 | B1 | 7/2002 | Nishiumi |
| 6,424,264 | B1 | 7/2002 | Giraldin et al. |
| 6,424,333 | B1 | 7/2002 | Tremblay |
| 6,426,719 | B1 | 7/2002 | Nagareda |
| 6,426,741 | B1 | 7/2002 | Goldsmith et al. |
| 6,438,193 | B1 | 8/2002 | Ko et al. |
| D462,683 | S | 9/2002 | Ashida |
| 6,445,960 | B1 | 9/2002 | Borta |
| 6,452,494 | B1 | 9/2002 | Harrison |
| 6,456,276 | B1 | 9/2002 | Park |
| D464,052 | S | 10/2002 | Fletcher |
| D464,950 | S | 10/2002 | Fraquelli et al. |
| 6,462,769 | B1 | 10/2002 | Trowbridge et al. |
| 6,463,257 | B1 | 10/2002 | Wood |
| 6,463,859 | B1 | 10/2002 | Ikezawa et al. |
| 6,466,198 | B1 | 10/2002 | Feinstein |
| 6,466,831 | B1 | 10/2002 | Shibata |
| 6,473,070 | B2 | 10/2002 | Mishra et al. |
| 6,473,713 | B1 | 10/2002 | McCall |
| 6,474,159 | B1 | 11/2002 | Foxlin et al. |
| 6,482,067 | B1 | 11/2002 | Pickens |
| 6,484,080 | B2 | 11/2002 | Breed |
| 6,490,409 | B1 | 12/2002 | Walker |
| 6,492,981 | B1 | 12/2002 | Stork et al. |
| 6,494,457 | B2 | 12/2002 | Conte et al. |
| 6,496,122 | B2 | 12/2002 | Sampsell |
| 6,509,217 | B1 | 1/2003 | Reddy |
| 6,512,511 | B2 | 1/2003 | Willner |
| 6,517,438 | B2 | 2/2003 | Tosaki |
| 6,518,952 | B1 | 2/2003 | Leiper |
| 6,525,660 | B1 | 2/2003 | Surintrspanont |
| 6,526,158 | B1 | 2/2003 | Goldberg |
| 6,527,638 | B1 | 3/2003 | Walker et al. |
| 6,527,646 | B1 | 3/2003 | Briggs |
| 6,530,838 | B2 | 3/2003 | Ha et al. |
| 6,530,841 | B2 | 3/2003 | Bull et al. |
| 6,538,675 | B2 | 3/2003 | Aratani |
| D473,942 | S | 4/2003 | Motoki et al. |
| 6,540,607 | B2 | 4/2003 | Mokris et al. |
| 6,540,611 | B1 | 4/2003 | Nagata |
| 6,544,124 | B2 | 4/2003 | Ireland |
| 6,544,126 | B2 | 4/2003 | Sawano |
| 6,545,611 | B2 | 4/2003 | Hayashi et al. |
| 6,545,661 | B1 | 4/2003 | Goschy et al. |
| 6,551,165 | B2 | 4/2003 | Smirnov |
| 6,551,188 | B2 | 4/2003 | Toyama et al. |
| 6,554,707 | B1 | 4/2003 | Sinclair et al. |
| 6,554,781 | B1 | 4/2003 | Carter et al. |
| D474,763 | S | 5/2003 | Tozaki et al. |
| 6,558,225 | B1 | 5/2003 | Rehkemper et al. |
| 6,560,511 | B1 | 5/2003 | Yokoo et al. |
| 6,561,049 | B2 | 5/2003 | Akiyama et al. |
| 6,565,438 | B2 | 5/2003 | Ogino |
| 6,565,444 | B2 | 5/2003 | Nagata et al. |
| 6,567,536 | B2 | 5/2003 | McNitt et al. |
| 6,569,023 | B1 | 5/2003 | Briggs |
| 6,572,108 | B1 | 6/2003 | Bristow |
| 6,575,753 | B2 | 6/2003 | Rosa et al. |
| 6,577,350 | B1 | 6/2003 | Proehl |
| 6,579,098 | B2 | 6/2003 | Shechter |
| 6,582,299 | B1 | 6/2003 | Matsuyama et al. |
| 6,582,380 | B2 | 6/2003 | Kazlausky et al. |
| 6,583,783 | B1 | 6/2003 | Dietrich |
| 6,585,596 | B1 | 7/2003 | Leifer et al. |
| 6,589,120 | B1 | 7/2003 | Takahashi |
| 6,590,536 | B1 | 7/2003 | Walton |
| 6,591,677 | B2 | 7/2003 | Rothoff |
| 6,592,461 | B1 | 7/2003 | Raviv et al. |
| 6,595,863 | B2 | 7/2003 | Chamberlain et al. |
| 6,597,342 | B1 | 7/2003 | Haruta |
| 6,597,443 | B2 | 7/2003 | Boman |
| 6,598,978 | B2 | 7/2003 | Hasegawa |
| 6,599,194 | B1 | 7/2003 | Smith |
| 6,605,038 | B1 | 8/2003 | Teller et al. |
| 6,607,123 | B1 | 8/2003 | Jollifee et al. |
| 6,608,563 | B2 | 8/2003 | Weston et al. |
| 6,609,969 | B1 | 8/2003 | Luciano et al. |
| 6,609,977 | B1 | 8/2003 | Shimizu |
| 6,616,452 | B2 | 9/2003 | Clark et al. |
| 6,616,535 | B1 | 9/2003 | Nishizaki |
| 6,616,607 | B2 | 9/2003 | Hashimoto |
| 6,626,728 | B2 | 9/2003 | Holt |
| 6,628,257 | B1 | 9/2003 | Oka |
| 6,629,019 | B2 | 9/2003 | Legge et al. |
| 6,632,142 | B2 | 10/2003 | Keith |
| 6,633,155 | B1 | 10/2003 | Liang |
| 6,634,949 | B1 | 10/2003 | Briggs et al. |
| 6,636,826 | B1 | 10/2003 | Abe et al. |
| 6,641,482 | B2 | 11/2003 | Masuyama et al. |
| 6,642,837 | B1 | 11/2003 | Vigoda et al. |
| 6,650,029 | B1 | 11/2003 | Johnston |
| 6,650,313 | B2 | 11/2003 | Levine |
| 6,650,345 | B1 | 11/2003 | Saito |
| 6,651,268 | B1 | 11/2003 | Briggs |
| 6,654,001 | B1 | 11/2003 | Su |
| 6,672,962 | B1 | 1/2004 | Ozaki et al. |
| 6,676,520 | B2 | 1/2004 | Nishiumi et al. |
| 6,676,524 | B1 | 1/2004 | Botzas |
| 6,677,990 | B1 | 1/2004 | Kawahara |
| 6,681,629 | B2 | 1/2004 | Foxlin et al. |
| 6,682,074 | B2 | 1/2004 | Weston |
| 6,682,351 | B1 | 1/2004 | Abraham-Fuchs et al. |
| 6,684,062 | B1 | 1/2004 | Gosior et al. |
| D486,145 | S | 2/2004 | Kaminski et al. |
| 6,686,954 | B1 | 2/2004 | Kitaguchi |
| 6,692,170 | B2 | 2/2004 | Abir |
| 6,693,622 | B1 | 2/2004 | Shahoian et al. |
| 6,702,672 | B1 | 3/2004 | Angell et al. |
| 6,709,336 | B2 | 3/2004 | Siegel et al. |
| 6,712,692 | B2 | 3/2004 | Basson |
| 6,716,102 | B2 | 4/2004 | Whitten et al. |
| 6,717,573 | B1 | 4/2004 | Shahoian et al. |
| 6,717,673 | B1 | 4/2004 | Janssen |
| 6,718,280 | B2 | 4/2004 | Hermann |
| 6,725,107 | B2 | 4/2004 | MacPherson |
| 6,725,173 | B2 | 4/2004 | An |
| 6,726,099 | B2 | 4/2004 | Becker et al. |
| D489,361 | S | 5/2004 | Mori et al. |
| 6,729,934 | B1 | 5/2004 | Driscoll et al. |
| 6,733,390 | B2 | 5/2004 | Walker et al. |
| 6,736,009 | B1 | 5/2004 | Schwabe |
| 6,739,874 | B2 | 5/2004 | Marcus et al. |
| 6,739,979 | B2 | 5/2004 | Tracy |
| D491,924 | S | 6/2004 | Kaminski et al. |
| D492,285 | S | 6/2004 | Ombao et al. |
| 6,743,104 | B1 | 6/2004 | Ota et al. |
| 6,746,334 | B1 | 6/2004 | Barney |
| 6,747,562 | B2 | 6/2004 | Giraldin et al. |
| 6,747,632 | B2 | 6/2004 | Howard |
| 6,747,690 | B2 | 6/2004 | Molgaard |

(56) References Cited

U.S. PATENT DOCUMENTS 6,749,432 B2 6/2004 French et al.
6,752,719 B2 6/2004 Himoto et al.
6,753,849 B1 6/2004 Curran et al.
6,753,888 B2 6/2004 Kamiwada
6,757,068 B2 6/2004 Foxlin
6,757,446 B1 6/2004 Li
6,761,637 B2 7/2004 Weston et al.
6,765,553 B1 7/2004 Odamura
D495,336 S 8/2004 Andre et al.
6,770,863 B2 8/2004 Walley
6,773,325 B1 8/2004 Mawle et al.
6,773,344 B1 8/2004 Gabai et al.
6,785,539 B2 8/2004 Hale
6,786,877 B2 9/2004 Foxlin
6,796,177 B2 9/2004 Mori
6,796,908 B2 9/2004 Weston
6,797,895 B2 9/2004 Lapstun
6,811,489 B1 11/2004 Shimizu
6,811,491 B1 11/2004 Levenberg et al.
6,812,583 B2 11/2004 Cheung et al.
6,812,881 B1 11/2004 Mullaly et al.
6,813,525 B2 11/2004 Reid
6,813,574 B1 11/2004 Yedur
6,813,584 B2 11/2004 Zhou et al.
6,816,151 B2 11/2004 Dellinger
6,821,204 B2 11/2004 Aonuma et al.
6,821,206 B1 11/2004 Ishida et al.
6,835,135 B1 12/2004 Silverbrook et al.
6,836,705 B2 12/2004 Hellmann
6,836,751 B2 12/2004 Paxton
6,836,971 B1 1/2005 Wan
6,842,991 B2 1/2005 Levi
6,846,238 B2 1/2005 Wells
6,850,221 B1 2/2005 Tickle
6,850,844 B1 2/2005 Walters
6,852,032 B2 2/2005 Ishino
6,856,327 B2 2/2005 Choi
D502,468 S 3/2005 Knight et al.
6,868,738 B2 3/2005 Moscrip
6,872,139 B2 3/2005 Sato et al.
6,873,406 B1 3/2005 Hines
D503,750 S 4/2005 Kit et al.
6,878,066 B2 4/2005 Leifer
6,882,824 B2 4/2005 Wood
D504,677 S 5/2005 Kaminski et al.
D505,424 S 5/2005 Ashida et al.
6,890,262 B2 5/2005 Oishi
6,891,469 B2 5/2005 Engellenner et al.
6,891,526 B2 5/2005 Gombert
6,894,686 B2 5/2005 Stamper et al.
6,897,845 B2 5/2005 Ozawa
6,897,854 B2 5/2005 Keely
6,902,483 B2 6/2005 Lin
6,903,725 B2 6/2005 Nacson
6,905,411 B2 6/2005 Nguyen et al.
6,906,700 B1 6/2005 Armstrong
6,908,386 B2 6/2005 Suzuki et al.
6,908,388 B2 6/2005 Shimizu
6,918,833 B2 7/2005 Emmerson et al.
6,921,332 B2 7/2005 Fukunaga
6,922,632 B2 7/2005 Foxlin
6,924,787 B2 8/2005 Kramer et al.
6,925,410 B2 8/2005 Narayanan
6,929,543 B1 8/2005 Ueshima et al.
6,929,548 B2 8/2005 Wang
6,932,698 B2 8/2005 Sprogis
6,932,706 B1 8/2005 Kaminkow
6,933,861 B2 8/2005 Wang
6,933,923 B2 8/2005 Feinstein
6,935,864 B2 8/2005 Shechter et al.
6,935,952 B2 8/2005 Walker et al.
6,939,232 B2 9/2005 Tanaka et al.
6,948,999 B2 9/2005 Chan
6,954,980 B2 10/2005 Song
6,955,606 B2 10/2005 Taho et al.
6,956,564 B1 10/2005 Williams
6,965,374 B2 11/2005 Villet et al.
6,966,775 B1 11/2005 Kendir et al.
6,967,563 B2 11/2005 Bormaster
6,967,566 B2 11/2005 Weston et al.
6,982,697 B2 1/2006 Wilson et al.
6,983,219 B2 1/2006 Mantyjarvi
6,984,208 B2 1/2006 Zheng
6,990,639 B2 1/2006 Wilson
6,993,451 B2 1/2006 Chang et al.
6,995,748 B2 2/2006 Gordon et al.
6,998,966 B2 2/2006 Pedersen
7,000,469 B2 2/2006 Foxlin et al.
7,002,591 B1 2/2006 Leather
7,004,847 B2 2/2006 Henry
7,005,985 B1 2/2006 Steeves
7,029,400 B2 4/2006 Briggs
7,031,875 B2 4/2006 Ellenby et al.
7,038,661 B2 5/2006 Wilson et al.
7,040,986 B2 5/2006 Koshima
7,040,993 B1 5/2006 Lovitt
7,040,998 B2 5/2006 Jolliffe et al.
7,052,391 B1 5/2006 Luciano, Jr.
7,055,101 B2 5/2006 Abbott et al.
7,056,221 B2 6/2006 Thirkettle et al.
7,059,974 B1 6/2006 Golliffe et al.
7,066,781 B2 * 6/2006 Weston ..... A63H 3/00 446/268
D524,298 S 7/2006 Hedderich et al.
7,081,033 B1 7/2006 Mawle
7,081,051 B2 7/2006 Himoto et al.
7,086,645 B2 8/2006 Hardie
7,090,582 B2 8/2006 Danieli et al.
7,094,147 B2 8/2006 Nakata
7,098,891 B1 8/2006 Pryor
7,098,894 B2 8/2006 Yang
7,102,615 B2 9/2006 Marks
7,102,616 B1 9/2006 Sleator
7,107,168 B2 9/2006 Oystol
D531,228 S 10/2006 Ashida et al.
7,115,032 B2 10/2006 Cantu et al.
7,117,009 B2 10/2006 Wong et al.
7,118,482 B2 10/2006 Ishihara et al.
7,126,584 B1 10/2006 Nishiumi et al.
7,127,370 B2 10/2006 Kelly
D531,585 S 11/2006 Weitgasser et al.
7,133,026 B2 11/2006 Horie et al.
7,136,674 B2 11/2006 Yoshie et al.
7,136,826 B2 11/2006 Alsafadi
7,137,899 B2 11/2006 Hiei
7,139,983 B2 11/2006 Kelts
7,140,962 B2 11/2006 Okuda et al.
7,142,191 B2 11/2006 Idesawa et al.
7,145,551 B1 12/2006 Bathiche
7,149,627 B2 12/2006 Ockerse
7,154,475 B2 12/2006 Crew
7,155,604 B2 12/2006 Kawai
7,158,116 B2 1/2007 Poltorak
7,158,118 B2 1/2007 Liberty
7,160,196 B2 1/2007 Thirkettle et al.
7,168,089 B2 1/2007 Nguyen et al.
7,173,604 B2 2/2007 Marvit
7,176,919 B2 2/2007 Drebin
7,180,414 B2 2/2007 Nyfelt
7,180,503 B2 2/2007 Burr
7,182,691 B1 2/2007 Schena
7,183,480 B2 2/2007 Nishitani et al.
7,184,059 B1 2/2007 Fouladi
D543,246 S 5/2007 Ashida et al.
7,220,220 B2 5/2007 Stubbs et al.
7,223,173 B2 5/2007 Masuyama et al.
7,225,101 B2 5/2007 Usuda et al.
7,231,063 B2 6/2007 Naimark
7,233,316 B2 6/2007 Smith et al.
7,236,156 B2 6/2007 Liberty et al.
7,239,301 B2 7/2007 Liberty et al.
7,252,572 B2 8/2007 Wright et al.
7,261,690 B2 8/2007 Teller et al.
7,262,760 B2 8/2007 Liberty

(56) References Cited

U.S. PATENT DOCUMENTS

RE39,818 E 9/2007 Slifer
7,288,028 B2 10/2007 Rodriquez et al.
D556,201 S 11/2007 Ashida et al.
7,291,014 B2 11/2007 Chung et al.
7,292,151 B2 11/2007 Ferguson et al.
7,297,059 B2 11/2007 Vancura et al.
7,301,527 B2 11/2007 Marvit
7,301,648 B2 11/2007 Foxlin
D556,760 S 12/2007 Ashida et al.
7,307,617 B2 12/2007 Wilson et al.
D559,847 S 1/2008 Ashida et al.
D561,178 S 2/2008 Azuma
7,331,857 B2 2/2008 MacIver
7,335,134 B1 2/2008 LaVelle
D563,948 S 3/2008 d'Hoore
7,337,965 B2 3/2008 Thirkettle et al.
7,339,105 B2 3/2008 Eitaki
7,345,670 B2 3/2008 Armstrong
D567,243 S 4/2008 Ashida et al.
7,359,121 B2 4/2008 French et al.
7,359,451 B2 4/2008 McKnight
7,361,073 B2 4/2008 Martin
RE40,324 E 5/2008 Crawford
7,371,177 B2 5/2008 Ellis et al.
7,379,566 B2 5/2008 Hildreth
7,387,559 B2 6/2008 Sanchez-Castro et al.
7,394,459 B2 7/2008 Bathiche et al.
7,395,181 B2 7/2008 Foxlin
7,398,151 B1 7/2008 Burrell et al.
7,408,453 B2 8/2008 Breed
7,414,611 B2 8/2008 Liberty
7,419,428 B2 9/2008 Rowe
7,424,388 B2 9/2008 Sato
7,428,499 B1 9/2008 Philyaw
7,435,179 B1 10/2008 Ford
7,441,151 B2 10/2008 Whitten et al.
7,442,108 B2 10/2008 Ganz
7,445,550 B2 11/2008 Barney et al.
7,465,212 B2 12/2008 Ganz
7,488,231 B2 * 2/2009 Weston ..... A63H 3/00 446/175
7,488,254 B2 2/2009 Himoto
7,489,299 B2 2/2009 Liberty et al.
7,492,268 B2 2/2009 Ferguson et al.
7,492,367 B2 2/2009 Mahajan et al.
7,500,917 B2 3/2009 Barney et al.
7,502,759 B2 3/2009 Hannigan et al.
7,519,537 B2 4/2009 Rosenberg
7,524,246 B2 4/2009 Briggs et al.
7,535,456 B2 5/2009 Liberty et al.
7,536,156 B2 5/2009 Tischer
7,556,563 B2 7/2009 Ellis et al.
7,564,426 B2 7/2009 Poor
7,568,289 B2 8/2009 Burlingham et al.
7,572,191 B2 8/2009 Weston et al.
7,582,016 B2 9/2009 Suzuki
7,596,466 B2 9/2009 Ohta
7,614,958 B2 11/2009 Weston et al.
7,623,115 B2 11/2009 Marks
7,627,139 B2 12/2009 Marks
7,627,451 B2 12/2009 Vock et al.
7,645,178 B1 1/2010 Trotto et al.
7,662,015 B2 2/2010 Hui
7,663,509 B2 2/2010 Shen
7,674,184 B2 3/2010 Briggs et al.
7,704,135 B2 4/2010 Harrison
7,704,146 B2 4/2010 Ellis
7,727,090 B2 6/2010 Gant
7,749,089 B1 7/2010 Briggs et al.
7,774,155 B2 8/2010 Sato et al.
7,775,882 B2 8/2010 Kawamura et al.
7,775,884 B1 8/2010 McCauley
7,789,741 B1 9/2010 Fields
7,796,116 B2 9/2010 Salsman et al.
7,828,295 B2 11/2010 Matsumoto et al.
7,850,527 B2 12/2010 Barney et al.
7,878,905 B2 2/2011 Weston et al.
7,883,420 B2 2/2011 Bradbury
7,896,742 B2 3/2011 Weston et al.
7,927,216 B2 4/2011 Ikeda
7,942,745 B2 5/2011 Ikeda
7,989,971 B2 8/2011 Lemieux
8,021,239 B2 9/2011 Weston et al.
8,025,573 B2 9/2011 Stenton et al.
8,033,901 B2 10/2011 Wood
8,089,458 B2 1/2012 Barney et al.
8,164,567 B1 4/2012 Barney et al.
8,169,406 B2 5/2012 Barney et al.
8,184,097 B1 5/2012 Barney et al.
8,206,223 B2 6/2012 Marans et al.
8,226,493 B2 7/2012 Briggs et al.
8,248,367 B1 8/2012 Barney et al.
8,287,372 B2 10/2012 Hong et al.
8,287,373 B2 10/2012 Marks et al.
8,330,284 B2 12/2012 Weston et al.
8,342,929 B2 1/2013 Briggs et al.
8,368,648 B2 2/2013 Barney et al.
8,373,659 B2 2/2013 Barney et al.
8,384,668 B2 2/2013 Barney et al.
8,439,757 B2 5/2013 Hornsby et al.
8,469,766 B2 6/2013 Zheng
8,475,275 B2 7/2013 Weston et al.
8,531,050 B2 9/2013 Barney et al.
8,535,153 B2 9/2013 Bradbury et al.
8,602,857 B2 12/2013 Morichau-Beauchant et al.
8,608,535 B2 12/2013 Weston et al.
8,686,579 B2 4/2014 Barney et al.
8,702,515 B2 4/2014 Weston et al.
8,708,821 B2 4/2014 Barney et al.
8,711,094 B2 4/2014 Barney et al.
8,753,165 B2 * 6/2014 Weston ..... A63H 3/00 340/10.1
8,758,136 B2 6/2014 Briggs et al.
8,790,180 B2 7/2014 Barney et al.
8,795,079 B2 8/2014 Penzias, III
8,814,688 B2 8/2014 Barney et al.
8,827,810 B2 9/2014 Weston et al.
8,834,271 B2 9/2014 Ikeda
8,870,655 B2 10/2014 Ikeda
8,888,576 B2 11/2014 Briggs et al.
8,913,011 B2 12/2014 Barney et al.
8,915,785 B2 12/2014 Barney et al.
8,961,260 B2 * 2/2015 Weston ..... A63H 3/00 340/10.1
8,961,312 B2 2/2015 Barney et al.
9,138,650 B2 9/2015 Barney et al.
9,149,717 B2 10/2015 Barney et al.
9,162,148 B2 10/2015 Barney et al.
9,162,149 B2 10/2015 Weston et al.
9,186,585 B2 11/2015 Briggs et al.
2001/0010514 A1 8/2001 Ishino
2001/0015123 A1 8/2001 Nishitani et al.
2001/0018361 A1 8/2001 Acres
2001/0024973 A1 9/2001 Meredith
2001/0031652 A1 10/2001 Gabai et al.
2001/0031662 A1 10/2001 Larian
2001/0034257 A1 10/2001 Weston et al.
2001/0039206 A1 11/2001 Peppel
2001/0040591 A1 11/2001 Abbott et al.
2001/0049302 A1 12/2001 Hagiwara et al.
2001/0054082 A1 12/2001 Rudolph et al.
2002/0005787 A1 1/2002 Gabai et al.
2002/0008622 A1 1/2002 Weston et al.
2002/0024500 A1 2/2002 Howard
2002/0024675 A1 2/2002 Foxlin
2002/0028071 A1 3/2002 Molgaard
2002/0028710 A1 3/2002 Ishihara et al.
2002/0032067 A1 3/2002 Barney
2002/0036617 A1 3/2002 Pryor
2002/0038267 A1 3/2002 Can et al.
2002/0052238 A1 5/2002 Muroi
2002/0058459 A1 5/2002 Holt
2002/0068500 A1 6/2002 Gabai et al.
2002/0072418 A1 6/2002 Masuyama

(56) References Cited

U.S. PATENT DOCUMENTS

| | | | |
|---|---|---|---|
| 2002/0075335 | A1 | 6/2002 | Relimoto |
| 2002/0077182 | A1 | 6/2002 | Swanberg et al. |
| 2002/0090985 | A1 | 7/2002 | Tochner et al. |
| 2002/0090992 | A1 | 7/2002 | Legge et al. |
| 2002/0098887 | A1 | 7/2002 | Himoto et al. |
| 2002/0103026 | A1 | 8/2002 | Himoto et al. |
| 2002/0107069 | A1 | 8/2002 | Ishino |
| 2002/0107591 | A1 | 8/2002 | Gabai et al. |
| 2002/0116615 | A1 | 8/2002 | Nguyen et al. |
| 2002/0118147 | A1 | 8/2002 | Solomon |
| 2002/0123377 | A1 | 9/2002 | Shulman |
| 2002/0126026 | A1 | 9/2002 | Lee et al. |
| 2002/0128056 | A1 | 9/2002 | Kato |
| 2002/0137427 | A1 | 9/2002 | Peters |
| 2002/0137567 | A1 | 9/2002 | Cheng |
| 2002/0140745 | A1 | 10/2002 | Ellenby |
| 2002/0158751 | A1 | 10/2002 | Bormaster |
| 2002/0158843 | A1 | 10/2002 | Levine |
| 2002/0183961 | A1 | 12/2002 | French et al. |
| 2003/0013513 | A1 | 1/2003 | Rowe |
| 2003/0022736 | A1 | 1/2003 | Cass |
| 2003/0027634 | A1 | 2/2003 | Matthews, III |
| 2003/0036425 | A1 | 2/2003 | Kaminkow et al. |
| 2003/0037075 | A1 | 2/2003 | Hannigan |
| 2003/0038778 | A1 | 2/2003 | Noguera |
| 2003/0040347 | A1 | 2/2003 | Roach et al. |
| 2003/0052860 | A1 | 3/2003 | Park et al. |
| 2003/0057808 | A1 | 3/2003 | Lee et al. |
| 2003/0060286 | A1 | 3/2003 | Walker et al. |
| 2003/0063068 | A1 | 4/2003 | Anton |
| 2003/0064812 | A1 | 4/2003 | Rappaport et al. |
| 2003/0069077 | A1 | 4/2003 | Korienek |
| 2003/0073505 | A1 | 4/2003 | Tracy |
| 2003/0095101 | A1 | 5/2003 | Jou |
| 2003/0096652 | A1 | 5/2003 | Siegel et al. |
| 2003/0106455 | A1 | 6/2003 | Weston |
| 2003/0107551 | A1 | 6/2003 | Dunker |
| 2003/0114233 | A1 | 6/2003 | Hiei |
| 2003/0134679 | A1 | 7/2003 | Siegel et al. |
| 2003/0144047 | A1 | 7/2003 | Sprogis |
| 2003/0144056 | A1 | 7/2003 | Leifer et al. |
| 2003/0149803 | A1 | 8/2003 | Wilson et al. |
| 2003/0166416 | A1 | 9/2003 | Ogata |
| 2003/0171145 | A1 | 9/2003 | Rowe |
| 2003/0171190 | A1 | 9/2003 | Rice |
| 2003/0190967 | A1 | 10/2003 | Henry |
| 2003/0193572 | A1 | 10/2003 | Wilson et al. |
| 2003/0195037 | A1 | 10/2003 | Vuong et al. |
| 2003/0195041 | A1 | 10/2003 | McCauley |
| 2003/0195046 | A1 | 10/2003 | Bartsch |
| 2003/0204361 | A1 | 10/2003 | Townsend |
| 2003/0214259 | A9 | 11/2003 | Dowling et al. |
| 2003/0216176 | A1 | 11/2003 | Shimizu |
| 2003/0222851 | A1 | 12/2003 | Lai |
| 2003/0234914 | A1 | 12/2003 | Solomon |
| 2004/0028258 | A1 | 2/2004 | Naimark |
| 2004/0033833 | A1 | 2/2004 | Briggs et al. |
| 2004/0034289 | A1 | 2/2004 | Teller et al. |
| 2004/0043806 | A1 | 3/2004 | Kirby et al. |
| 2004/0048666 | A1 | 3/2004 | Bagley |
| 2004/0063480 | A1 | 4/2004 | Wang |
| 2004/0070564 | A1 | 4/2004 | Dawson |
| 2004/0075650 | A1 | 4/2004 | Paul |
| 2004/0077423 | A1 | 4/2004 | Weston et al. |
| 2004/0081313 | A1 | 4/2004 | McKnight et al. |
| 2004/0095317 | A1 | 5/2004 | Zhang |
| 2004/0102247 | A1 | 5/2004 | Smoot et al. |
| 2004/0119693 | A1 | 6/2004 | Kaemmler |
| 2004/0121834 | A1 | 6/2004 | Libby et al. |
| 2004/0134341 | A1 | 7/2004 | Sandoz |
| 2004/0140954 | A1 | 7/2004 | Faeth |
| 2004/0143413 | A1 | 7/2004 | Oystol |
| 2004/0147317 | A1 | 7/2004 | Ito et al. |
| 2004/0152499 | A1 | 8/2004 | Lind et al. |
| 2004/0152515 | A1 | 8/2004 | Wegmuller et al. |
| 2004/0174287 | A1 | 9/2004 | Deak |
| 2004/0193413 | A1 | 9/2004 | Wilson |
| 2004/0198158 | A1 | 10/2004 | Driscoll et al. |
| 2004/0198517 | A1 | 10/2004 | Briggs |
| 2004/0203638 | A1 | 10/2004 | Chan |
| 2004/0204240 | A1 | 10/2004 | Barney |
| 2004/0207597 | A1 | 10/2004 | Marks |
| 2004/0214642 | A1 | 10/2004 | Beck |
| 2004/0218104 | A1 | 11/2004 | Smith |
| 2004/0222969 | A1 | 11/2004 | Buchenrieder |
| 2004/0227725 | A1 | 11/2004 | Calarco |
| 2004/0229693 | A1 | 11/2004 | Lind |
| 2004/0229696 | A1 | 11/2004 | Beck |
| 2004/0236453 | A1 | 11/2004 | Szoboszlay |
| 2004/0239626 | A1 | 12/2004 | Noguera |
| 2004/0252109 | A1 | 12/2004 | Trent et al. |
| 2004/0254020 | A1 | 12/2004 | Dragusin |
| 2004/0259651 | A1 | 12/2004 | Storek |
| 2004/0268393 | A1 | 12/2004 | Hunleth |
| 2005/0017454 | A1 | 1/2005 | Endo et al. |
| 2005/0020369 | A1 | 1/2005 | Davis |
| 2005/0032582 | A1 | 2/2005 | Mahajan et al. |
| 2005/0047621 | A1 | 3/2005 | Cranfill |
| 2005/0054457 | A1 | 3/2005 | Eyestone |
| 2005/0059488 | A1 | 3/2005 | Larsen et al. |
| 2005/0059503 | A1 | 3/2005 | Briggs et al. |
| 2005/0060586 | A1 | 3/2005 | Burger et al. |
| 2005/0076161 | A1 | 4/2005 | Albanna |
| 2005/0085298 | A1 | 4/2005 | Woolston |
| 2005/0110751 | A1 | 5/2005 | Wilson et al. |
| 2005/0116020 | A1 | 6/2005 | Smolucha et al. |
| 2005/0125826 | A1 | 6/2005 | Hunleth |
| 2005/0127868 | A1 | 6/2005 | Calhoon et al. |
| 2005/0130739 | A1 | 6/2005 | Argentar |
| 2005/0134555 | A1 | 6/2005 | Liao |
| 2005/0138851 | A1 | 6/2005 | Ingraselino |
| 2005/0143173 | A1 | 6/2005 | Barney et al. |
| 2005/0156883 | A1 | 7/2005 | Wilson et al. |
| 2005/0162389 | A1 | 7/2005 | Obermeyer |
| 2005/0164601 | A1 | 7/2005 | McEachen et al. |
| 2005/0170889 | A1 | 8/2005 | Lum et al. |
| 2005/0172734 | A1 | 8/2005 | Alsio |
| 2005/0174324 | A1 | 8/2005 | Liberty |
| 2005/0176485 | A1 | 8/2005 | Ueshima |
| 2005/0179644 | A1 | 8/2005 | Alsio |
| 2005/0202866 | A1 | 9/2005 | Luciano et al. |
| 2005/0210418 | A1 | 9/2005 | Marvit |
| 2005/0210419 | A1 | 9/2005 | Kela |
| 2005/0212749 | A1 | 9/2005 | Marvit et al. |
| 2005/0212750 | A1 | 9/2005 | Marvit et al. |
| 2005/0212751 | A1 | 9/2005 | Marvit et al. |
| 2005/0212752 | A1 | 9/2005 | Marvit et al. |
| 2005/0212753 | A1 | 9/2005 | Marvit et al. |
| 2005/0212754 | A1 | 9/2005 | Marvit et al. |
| 2005/0212755 | A1 | 9/2005 | Marvit |
| 2005/0212756 | A1 | 9/2005 | Marvit et al. |
| 2005/0212757 | A1 | 9/2005 | Marvit et al. |
| 2005/0212758 | A1 | 9/2005 | Marvit et al. |
| 2005/0212759 | A1 | 9/2005 | Marvit et al. |
| 2005/0212760 | A1 | 9/2005 | Marvit et al. |
| 2005/0212764 | A1 | 9/2005 | Toba |
| 2005/0212767 | A1 | 9/2005 | Marvit |
| 2005/0215295 | A1 | 9/2005 | Arneson |
| 2005/0215322 | A1 | 9/2005 | Himoto et al. |
| 2005/0217525 | A1 | 10/2005 | McClure |
| 2005/0227579 | A1 | 10/2005 | Yamaguchi et al. |
| 2005/0233808 | A1 | 10/2005 | Himoto et al. |
| 2005/0239548 | A1 | 10/2005 | Ueshima et al. |
| 2005/0243061 | A1 | 11/2005 | Liberty et al. |
| 2005/0243062 | A1 | 11/2005 | Liberty |
| 2005/0253806 | A1 | 11/2005 | Liberty et al. |
| 2005/0256675 | A1 | 11/2005 | Kurata |
| 2005/0277465 | A1 | 12/2005 | Whitten et al. |
| 2005/0278741 | A1 | 12/2005 | Robarts |
| 2006/0007115 | A1 | 1/2006 | Furuhashi |
| 2006/0028446 | A1 | 2/2006 | Liberty |
| 2006/0030385 | A1 | 2/2006 | Barney et al. |
| 2006/0040720 | A1 | 2/2006 | Harrison |
| 2006/0046849 | A1 | 3/2006 | Kovacs |

(56) References Cited

U.S. PATENT DOCUMENTS

| | | | |
|---|---|---|---|
| 2006/0092133 | A1 | 5/2006 | Touma |
| 2006/0094502 | A1 | 5/2006 | Katayama et al. |
| 2006/0122474 | A1 | 6/2006 | Teller et al. |
| 2006/0123146 | A1 | 6/2006 | Wu et al. |
| 2006/0148563 | A1 | 7/2006 | Yang |
| 2006/0152487 | A1 | 7/2006 | Grunnet-Jepsen |
| 2006/0152488 | A1 | 7/2006 | Salsman |
| 2006/0152489 | A1 | 7/2006 | Sweetser |
| 2006/0154726 | A1 | 7/2006 | Weston et al. |
| 2006/0178212 | A1 | 8/2006 | Penzias |
| 2006/0205507 | A1 | 9/2006 | Ho |
| 2006/0229134 | A1 | 10/2006 | Briggs et al. |
| 2006/0231794 | A1 | 10/2006 | Sakaguchi et al. |
| 2006/0234601 | A1 | 10/2006 | Weston |
| 2006/0246403 | A1 | 11/2006 | Monpouet et al. |
| 2006/0252475 | A1 | 11/2006 | Zalewski et al. |
| 2006/0252477 | A1 | 11/2006 | Zalewski et al. |
| 2006/0256081 | A1 | 11/2006 | Zalewski et al. |
| 2006/0258452 | A1 | 11/2006 | Hsu |
| 2006/0258471 | A1 | 11/2006 | Briggs et al. |
| 2006/0264258 | A1 | 11/2006 | Zalewski et al. |
| 2006/0264260 | A1 | 11/2006 | Zalewski et al. |
| 2006/0267935 | A1 | 11/2006 | Corson |
| 2006/0273907 | A1 | 12/2006 | Heiman |
| 2006/0282873 | A1 | 12/2006 | Zalewski et al. |
| 2006/0284842 | A1 | 12/2006 | Poltorak |
| 2006/0287030 | A1 | 12/2006 | Briggs et al. |
| 2006/0287085 | A1 | 12/2006 | Mao |
| 2006/0287086 | A1 | 12/2006 | Zalewski et al. |
| 2006/0287087 | A1 | 12/2006 | Zalewski et al. |
| 2007/0015588 | A1 | 1/2007 | Matsumoto et al. |
| 2007/0021208 | A1 | 1/2007 | Mao et al. |
| 2007/0049374 | A1 | 3/2007 | Ikeda et al. |
| 2007/0050597 | A1 | 3/2007 | Ikeda |
| 2007/0052177 | A1 | 3/2007 | Ikeda et al. |
| 2007/0060391 | A1 | 3/2007 | Ikeda et al. |
| 2007/0066394 | A1 | 3/2007 | Ikeda et al. |
| 2007/0066396 | A1 | 3/2007 | Weston et al. |
| 2007/0072680 | A1 | 3/2007 | Ikeda et al. |
| 2007/0082720 | A1 | 4/2007 | Bradbury et al. |
| 2007/0087837 | A1 | 4/2007 | Bradbury et al. |
| 2007/0087838 | A1 | 4/2007 | Bradbury et al. |
| 2007/0087839 | A1 | 4/2007 | Bradbury et al. |
| 2007/0091084 | A1 | 4/2007 | Ueshima et al. |
| 2007/0093170 | A1 | 4/2007 | Zheng |
| 2007/0093291 | A1 | 4/2007 | Hulvey |
| 2007/0093293 | A1 | 4/2007 | Osnato |
| 2007/0100696 | A1 | 5/2007 | Illingworth |
| 2007/0159362 | A1 | 7/2007 | Shen |
| 2007/0173705 | A1 | 7/2007 | Teller et al. |
| 2007/0249425 | A1 | 10/2007 | Weston et al. |
| 2007/0252815 | A1 | 11/2007 | Kuo |
| 2007/0257884 | A1 | 11/2007 | Taira |
| 2007/0265075 | A1 | 11/2007 | Zalewski |
| 2007/0265076 | A1 | 11/2007 | Lin |
| 2007/0265088 | A1 | 11/2007 | Nakada et al. |
| 2008/0014835 | A1 | 1/2008 | Weston et al. |
| 2008/0015017 | A1 | 1/2008 | Ashida et al. |
| 2008/0039202 | A1 | 2/2008 | Sawano et al. |
| 2008/0119270 | A1 | 5/2008 | Ohta |
| 2008/0121782 | A1 | 5/2008 | Hotelling et al. |
| 2008/0174550 | A1 | 7/2008 | Laurila |
| 2008/0183678 | A1 | 7/2008 | Weston et al. |
| 2008/0273011 | A1 | 11/2008 | Lin |
| 2008/0278445 | A1 | 11/2008 | Sweester |
| 2009/0009294 | A1 | 1/2009 | Kupstas |
| 2009/0033621 | A1 | 2/2009 | Quinn |
| 2009/0051653 | A1 | 2/2009 | Barney et al. |
| 2009/0124165 | A1 | 5/2009 | Weston |
| 2009/0156309 | A1 | 6/2009 | Weston et al. |
| 2009/0203446 | A1 | 8/2009 | Bradbury et al. |
| 2009/0215534 | A1 | 8/2009 | Wilson et al. |
| 2009/0273560 | A1 | 11/2009 | Kalanithi et al. |
| 2009/0305799 | A1 | 12/2009 | Weston et al. |
| 2009/0326851 | A1 | 12/2009 | Tanenhaus |
| 2010/0056285 | A1 | 3/2010 | Weston et al. |
| 2010/0105475 | A1 | 4/2010 | Mikhailov |
| 2010/0144436 | A1 | 6/2010 | Marks et al. |
| 2010/0203932 | A1 | 8/2010 | Briggs et al. |
| 2010/0273556 | A1 | 10/2010 | Briggs et al. |
| 2010/0289744 | A1 | 11/2010 | Cohen |
| 2011/0081969 | A1 | 4/2011 | Ikeda |
| 2011/0081970 | A1 | 4/2011 | Barney et al. |
| 2011/0177853 | A1 | 7/2011 | Ueshima |
| 2011/0190052 | A1 | 8/2011 | Takeda |
| 2011/0263330 | A1 | 10/2011 | Weston et al. |
| 2011/0300941 | A1 | 12/2011 | Weston et al. |
| 2012/0004031 | A1 | 1/2012 | Barney et al. |
| 2012/0034980 | A1 | 2/2012 | Weston et al. |
| 2012/0094759 | A1 | 4/2012 | Barney et al. |
| 2012/0122575 | A1 | 5/2012 | Barney et al. |
| 2012/0190452 | A1 | 7/2012 | Weston et al. |
| 2012/0208638 | A1 | 8/2012 | Barney et al. |
| 2012/0258802 | A1 | 10/2012 | Weston et al. |
| 2012/0270657 | A1 | 10/2012 | Barney et al. |
| 2012/0295710 | A1 | 11/2012 | Barney et al. |
| 2012/0309528 | A1 | 12/2012 | Barney et al. |
| 2013/0079141 | A1 | 3/2013 | Barney et al. |
| 2013/0116020 | A1 | 5/2013 | Barney et al. |
| 2013/0116051 | A1 | 5/2013 | Barney et al. |
| 2013/0165228 | A1 | 6/2013 | Barney et al. |
| 2013/0196770 | A1 | 8/2013 | Barney et al. |
| 2013/0217453 | A1 | 8/2013 | Briggs et al. |
| 2013/0303276 | A1 | 11/2013 | Weston et al. |
| 2014/0194206 | A1 | 7/2014 | Barney et al. |
| 2014/0235341 | A1 | 8/2014 | Barney et al. |
| 2014/0256446 | A1 | 9/2014 | Barney et al. |
| 2014/0323221 | A1 | 10/2014 | Ikeda |
| 2014/0357373 | A1 | 12/2014 | Barney et al. |
| 2014/0378233 | A1 | 12/2014 | Weston et al. |
| 2015/0050971 | A1 | 2/2015 | Briggs et al. |
| 2015/0094140 | A1 | 4/2015 | Barney et al. |
| 2015/0165316 | A1 | 6/2015 | Barney et al. |
| 2015/0251100 | A1 | 9/2015 | Barney et al. |
| 2015/0290545 | A1 | 10/2015 | Barney et al. |
| 2015/0360125 | A1 | 12/2015 | Barney et al. |

FOREIGN PATENT DOCUMENTS

| | | | |
|---|---|---|---|
| CN | 1338961 | | 3/2002 |
| CN | 1559644 | | 1/2005 |
| DE | 3930581 | | 3/1991 |
| DE | 19701374 | | 7/1997 |
| DE | 19632273 | | 2/1998 |
| DE | 19648487 | | 6/1998 |
| DE | 19814254 | | 10/1998 |
| DE | 19937307 | | 2/2000 |
| DE | 10029173 | | 1/2002 |
| DE | 10219198 | | 11/2003 |
| EP | 0 264 782 | A2 | 4/1988 |
| EP | 0 570 999 | | 12/1988 |
| EP | 0 322 825 | A2 | 7/1989 |
| EP | 0 695 565 | A1 | 2/1996 |
| EP | 0 835 676 | | 4/1998 |
| EP | 0 848 226 | | 6/1998 |
| EP | 0 852 961 | | 7/1998 |
| EP | 1 062 994 | | 12/2000 |
| EP | 1 279 425 | | 1/2003 |
| EP | 1 293 237 | | 3/2003 |
| EP | 0 993 845 | | 12/2005 |
| FR | 2547093 | A1 | 12/1984 |
| GB | 2244546 | | 12/1991 |
| GB | 2284478 | | 6/1995 |
| GB | 2307133 | | 5/1997 |
| GB | 2310481 | | 8/1997 |
| GB | 2316482 | | 2/1998 |
| GB | 2319374 | | 5/1998 |
| GB | 2325558 | A | 11/1998 |
| GB | 2388418 | | 11/2003 |
| JP | 62-14527 | | 1/1987 |
| JP | 63-186687 | | 8/1988 |
| JP | 03-210622 | | 9/1991 |
| JP | 06-050758 | | 2/1994 |
| JP | 6154422 | | 6/1994 |

(56) References Cited

FOREIGN PATENT DOCUMENTS

| | | | |
|---|---|---|---|
| JP | 06-198075 | | 7/1994 |
| JP | 6190144 | | 7/1994 |
| JP | H0677387 | | 10/1994 |
| JP | 06-308879 | | 11/1994 |
| JP | 07-028591 | | 1/1995 |
| JP | 07-044315 | | 2/1995 |
| JP | 07-107573 | | 4/1995 |
| JP | 07-115690 | | 5/1995 |
| JP | 07-146123 | | 6/1995 |
| JP | 07-200142 | | 8/1995 |
| JP | 07-262797 | | 10/1995 |
| JP | 07-302148 | | 11/1995 |
| JP | 07-318332 | | 12/1995 |
| JP | 08-095704 | | 4/1996 |
| JP | 08-106352 | | 4/1996 |
| JP | 08-111144 | | 4/1996 |
| JP | 08-114415 | | 5/1996 |
| JP | 08-122070 | | 5/1996 |
| JP | 08-152959 | | 6/1996 |
| JP | 08-191953 | | 7/1996 |
| JP | 08-211993 | | 8/1996 |
| JP | 08-221187 | | 8/1996 |
| JP | 08-305355 | | 11/1996 |
| JP | 08-335136 | | 12/1996 |
| JP | 09-034456 | | 2/1997 |
| JP | 09-149915 | | 6/1997 |
| JP | 09-164273 | | 6/1997 |
| JP | 09-225137 | | 9/1997 |
| JP | 09-230997 | | 9/1997 |
| JP | 09-237087 | | 9/1997 |
| JP | 09-274534 | | 10/1997 |
| JP | 09-319510 | | 12/1997 |
| JP | 10-021000 | | 1/1998 |
| JP | 10-033831 | | 2/1998 |
| JP | 10-043349 | A | 2/1998 |
| JP | 10-099542 | | 4/1998 |
| JP | 10-154038 | | 6/1998 |
| JP | 10-235019 | | 9/1998 |
| JP | 10-254614 | | 9/1998 |
| JP | 11-053994 | | 2/1999 |
| JP | 11-099284 | | 4/1999 |
| JP | 2000-176150 | | 6/2000 |
| JP | 2000-208756 | | 7/2000 |
| JP | 2000-270237 | | 9/2000 |
| JP | 2000-300839 | | 10/2000 |
| JP | 2000-308756 | | 11/2000 |
| JP | 2000-325653 | | 11/2000 |
| JP | 2001-038052 | | 2/2001 |
| JP | 2001-058484 | | 3/2001 |
| JP | 2001-104643 | | 4/2001 |
| JP | U20009165 | | 4/2001 |
| JP | 2001-175412 | | 6/2001 |
| JP | 2001-251324 | | 9/2001 |
| JP | 2001-265521 | | 9/2001 |
| JP | 2001-306245 | | 11/2001 |
| JP | 2002-007057 | | 1/2002 |
| JP | 2002-062981 | | 2/2002 |
| JP | 2002-78969 | | 3/2002 |
| JP | 2002-082751 | | 3/2002 |
| JP | 2002-091692 | | 3/2002 |
| JP | 2002-126375 | | 5/2002 |
| JP | 2002-136694 | | 5/2002 |
| JP | 2002-153673 | | 5/2002 |
| JP | 2002-202843 | | 7/2002 |
| JP | 2002-224444 | | 8/2002 |
| JP | 2002-233665 | | 8/2002 |
| JP | 2002-298145 | | 10/2002 |
| JP | 2003-053038 | | 2/2003 |
| JP | 2003-140823 | | 5/2003 |
| JP | 2003-208263 | | 7/2003 |
| JP | 2003 236246 | | 8/2003 |
| JP | 2003-325974 | | 11/2003 |
| JP | 2004-062774 | | 2/2004 |
| JP | 2004-313429 | | 11/2004 |
| JP | 2004-313492 | | 11/2004 |
| JP | 2005-040493 | | 2/2005 |
| JP | 2005-063230 | | 3/2005 |
| JP | 2006-113019 | | 4/2006 |
| JP | 2006-136694 | | 6/2006 |
| JP | 2006-216569 | | 8/2006 |
| JP | 2007-083024 | | 4/2007 |
| JP | 4043702 | | 2/2008 |
| NL | 9300171 | | 8/1994 |
| RU | 2077358 | C1 | 4/1997 |
| RU | 2125853 | | 2/1999 |
| RU | 2126161 | | 2/1999 |
| WO | WO 90/07961 | | 7/1990 |
| WO | WO 94/02931 | | 3/1994 |
| WO | WO 95/11730 | A1 | 5/1995 |
| WO | WO 96/05766 | | 2/1996 |
| WO | WO 96/14115 | | 5/1996 |
| WO | WO 96/14121 | | 5/1996 |
| WO | WO 97/09101 | | 3/1997 |
| WO | WO 97/12337 | | 4/1997 |
| WO | WO 97/17598 | | 5/1997 |
| WO | WO 97/20305 | | 6/1997 |
| WO | WO 97/28864 | | 8/1997 |
| WO | WO 97/32641 | | 9/1997 |
| WO | WO 98/11528 | | 3/1998 |
| WO | WO 98/36400 | | 8/1998 |
| WO | WO 99/58214 | | 11/1999 |
| WO | WO 00/33168 | | 6/2000 |
| WO | WO 00/35345 | | 6/2000 |
| WO | WO 00/61251 | A1 | 10/2000 |
| WO | WO 00/63874 | | 10/2000 |
| WO | WO 00/67863 | | 11/2000 |
| WO | WO 01/46916 | | 6/2001 |
| WO | WO 01/46916 | A2 | 6/2001 |
| WO | WO 01/87426 | | 11/2001 |
| WO | WO 01/91042 | | 11/2001 |
| WO | WO 02/17054 | | 2/2002 |
| WO | WO 02/34345 | | 5/2002 |
| WO | WO 02/47013 | | 6/2002 |
| WO | WO 03/015005 | | 2/2003 |
| WO | WO 03/043709 | | 5/2003 |
| WO | WO 03/044743 | A2 | 5/2003 |
| WO | WO 03/088147 | | 10/2003 |
| WO | WO 03/107260 | | 12/2003 |
| WO | WO 2004/039055 | | 5/2004 |
| WO | WO 2004/051391 | | 6/2004 |
| WO | WO 2004/087271 | | 10/2004 |
| WO | WO 2006/039339 | | 4/2006 |
| WO | WO 2006/101880 | | 9/2006 |
| WO | WO 2007/058996 | | 5/2007 |
| WO | WO 2007/120880 | | 10/2007 |

OTHER PUBLICATIONS

"Smart Card News Online", published Oct. 25, 2006, source www.smartcard.co.ukINOLARCH/2006/October/251006.html.

"Emerald Forest Toys" [online] [retrieved on Sep. 14, 2005], retrieved from Internet <URL:http://www.pathworks.net/print_eft.html>.

"Gatemaster Features", "Gatemaster Main Screen", "Gatemaster: So You're a Computer Geek eh?", and "Gatemaster Pricing" by Gate Master Management System, internet article, Jul. 9, 1997; http://web.archive.org/web/19970709135000/www.gatemaster.com/gmfeat.htm (accessed on Dec. 11, 2008).

"Ollivanders: Makers of Fine Wands." Dec. 2, 2002. [online] [retrieved on Mar. 30, 2005], Retrieved from Internet (URL:http//www.cim.mcgill.edu/!jer/courses/hci/assignments/2002/www.ece.mcgill.ca/%7Eeuryd).

International Preliminary Examination Report, International App. No. PCT/US00/09482; dated Apr. 24, 2001; 4 pages.

International Search Report and Written Opinion, International App. No. PCT/US04/08912; mailed Aug. 26, 2004; 10 pages.

International Search Report and Written Opinion, International App. No. PCT/US05/34831; mailed Jul. 2, 2008; 11 pages.

International Search Report and Written Opinion; International Appl. No. PCT/US2006/043915; mailed Mar. 9, 2007; 8 pages.

Laser Tag: General info: History of Laser Tag, http://lasertag.org/general/history.html (accessed on Mar. 13, 2008; historical dates start on Mar. 1984).

(56) References Cited

OTHER PUBLICATIONS

Laser Tag: Lazer Tag Branded Gear; last update Sep. 26, 2006, http://home.comcast.net/~ferret1963/Lazer_Tag_Brand.html (accessed on Mar. 13, 2008; historical dates start in 1986).
Owl Magic Wand & Owl Magic Orb Raving Toy Maniac, Nov. 19, 2001. [online] [retrieved on Mar. 30, 2005], Retrieved from the Internet (URL:http://www.toymania.com/news/messages/1358.shtm1).
"At-home fishing", http:www.virtualpet.com/vp/media/fishing/homef.jpg (accessed on Jan. 14, 2010).
"Coleco Vision: Super Action™ Controller Set," www.vintagecomputing.com/wp-content/images/retroscan/coleco_sac_1_large.jpg. (downloaded from Internet on Sep. 2, 2011; available at http://www.vintagecomputing.com on Sep. 4, 2006).
"Controllers-Atari Space Age Joystic," AtariAge: Have You Played Atari Today? www.atariage.com/controller_page.html?SystemID=26008( ControllerID-12., Sep. 1, 2006.
"Controllers-Booster Grip," AtariAge: Have You Played Atari Today? www.atariage.com/controller_page.html?SystemID=26008& ControllerID=18., (accessed on Jul. 29, 2011; allegedly available as early as Sep. 1, 2006).
"Electronic Plastic: BANDAI—Power Fishing" "Power Fishing Company: BANDAI," 1 page, http://www.handhelden.com/Bandai/PowerFishing.html., 1984 (accessed on Jul. 29, 2011).
"Game Controller" Wikipedia, Jan. 5, 2005.
"Get Bass," Videogame by Sega, The International Arcade Museum and the KLOV (accessed at http://www.arcade-museum.com/game_detail.php?game_id=7933 on Jul. 29, 2011).
"Glove-based input interfaces" Cyberglove/Cyberforce, http://www.angelfire.com/ca7/mellott124/glove1.htm (accessed on Jul. 29, 2011).
"Harry Potter Magic Spell Challenge," Tiger Electronics, 2001.
"Imp Coexists With Your Mouse," Byte, p. 255, Jan. 1994.
"MEMS enable smart golf clubs," Small Times, Jan. 6, 2005, accessed at http://dpwsa.electroiq.com/index/display/semiconductors-article-display/269788/articles/small-times/consumer/2005/01/mems-enable-smart-golf-clubs.html on Jul. 29, 2011.
"Miacomet and Interact Announce Agreement to Launch Line of Reel Feel™ Sport Controllers", PR Newswire (May 13, 1999), accessed at http://www.thefreelibrary.com/_print/PrintArticle.aspx?id=54621351 on Sep. 7, 2011.
"The N.I.C.E. Project," YouTube video uploaded by evltube on Nov. 20, 2007 (accessed at http://www.youtube.com/watch?v=ihGXa21qLms on Sep. 8, 2011; digital video available upon request).
"212 Series Encoders" HT12A/HT12E by HOLTEK-Product Specification, Apr. 2000.
"212 Series of Decoders" HT12D/HT12F by HOLTEK-Product Specification, Nov. 2002.
"ASCII Entertainment releases the Grip," ASCII Entertainment Software—Press News—Coming Soon Magazine, May 1997 (electronic version accessed at http://www.csoon.com/issue25/p_ascii4.htm on Sep. 6, 2011).
"Enchanted Spell-Casting Sorcerers Wand" by Ken Holt as featured on www.inventionconnection.com online advertisement, Dec. 2002.
"Interview with Pat Goschy, the "Real" Nintendo Wii Inventor," YouTube video uploaded by agbulls on Jan. 14, 2008 (accessed at http://www.youtube.com/watch?v=oKtZysYGDLE on Feb. 11, 2011; digital copy of video available upon request).
"Micro Tilt Switch" D6B by Omron® Product Specification, Jan. 2007.
"Nintendo Wii Controller Invented by Americans: Midway Velocity Controller Technology Brief," You Tube Video presentation dated Jun. 28, 2000; uploaded by drjohniefever on Sep. 8, 2007 (accessed at http://www.youtube.com/watch?v=wjLhSrSxFNw on Jun. 30, 2010; digital video available upon request).
"Raise High the 3D Roof Beam: Kids shape these PC games as they go along." by Anne Field, article as featured in Business Week 2001. (Nov. 26, 2001).
"Serial-in Parallel-out Shift Register" SN54/74LS164 by Motorola-Product Specification, Fifth Edition, 1992.
"Sony PS2 Motion Controller 5 years ago (2004)," YouTube Video uploaded by r1oot on Jul. 8, 2009 (accessed at http://www.youtube.com/watch?v=JbSzmRt7HhQ8deature=related on Sep. 6, 2011; digital video available upon request).
"The Big Ideas Behind Nintendo's Wii," Business Week, Nov. 16, 2006 (accessed at http://www.businessweek.com/technology/content/nov2006/tc20061116_750580.htm on Aug. 31, 2011).
"The Magic Labs Conjure Wands" as featured on www.magic-lab.com Product Specification, Dec. 2002.
"Tilt Switch" by Fuji & Co. as featured on www.fuji-piezo.com online advertisement, May 2001.
"Toy Wand Manufacturer Selects MEMSIC Sensor: Magic Labs cuts costs with MEMSIC sensor" Press Release by MEMSIC, Inc. as featured on www.memsic.com, May 2002.
"Wii Mailbag," IGN.com, Jan. 26, 2006 (accessed at http://uk.wii.ign.com/mail/2006-01-26.html on Aug. 31, 2011).
Acar, et al., "Experimental evaluation and comparative analysis of commercial variable-capacitance MEMS accelerometers," Journal of Micromechanics and Microengineering, vol. 13 (1), pp. 634-645, May 2003.
Achenbach, "Golf's New Measuring Stick," Golfweek, 1 page, Jun. 11, 2005.
ACT Labs, Miacomet Background, Jan. 27, 2001, http://web.archive.org/web/200101271753/http://www.act-labs.com/ realfeel_background.htm, (accessed on Sep. 7, 2011).
AGARD, "Advances in Strapdown Inertial Systems," Agard Lecture Series No. 133, Advisory Group for Aerospace Research and Development, Neuilly-Sur-Seine (France) May 1984.
AirPad Controller Manual, (AirPad Corp. 2000).
Airpad Motion Reflex Controller for Sony Playstation—Physical Product, (AirPad Corp. 2000).
Algrain, "Estimation of 3-D Angular Motion Using Gyroscopes and Linear Accelerometers," IEEE Transactions on Aerospace and Electronic Systems, vol. 27, No. 6, pp. 910-920, Nov. 1991.
Algrain, et al., "Accelerometer Based Line-of-Sight Stabilization Approach for Pointing and Tracking System," Second IEEE Conference on Control Applications, Sep. 13-16, 1993 Vancouver, B.C.., pp. 159-163 Sep. 13-16, 1993.
Algrain, et al., "Interlaced Kalman Filtering of 3-D Angular Motion Based on Euler's Nonlinear Equations," IEEE Transactions on Aerospace and Electronic Systems, vol. 30, No. 1, Jan. 1994.
Allen, et al., "A General Method for Comparing the Expected Performance of Tracing and Motion Capture Systems," {VRST} '05: Proceedings of the ACM Symposium on Virtual Reality Software and Technology, Nov. 7-9, 2005 Monterey, California Nov. 7-9, 2005.
Allen, et al., "Tracking: Beyond 15 Minutes of Thought," SIGGRAPH 2001 Course 11, Aug. 2001.
Analog Devices "ADXL202E Low-Cost .+−.2 g Dual-Axis Accelerometer with Duty Cycle Output" Data Sheet, Rev. A, Oct. 2000.
Analog Devices "ADXL330 Small, Low Power, 3-Axis ±2 g iMEMS Accelerometer" Data Sheet, Rev. PrA Oct. 2005.
Analog Devices "ADXL50 Monolithic Accelerometer with Signal Conditioning" Data Sheet Mar. 1996.
Analog Devices "ADXRS150±150°/s Single Chip Yaw Rate Gyro with Signal Conditioning" Data Sheet, Rev. B, Mar. 2004.
Analog Devices "ADXRS401 ±75°/s Single Chip Yaw Rate Gyro with Signal Conditioning" Data Sheet, Rev. O, Jul. 2004.
Analog Devices "MicroConverter®, Multichannel 12-Bit ADC with Embedded Flash MCU, ADuC812" Data Sheet (Feb. 2003), available at http://www.analog.com/static/imported-files/data_sheets/ADUC812.pdf.
Analog Devices, "ADXL150/ADXL250, ±5g to ±50g, Low Noise, Low Power, Single/Dual Axis iMEMS® Accelerometers," Data Sheet, Rev. 0 (Apr. 1998).
Ang, et al., "Design and Implementation of Active Error Canceling in Hand-held Microsurgical Instrument," Paper presented at 2001 IEEE/RSJ International Conference on Intelligent Robots and Systems (Oct./Nov. 2001).
Ang, et al., "Design of All-Accelerometer Inertial Measurement Unit for Tremor Sensing in Hand-held Microsurgical Instrument," Pro-

(56) References Cited

OTHER PUBLICATIONS ceedings of the 2003 IEEE International Conference on Robotics & Automation, Sep. 14-19, 2003, Taipei, Taiwan, pp. 1781-1786, Sep. 14-19, 2003.
Apostolyuk, Vladislav, "Theory and Design of Micromechanical Vibratory Gyroscopes," MEMS/NEMS Handbook, Springer, vol. 1, pp. 173-195 (May 2006).
Ascension Technology, 6D Bird Class B Installation and Operation Guide, Apr. 30, 2003.
ASCII, picture of one-handed controller, 2 pages, Feb. 6, 2006.
Ator, "Image-Velocity Sensing with Parallel-Slit Reticles," Journal of the Optical Society of America, vol. 53, No. 12, pp. 1416-1422, Dec. 1963.
Azarbayejani, et al, "Real-Time 3-D Tracking of the Human Body," M.I.T. Media Laboratory Perceptual Computing Section Technical Report No. 374, Appears in Proceedings of Image'Com 96, Bordeaux, France, May 1996.
Azarbayejani, et al., "Visually Controlled Graphics," M.I.T. Media Laboratory Perceptual Computing Section Technical Report No. 374, Appears in IEEE Transactions on Pattern Analysis and Machine Intelligence, vol. 15, No. 6, pp. 602-605, Jun. 1993.
Azuma et al., "Improving Static and Dynamic Registration in an Optical See-Through HMD," Paper Presented at SIGGRAPH '94 Annual Conference in Orlando, FL, Mar. 1994.
Azuma, "Predictive Tracking for Augmented Reality," Ph.D. Dissertation, University of North Carolina at Chapel Hill, Department of Computer Science, Feb. 1995.
Azuma, et al., "A Frequency-Domain Analysis of Head-Motion Prediction," Paper Presented at Siggraph '95 Annual Conference in Los Angeles, CA, Feb. 1995.
Azuma, et al., "A motion-stabilized outdoor augmented reality system," Proceedings of IEEE Virtual Reality '99, Houston, TX, Mar. 13-17, 1999, pp. 252-259.
Azuma, et al., "Making Augmented Reality Work Outdoors Requires Hybrid Tracking," Proceedings of the International Workshop on Augmented Reality, San Francisco, CA, Nov. 1, 1998.
Bachmann et al., "Inertial and Magnetic Posture Tracking for Inserting Humans into Networked Virtual Environments," Virtual Reality Software and Technology archive, Paper Presented at ACM Symposium on Virtual Reality Software and Technology in Banff, Alberta, Canada, Dec. 2000.
Bachmann et al., "Orientation Tracking for Humans and Robots Using Inertial Sensors" Paper Presented at 199 International Symposium on Computational Intelligence in Robotics & Automation (CIRA '99), Mar. 1999.
Bachmann, "Inertial and Magnetic Angle Tracking of Limb Segments for Inserting Humans into Synthetic Environments," Dissertation, Naval Postgraduate School, Monterey, CA (Dec. 2000).
Badler, et al., "Multi-Dimensional Input Techniques and Articulated Figure Positioning by Multiple Constraints," Interactive 3D Graphics, Oct. 1986; pp. 151-169.
Baker et al., "Active Multimodal Control of a 'Floppy' Telescope Structure," Proc. SPIE, vol. 4825, pp. 74-81 (2002).
Balakrishnan, "The Rockin' Mouse: Integral 3D Manipulation on a Plane," Published in Proceedings of 1997 ACM Conference on Human Factors in Computing Systems (CHI'97), pp. 311-318, Jun. 1997.
Ballagas, et al., "iStuff: A Physical User Interface Toolkit for Ubiquitous Computer Environments," Paper presented at SIGCHI Conference on Human Factors in Computing Systems, Apr. 2003.
Baraff, "An Introduction to Physically Based Modeling: Rigid Body Simulation I—Unconstrained Rigid Body Dynamics," SIGGRAPH 97 Course Notes, Robotics Institute, Carnegie Mellon University (Aug. 1997).
Baudisch, et al., "Soap: a Pointing Device that Works in Mid-air," Proc. UIST'06, Oct. 15-18, 2006, Montreux, Switzerland (Oct. 2006).
BBN Report No. 7661, "Virtual Environment Technology for Training (VETT)," The Virtual Environment and Teleoperator Research Consortium (VETREC), pp. III-A-27 to III-A-40 (Mar. 1992).
Behringer, "Improving the Registration Precision by Visual Horizon Silhouette Matching," Paper presented at First IEEE Workshop on Augmented Reality (Feb. 1998).
Behringer, "Registration for Outdoor Augmented Reality Applications Using Computer Vision Techniques and Hybrid Sensors," Paper presented at IEEE Virtual Reality (VR '99) Conference in Houston, TX (Mar. 1999).
BEI GyrochipTM Model QRS11 Data Sheet, BEI Systron Donner Inertial Division, BEI Technologies, Inc., (Sep. 1998).
Benbasat, "An Inertial Measurement Unit for User Interfaces," Massachusetts Institute of Technology Masters Thesis, (Sep. 2000).
Benbasat, et al., "An Inertial Measurement Framework for Gesture Recognition and Applications," Paper Presented at International Gesture Workshop on Gesture and Sign Languages in Human-Computer Interaction (GW '01), London, UK (Sep. 2001).
Bhatnagar, "Position trackers for Head Mounted Display systems: A survey" (Technical Report), University of North Carolina at Chapel Hill (Mar. 1993).
Bianchi, "A Tailless Mouse, New cordless Computer Mouse Invented by ArcanaTech," Inc.com, Jun. 1, 1992 (accessed at http://www.inc.com/magazine/19920601/4115.html on Jun. 17, 2010).
Bishop, "The Self-Tracker: A Smart Optical Sensor on Silicon," Ph.D. Dissertation, Univ. of North Carolina at Chapel Hill (1984), 65 pages.
Bjork, Staffan et al., "Pirates! Using the Physical World as a Game Board," Reportedly presented as part of Interact 2001: 8th TC.13 IFIP International Conference on Human-Computer Interaction, Tokyo Japan (Jul. 9-13, 2001).
Bluffing Your Way in Pokemon, Oct. 14, 2002, 7 pages.
Bona, et al., "Optimum Reset of Ship's Inertial Navigation System," IEEE Transactions on Aerospace and Electronic Systems, Abstract only (1965) (accessed at http://oai.dtic.mil/oai/oai?verb=getRecord8tmetadataPrefix=html &identifier=AD0908193 on Jun. 17, 2010).
Borenstein, et al., "Where am I? Sensors and Methods for Mobile Robot Positioning" (Apr. 1996).
Borovoy, R. , et al., "Things that Blink: Computationally Augmented Name Tags," IBM Systems Journal, vol. 35, Nos. 3 & 4, 1996; pp. 488-495 (May 1996).
Borovoy, Richard et al., "Groupwear: Nametags That Tell About Relationships," Chi 98, Apr. 1998, pp. 329-330.
Boser, "3-Axis Accelerometer with Differential Sense Electronics," Berkeley Sensor & Actuator Center, available at http://www.eecs.berkeley.edu/.about.boser/pdf/3axis.pdf (Feb. 1997).
Boser, "Accelerometer Design Example: Analog Devices XL-05/5," Berkeley Sensor & Actuator Center, available at http://www.eecs.berkeley.edu/.about.boser/pdf/xI05.pdf (1996).
Bowman, et al., "An Introduction to 3-D User Interface Design," MIT Presence, vol. 10, No. 1, pp. 96-108 (Feb. 2001).
Briefs, (New & Improved), (Brief Article), PC Magazine, Oct. 26, 1993.
Britton et al., "Making Nested Rotations Convenient for the User," SIGGRAPH '78 Proceedings of the 5th Annual Conference on Computer Graphics and Interactive Techniques, vol. 12, Issue 3, pp. 222-227 (Aug. 1978).
Britton, "A Methodology for the Ergonomic Design of Interactive Computer Graphic Systems, and its Application to Crystallography" Ph.D. Dissertation, University of North Carolina at Chapel Hill, Dept. of Computer Science (1977).
Brownell, Richard, Review: Peripheral-GameCube-G3 Wireless Controller, gamesarefun.com, Jul. 13, 2003 (accessed at http://www.gamesarefun.com/gamesdb/perireview.php?perireviewid=1 on Jul. 29, 2011).
Buchanan, Levi: "Happy Birthday, Rumble Pak," IGN.com, Apr. 3, 2008 (accessed at http://retro.ign.com/articles/864/864231p1.html on Jul. 29, 2011).
Business Wire, "Feature/Virtual reality glasses that interface to Sega channel,Time Warner, TCI; project announced concurrent with COMDEX," Nov. 14, 1994 (accessed at http://findarticles.com/p/articles/mi_m0EIN/is_1994_Nov_14/ai_15923497/?tag=content;col1 on Jul. 7, 2010).
Business Wire, "Free-space 'Tilt' Game Controller for Sony Playstation Uses Scenix Chip; SX Series IC Processes Spatial Data in Real

(56) References Cited

OTHER PUBLICATIONS

Time for On-Screen," Dec. 6, 1999 (accessed at http://findarticles.com/p/articles/mi_m0EIN/is_1999_Dec_6/ai_58042965/?tag=content;col1 on Jul. 7, 2010)).
Business Wire, "Logitech MAGELLAN 3D Controller," Apr. 14, 1997 (accessed at http://www.thefreelibrary.com/_/print/PrintArticle.aspx?id=19306114 on Feb. 10, 2011).
Business Wire, "Mind Path Introduces GYROPOINT RF Wireless Remote," Jan. 27, 2000 (accessed at http://www.allbusiness.com/company-activities-management/operations-office/6381880-1.html on Jun. 17, 2010).
Business Wire, "Pegasus' Wireless PenCell Writes on Thin Air with ART's Handwriting Recognition Solutions," Business Editors/High Tech Writers Telecom Israel 2000 Hall 29, Booth 19-20, Nov. 7, 2000 (accessed at http://www.highbeam.com/doc/1G1-66658008.html on Jun. 17, 2010).
Business Wire, "RPI ships low-cost pro HMD Plus 3D Mouse and VR PC graphics card system for CES," Jan. 9, 1995 (accessed at http://www.highbeam.com/doc/1G1-16009561.html on Jun. 17, 2010).
Business Wire, "InterSense Inc. Launches InertiaCube2—The World's Smallest Precision Orientation Sensor with Serial Interface," Aug. 14, 2001 (accessed at http://www.highbeam.com/doc/1G1-77183067.html/print on Sep. 7, 2011.).
Buxton et al., "A Study in Two-Handed Input," Proceedings of CHI '86, pp. 321-326 (1986) (accessed at http://www.billbuxton.com/2hands.html on Jul. 29, 2011).
Buxton, Bill, "A Directory of Sources for Input Technologies" (last updated Apr. 19, 2001), http://web.archive.org/web/20010604004849/http://www.billbuxton.com/InputSources.html (accessed on Sep. 8, 2011).
Buxton, Bill, "Human input/output devices," In M. Katz (ed.), Technology Forecast: 1995, Menlo Park, CA: Price Waterhouse World Firm Technology Center, pp. 49-65 (Sep. 1994).
Canaday, "R67-26 The Lincoln Wand," IEEE Transactions on Electronic Computers, vol. EC-16, No, 2, p. 240 (Apr. 1967) (downloaded from IEEE Xplore on Jul. 7, 2010).
Caruso, "Application of Magnetoresistive Sensors in Navigation Systems," Sensors and Actuators, SAE SP-1220, pp. 15-21 (Feb. 1997); text of article accessed at http://www.ssec.honeywell.com/position-sensors/datasheets/sae.pdf.
Caruso, "Applications of Magnetic Sensors for Low Cost Compass Systems," Honeywell, SSEC, Paper presented at IEEE 2000 Position Location and Navigation Symposium (Mar. 2000), accessed at http://www.ssec.honeywell.com/magnetic/datasheets/lowcost.pdf.
Caruso, et al., "A New Perspective on Magnetic Field Sensing," Sensors Magazine, Dec. 1, 1998 (accessed at http://www.sensorsmag.com/sensors/electric-magnetic/a-new-perspective-magneticfield-sensing-855 on Jun. 17, 2010).
Caruso, et al., "Vehicle Detection and Compass Applications using AMR Magnetic Sensors", Paper presented at 1999 Sensors Expo in Baltimore, Maryland (May 1999), available at http://masters.donntu.edu.ua/2007/kita/gerus/library/amr.pdf.
Chatfield, "Fundamentals of High Accuracy Inertial Navigation," vol. 174 Progress in Astronautics and Aeronautics, American Institute of Aeronautics and Astronautics, Inc. (1997).
Cheng, "Direct interaction with Large-Scale Display Systems using Infrared Laser Tracking Devices," Paper presented at Australasian Symposium on Information Visualisation, Adelaide, Australia (Jan. 2003).
Cheok, et al., "Micro-Accelerometer Based Hardware Interfaces for Wearable Computer Mixed Reality Applications," 6th International Symposium on Wearable Computers (ISWC'02), 8 pages.
Cho, et al., "Magic Wand: A Hand-Drawn Gesture Input Device in 3-D Space with Inertial Sensors," Proceedings of the 9th Intl Workshop on Frontiers in Handwriting Recognition (IWFHR-9 2004), IEEE (Aug. 2004).
Clark, James H., "Designing Surfaces in 3-D," Graphics and Image Processing-Communications of the ACM, Aug. 1976; vol. 19; No. 8; pp. 454-460.
Clark, James H., "Three Dimensional Man Machine Interaction," Siggraph '76, Jul. 14-16 Philadelphia, Pennsylvania, 1 page.
CNET News.com, "Nintendo Wii Swings Into Action," May 25, 2006 (accessed at http://news.cnet.com/2300-1043_3-6070295-4.html on Aug. 5, 2011).
Cooke, et al., "NPSNET: Flight simulation dynamic modeling using quaternions," Presence, vol. 1, No. 4, pp. 404-420, (Jan. 25, 1994).
Crecente, Brian, "Motion Gaming Gains Momentum," kotaku.com, Sep. 17, 2010 (accessed at http://kotaku.com/5640867/motion-gaming-gains-momentum on Aug. 31, 2011).
CSIDC Winners—"Tablet-PC Classroom System Wins Design Competition," IEEE Computer Society Press, vol. 36, Issue 8, pp. 15-18, IEEE Computer Society, Aug. 2003.
Cutrone, "Hot products: Gyration GyroPoint Desk, GyroPoint Pro gyroscope-controlled wired and wireless mice," Results from the Comdex Show Floor, Computer Reseller News, Dec. 4, 1995 (accessed from LexisNexis research database on Feb. 17, 2011; see pp. 8 and 9 of reference submitted herewith).
Deering, Michael F. , "HoloSketch a Virtual Reality Sketching Animation Tool," ACM Transactions on Computer-Human Interaction, Sep. 1995; vol. 2, No. 3; pp. 220-238.
Deruyck, et al., "An Electromagnetic Position Sensor," Polhemus Navigation Sciences, Inc., Burlington, VT (Nov. 1973) (Abstract from DTIC Online).
Dichtburn, "Camera in Direct3D" Toymaker (Feb. 6, 2005), http://web.archive.org/web/20050206032104/http:/toymaker.info/games/html/camera.html (accessed on Jul. 29, 2011).
Digital ID Cards The next generation of 'smart' cards will have more than a one-track mind. Wall Street Journal, Jun. 25, 2001.
Donelson, et al., "Spatial Management of Information", Proceedings of 1978 ACM SIGGRAPH Conference in Atlanta, Georgia, pp. 203-209 (Aug. 1977).
Druin et al., Robots: Exploring New Technologies for Learning for Kids; 2000; Chapter One: To Mindstorms and Beyond; 27 pp. (Jun. 2000).
Drzymala, Robert E., et al., "A Feasibility Study Using a Stereo-Optical Camera System to Verify Gamma Knife Treatment Specification," Proceedings of 22nd Annual Embs International Conference, Jul. 2000; pp. 1486-1489.
Durlach, et al., "Virtual Reality: Scientific and Technological Challenges," National Academy Press (1995).
Emura, et al., "Sensor Fusion based Measurement of Human Head Motion," 3rd IEEE International Workshop on Robot and Human Communication (Jul. 1994).
Ewalt, David M., "Nintendo's Wii is a Revolution," Review, Forbes.com, Nov. 13, 2006 (accessed at http://www.forbes.com/2006/11/13/wii-review-ps3-tech-media-cx_de_1113wii.html on Jul. 29, 2011).
Ferrin, "Survey of Helmet Tracking Technologies," Proc. SPIE vol. 1456, p. 86-94 (Apr. 1991).
Fielder, Lauren "E3 2001: Nintendo unleashes GameCube software, a new Miyamoto game, and more," GameSpot, May 16, 2001 (accessed at http://www.gamespot.com/news/2761390/e3-2001-nintendo-unleashes-gamecube-software-a-new-miyamoto-game-and-more?tag=gallery_summary°/03Bstory on Jul. 29, 2011).
U.S. Appl. No. 09/520,148, filed Mar. 7, 2000 by Miriam Mawle.
Foremski, T., "Remote Control Mouse Aims at Interactive TV" Electronics Weekly, Mar. 9, 1994.
Foxlin, "Head-tracking Relative to a Moving Vehicle or Simulator Platform Using Differential Inertial Sensors," Proceedings of Helmet and Head-Mounted Displays V, SPIE vol. 4021, AeroSense Symposium, Orlando, FL, Apr. 24-25, 2000 (2000).
Foxlin, "Inertial Head Tracker Sensor Fusion by a Complementary Separate-bias Kalman Filter," Proceedings of the IEEE 1996 Virtual Reality Annual International Symposium, pp. 185-194, 267 (Mar./Apr. 3, 1996).
Foxlin, "Generalized architecture for simultaneous localization, auto-calibration, and map-building," IEEE/RSJ Conf. on Intelligent Robots and Systems (IROS 2002), Oct. 2-4, 2002, Lausanne, Switzerland (Oct. 2002).
Foxlin, "Motion Tracking Requirements and Technologies," Chapter 8, from Handbook of Virtual Environment Technology, Kay Stanney,

(56) References Cited

OTHER PUBLICATIONS

Ed., Lawrence Erlbaum Associates (Jan. 2002) (extended draft version available for download at http://www.intersense.com/pp./44/119/).
Foxlin, "Pedestrian Tracking with Shoe-Mounted Inertial Sensors," IEEE Computer Graphics and Applications, vol. 25, No. 6, pp. 38-46, (Nov./Dec. 2005).
Foxlin, et al., "An Inertial Head-Orientation Tracker with Automatic Drift Compensation for Use with HMD's," Proceedings of the 1994 Virtual Reality Software and Technology Conference, Aug. 23-26, 1994, Singapore, pp. 159-173 (1994).
Foxlin, et al., "Constellation™: A Wide-Range Wireless Motion-Tracking System for Augmented Reality and Virtual Set Applications," ACM SIGGRAPH 98, Orlando, Florida, Jul. 19-24, 1998 (1998).
Foxlin, et al., "Miniature 6-DOF Inertial System for Tracking HMDs," SPIE vol. 3362, Helmet and Head-Mounted Displays III, AeroSense 98, Orlando, FL, Apr. 13-14, 1998 (1998).
Foxlin, et al., "WearTrack: A Self-Referenced Head and Hand Tracker for Wearable Computers and Portable VR," Proceedings of International Symposium on Wearable Computers (ISWC 2000), Oct. 16-18, 2000, Atlanta, GA (2000).
Foxlin, et al., "FlightTracker: A Novel Optical/Inertial Tracker for Cockpit Enhanced Vision, Symposium on Mixed and Augmented Reality," Proceedings of the 3rd IEEE/ACM International Symposium on Mixed and Augmented Reality (ISMAR 2004), Nov. 2-5, 2004, Washington, D.C. (2004).
Foxlin, et al., "Miniaturization, Calibration & Accuracy Evaluation of a Hybrid Self-Tracker," IEEE/ACM International Symposium on Mixed and Augmented Reality (ISMAR 2003), Oct. 7-10, 2003, Tokyo, Japan (2003).
Foxlin, et al., "VIS-Tracker: A Wearable Vision-Inertial Self-Tracker," IEEE VR2003, Mar. 22-26, 2003, Los Angeles, CA (2003).
Frankle, "E3 2002: Roll O Rama," Roll-o-Rama GameCube Preview at IGN, May 23, 2002 (accessed at http://cube.ign.com/articles/360/360662p1.html on Sep. 7, 2011).
Friedmann, et al., "Device Synchronization Using an Optimal Linear Filter," SI3D '92: Proceedings of the 1992 symposium on Interactive 3D graphics, pp. 57-62 (Mar./Apr. 1992).
Friedmann, et al., "Synchronization in virtual realities," M.I.T. Media Lab Vision and Modeling Group Technical Report No. 157, Jan. 1991 to appear in Presence, vol. 1, No. 1, MIT Press, Cambridge, MA (1991).
FrontSide Field Test, "Get This!" Golf Magazine, Jun. 2005, p. 36.
Fuchs, Eric, "Inertial Head-Tracking," MS Thesis, Massachusetts Institute of Technology, Dept. of Electrical Engineering and Computer Science (Sep. 1993).
Furniss, Maureen, "Motion Capture," posted at http://web.mit.edu/m-i-t/articles/index_furniss.html on Dec. 19, 1999; paper presented at the Media in Transition Conference at MIT on Oct. 8, 1999 (accessed on Sep. 8, 2011).
gamecubicle.com News Article, Nintendo WaveBird Controller, http://www.gamecubicle.com/news-Nintendo_gamecube_wavebird_controller.htm, May 14, 2002 (accessed on Aug. 5, 2011).
Geen, et al., "New iMEMS® Angular-Rate-Sensing Gyroscope," Analog Dialogue 37-03, pp. 12-14 (2003).
Geen, et al., "New iMEMS® Angular-Rate-Sensing Gyroscope," Analog Dialogue 37-03, pp. 1-3 (2003).
Gelmis, J., "Ready to Play, The Future Way," Buffalo News, Jul. 23, 1996 (accessed from LexisNexis research database on Sep. 6, 2011).
Grimm, et al., "Real-Time Hybrid Pose Estimation from Vision and Inertial Data," Proceedings of the First Canadian Conference on Computer and Robot Vision (CRV'04), IEEE Computer Society (Apr. 2004).
Gyration Ultra Cordless Optical Mouse, Setting Up Ultra Mouse, Gyration Quick Start Card part No. DL-00071-0001 Rev. A. Gyration, Inc., Jun. 2003.
Gyration Ultra Cordless Optical Mouse, User Manual, Gyration, Inc., Saratoga, CA (2003).
Gyration, "Gyration MicroGyro 100 Developer Kit Data Sheet," http://web.archive.org/web/19980708122611/www.gyration.com/html/devkit.ht- ml (Jul. 1998).
Gyration, Inc., GyroRemote GP240-01 Professional Series (Sep. 2003).
Harada, et al., "Portable Absolute Orientation Estimation Device with Wireless Network Under Accelerated Situation" Proceedings of the 2004 IEEE International Conference on Robotics & Automation, New Orleans, LA, Apr. 2004, pp. 1412-1417(Apr. 2004).
Harada, et al., "Portable orientation estimation device based on accelerometers, magnetometers and gyroscope sensors for sensor network," Proceedings of IEEE International Conference on Multisensor Fusion and Integration for Intelligent Systems (MFI 2003), pp. 191-196, (Aug. 2003).
Haykin, et al., "Adaptive Tracking of Linear Time-Variant Systems by Extended RLS Algorithms, IEEE Transactions on Signal Processing," vol. 45, No. 5, pp. 1118-1128 (May 1997).
Heath, "Virtual Reality Resource Guide Al Expert," v9 n5 p32(14) (May 1994) (accessed at http://ftp.hitl.washington.edu/scivw-ftp/commercial/VR-Resource-Guide.bd on Jun. 17, 2010).
HiBall-3100—"Wide-Area, High-Precision Tracker and 3D Digitizer," www.3rdtech.com/HiBall.htm (accessed on Jul. 29, 2011).
Hinckley, "Synchronous Gestures for Multiple Persons and Computers," Paper presented at ACM UIST 2003 Symposium on User Interface Software & Technology in Vancouver, BC, Canada (Nov. 2003).
Hinckley, et al., "A Survey of Design Issues in Spatial Input," Paper presented at 7th Annual ACM Symposium on User Interface Software and Technology (Nov. 1994).
Hinckley, et al., "Sensing Techniques for Mobile Interaction," Proceedings of the 13th Annual Acm Symposium on User Interface Software and Technology (ACM UIST), San Diego, CA, (Nov. 2000).
Hinckley, et al., "The VideoMouse: A Camera-Based Multi-Degree-of-Freedom Input Device" ACM UIST'99 Symposium on User Interface Software & Technology, CHI Letters vol. 1 No. 1, pp. 103-112 (Sep. 1999).
Hinckley, Ken, "Haptic Issues for Virtual Manipulation," Ph.D. Dissertation University of Virginia, Dept. of Computer Science (Jan. 1997).
Hind, Nicholas, "Cosmos: a composition for Live Electronic Instruments Controlled by the Radio Baton and Computer Keyboard (Radio Baton and Magic Glove)," A Final Project Submitted to the Department of Music of Stanford University in Partial Fulfillment of the Requirements for the Degree of Doctor Musical Arts/Umi Microform 9837187, Jan. 1998.
Hoffman, Hunter G., "Physically Touching Virtual Objects Using Tactile Augmentation Enhances the Realism of Virtual Environments," IEEE Virtual Reality Annual International Symposium '98, Atlanta, Georgia, Mar. 14-18, 1998, 5 pages (Mar. 1998).
Hogue, Andrew, "Marvin: A Mobile Automatic Realtime visual and Inertial tracking system," Master's Thesis, York University (May 2003), available at http://www.cse.yorku.ca/~hogue/marvin.pdf.
Holden, Maureen K. et al., "Use of Virtual Environments in Motor Learning and Rehabilitation," Department of Brain and Cognitive Sciences, Handbook of Virtual Environments: Design, Implementation, and Applications, Chap. 49, pp. 999-1026, Stanney (ed), Lawrence Erlbaum Associates (Jan. 2002).
Holloway, Richard Lee, "Registration Errors in Augmented Reality Systems," Ph.D. Dissertation, University of North Carolina at Chapel Hill, Dept. of Computer Science (1995).
Immersion CyberGlove product, Immersion Corporation, http://www.cyberglovesystem.com (Jul. 2001).
Immersion, "Immersion Ships New Wireless CyberGlove(R) II Hand Motion-Capture Glove; Animators, Designers, and Researchers Gain Enhanced Efficiency and Realism for Animation, Digital Prototyping and Virtual Reality Projects," Business Wire, Dec. 7, 2005 (available at http://ir.immersion.com/releasedetail.cfm?releaseid=181278).
Interfax Press Release, "Tsinghua Tongfang Releases Unique Peripheral Hardware for 3D Gaming," Apr. 2002, 1 page. (Apr. 2002).
Intersense, "InterSense InertiaCube2 Devices," (Specification) (image) (2001).

(56) References Cited

OTHER PUBLICATIONS

Intersense, "InterSense InertiaCube2 Manual for Serial Port Model" (2001).
Intersense, "IS-900 Product Technology Brief," http://www.intersense.com/uploadedFiles/Products/White.sub.--Papers/IS900-.sub.--Tech.sub.--Overview.sub.--Enhanced.pdf (1999).
Intersense, "InterSense Inc., The New Standard in Motion Tracking," Mar. 27, 2004, http://web.archive,org!web12004040500550Z/http://intersense.com (accessed on May 19, 2009).
Intersense, "InterSense Mobile Mixed Reality Demonstration," YouTube Video dated Oct. 2006 on opening screen; uploaded by InterSenseInc. on Mar. 14, 2008 (accessed at http://www.youtube.com/watch?v=daVdzGK0nUE&feature=channel_page on Sep. 8, 2011; digital video available upon request).
Intersense, "IS-900 Precision Motion Trackers," Jun. 14, 2002, http://web.archive.org/web/20020614110352/http://www.isense.com/products/prec/is900/ (accessed on Sep. 8, 2011).
Intersense, Inc., "Comparison of Intersense IS-900 System and Optical Systems," Whitepaper, Jul. 12, 2004., available at http://www.jazdtech.com/techdirect/research/InterSense-Inc.htm?contentSetId=600329398&supplierId=60018705.
Jacob, "Human-Computer Interaction—Input Devices," ACM Computing Surveys, vol. 28, No. 1, pp. 177-179 (Mar. 1996); link to text of article provided at http://www.cs.tufts.edu/~jacob/papers/.
Jakubowski, et al., "Increasing Effectiveness of Human Hand Tremor Separation Process by Using Higher-Order Statistics," Measurement Science Review, vol. 1, No. 1 (2001).
Ji, H. "Study on the Infrared Remote-Control Lamp-Gesture Device," Yingyong Jiguang/Applied Laser Technology, v. 17, n. 5, p. 225-227, Language: Chinese-Abstract only, Oct. 1997.
Jiang, "Capacitive position-sensing interface for micromachined inertial sensors," Dissertation at Univ. of Cal. Berkeley, 2003.
Ju, et al., "The Challenges of Designing a User Interface for Consumer Interactive Television Consumer Electronics Digest of Technical Papers.," IEEE 1994 International Conference on vol. , Issue , Jun. 21-23, 1994 pp. 114-115 (Jun. 1994) (downloaded from IEEE Xplore on Jul. 13, 2010).
Keir, et al., "Gesture-recognition with Nonreferenced Tracking," IEEE Symposium on 3D User Interfaces, pp. 151-158, Mar. 25-26, 2006.
Kennedy, P.J. "Hand-held Data Input Device," IBM Technical Disclosure Bulletin, vol. 26, No. 11, pp. 5826-5827, Apr. 1984.
Kessler, et al., "The Simple Virtual Environment Library: an Extensible Framework for Building VE Applications," Presence, MIT Press vol. 9, No. 2. pp. 187-208 (Apr. 2000).
Kindratenko, "A Comparison of the Accuracy of an Electromagnetic and a Hybrid Ultrasound-Inertia Position Tracking System," MIT Presence, vol. 10, No. 6, pp. 657-663, Dec. 2001.
Klein et al., "Tightly Integrated Sensor Fusion for Robust Visual Tracking," British Machine Vision Computing, vol. 22, No. 10, pp. 769-776, Feb. 2004.
Kohlhase, "NASA Report, The Voyager Neptune travel guide," Jet Propulsion Laboratory Publication 89-24, (Jun. 1989).
Kormos, D.W., et al., "Intraoperative, Real-Time 3-D Digitizer for Neurosurgical Treatment and Planning," IEEE (Feb. 1993) (Abstract only).
Kosak, Dave, "Mind-Numbing New Interface Technologies," Gamespy.com, Feb. 1, 2005 (accessed at http://www.gamespy.com/articles/584/584744p1.html on Aug. 31, 2011).
Krumm et al., "How a Smart Environment can Use Perception," Paper presented at UBICOMP 2001 Workshop on Perception for Ubiquitous Computing (2001).
Kuipers, Jack B., "SPASYN—An Electromagnetic Relative Position and Orientation Tracking System," IEEE Transactions on Instrumentation and Measurement, vol. 29, No. 4, pp. 462-466 (Dec. 1980).
Kunz, Andreas M. et al., "Design and Construction of a New Haptic Interface," Proceedings of DETC '00, ASME 2000 Design Engineering Technical Conferences and Computers and Information in Engineering Conference, Baltimore, Maryland, Sep. 10-13, 2000.
La Scala, et al., "Design of an Extended Kalman Filter Frequency Tracker," IEEE Transactions on Signal Processing, vol. 44, No. 3 (Mar. 1996).
Laughlin, et al., "Inertial Angular Rate Sensors: Theory and Applications," Sensors Magazine Oct. 1992.
Lee, et al., "Innovative Estimation Method with Measurement Likelihood for all-Accelerometer Type Inertial Navigation System," IEEE Transactions on Aerospace and Electronic Systems, vol. 38, No. 1, Jan. 2002.
Lee, et al., "Tilta-Pointer: the Free-Space Pointing Device," Princeton COS 436 Project (Fall 2004); retrieved from Google's cache of http://www.milyehuang.com/cos436/project/specs.html on May 27, 2011.
Lee, et al., "Two-Dimensional Position Detection System with MEMS Accelerometer for Mouse Applications," Design Automation Conference, 2001, Proceedings, 2001 pp. 852-857, Jun. 2001.
Leganchuk, et al., "Manual and Cognitive Benefits of Two-Handed Input: An Experimental Study," ACM Transactions on Computer-Human Interaction, vol. 5, No. 4, pp. 326-259, Dec. 1998.
Liang, et al., "On Temporal-Spatial Realism in the Virtual Reality Environment," ACM 1991 Symposium on User Interface Software and Technology (Nov. 1991).
Link, "Field-Qualified Silicon Accelerometers from 1 Milli g to 200,000 g," Sensors, Mar. 1993.
Liu, et al., "Enhanced Fisher Linear Discriminant Models for Face Recognition," Paper presented at 14th International Conference on Pattern Recognition (ICPR'98), Queensland, Australia (Aug. 1998).
Lobo, et al., "Vision and Inertial Sensor Cooperation Using Gravity as a Vertical Reference," IEEE Trans. on Pattern Analysis and Machine Intelligence, vol. 25, No. 12, pp. 1597-1608, Dec. 2003.
Logitech, "Logitech Tracker—Virtual Reality Motion Tracker," downloaded from http://www.vrealities.com/logitech.html on Jun. 18, 2010.
Logitech, Inc. "3D Mouse & Head Tracker Technical Reference Manual," Nov. 1992.
Logitech's WingMan Cordless RumblePad Sets PC Gamers Free, Press Release, Sep. 2, 2001 (accessed at http://www.logitech.com/en-us/172/1373 on Aug. 5, 2011).
Louderback, J. "Nintendo Wii", Reviews by PC Magazine, Nov. 13, 2006 (accessed at http://www.pcmag.com/article/print/193909 on Sep. 8, 2011).
Luethi, P. et al., "Low Cost Inertial Navigation System" (2000); downloaded from http://www.electronic-engineering.ch/study/ins/ins.html on Jun. 18, 2010.
Luinge, "Inertial sensing of human movement," Thesis, University of Twente, Twente University Press, (Oct. 2002).
Luinge, et al., "Estimation of orientation with gyroscopes and accelerometers," Proceedings of the First Joint BMES/EMBS Conference, 1999, vol. 2, p. 844 (Oct. 1999).
Mackenzie, et al., "A two-ball mouse affords three degrees of freedom," Extended Abstracts of the CHI '97 Conference on Human Factors in Computing Systems, pp. 303-304. New York: ACM (Oct. 1997).
Mackinlay, "Rapid Controlled Movement Through a Virtual 3D Workspace," ACM SIGGRAPH Computer Graphics archive, vol. 24, No. 4, pp. 171-176 (Aug. 1990).
Maclean, "Designing with Haptic Feedback", Paper presented at IEEE Robotics and Automation (ICRA '2000) Conference in San Francisco, CA, Apr. 22-28, 2000.
Maggioni, C., "A novel gestural input device for virtual reality," IEEE Virtual Reality Annual International Symposium (Cat. No. 93CH3336-5), 118-24, Jan. 1993.
Marks, Richard (Jan. 21, 2004) (Windows Media v7). EyeToy: A New Interface for Interactive Entertainment, Stanford University (accessed at http://lang.stanford.edu/courses/ee380/2003-2004/040121-ee380-100.wmv on Sep. 7, 2011; digital video available upon request).
Marrin, "Possibilities for the Digital Baton as a General Purpose Gestural Interface," Late-Breaking/Short Talks, Paper presented at CHI 97 Conference in Atlanta Georgia, Mar. 22-27, 1997 (accessed at http://www.sigchi.org/chi97/proceedings/short-talk/tm.htm on Aug. 5, 2011).

(56) References Cited

OTHER PUBLICATIONS

Marrin, Teresa et al., "The Digital Baton: A Versatile Performance Instrument," Paper presented at International Computer Music Conference, Thessaloniki, Greece (Sep. 1997) (text of paper available at http://quod.lib.umich.edu/cgi/p/pod/dod-idx?c=icmc;idno=bbp2372.1997.083).
Marti, et al., "Biopsy navigator: a smart haptic interface for interventional radiological gestures" Proceedings of the Computer Assisted Radiology and Surgery (CARS 2003) Conference, International Congress Series, vol. 1256, pp. 788-793 (Jun. 2003) (e-copy of text of paper available at http://infoscience.epfl.ch/record/29966/files/CARS03-GM.pdf).
Masliah, "Measuring the Allocation of Control in 6 Degree of Freedom Docking Experiment," Paper presented at SIGCHI Conference on Human Factors in Computing Systems, The Hague, Netherlands (Apr. 2000).
Maybeck, "Stochastic Models, Estimation and Control," vol. 1, Chapter 1, Introduction (1979).
Merians, et al., "Virtual Reality-Augmented Rehabilitation for Patients Following Stroke," Physical Therapy, vol. 82, No. 9, Sep. 2002.
Merrill, "FlexiGesture: A sensor-rich real-time adaptive gesture and affordance learning platform for electronic music control," Thesis, Massachusetts Institute of Technology, Jun. 2004.
Meyer, et al., "A Survey of Position Tracker," MIT Presence, vol. 1, No. 2, pp. 173-200, (Nov. 1992).
Miller, Paul, "Exclusive shots of Goschy's prototype 'Wiimote' controllers," Engadget, Jan. 15, 2008 (accessed at http://www.engadget.com/2008/01/15/exclusive-shots-of-goschys-prototype-wiimote-controllers/ on Aug. 31, 2011).
Miller, Ross, "Joystiq interview: Patrick Goschy talks about Midway, tells us he 'made the Wii'," Joystiq.com, Jan. 16, 2008 (accessed at http://www.joystiq.com/2008/01/16/joystiq-interview-patrick-goschy-talks-about-midway-tells-us-h/ on Aug. 31, 2011).
Mizell, "Using Gravity to Estimate Accelerometer Orientation," Proceedings of the Seventh IEEE International Symposium on Wearable Computers (ISWC '03), IEEE Computer Society (Oct. 2003).
Morgan, C., "Still chained to the overhead projector instead of the podium," (TV Interactive Corp's LaserMouse Remote Pro infrared mouse) (clipboard) (brief article) (product announcement) Government Computer News, Jun. 13, 1994.
Morris, "Accelerometry—a technique for the measurement of human body movements," J Biomechanics vol. 6, pp. 729-736 (Nov. 1973).
Moser, "Low Budget Inertial Navigation Platform (2000)," www.tmoser.ch/typo3/11.0.html (accessed on Jul. 29, 2011).
Mulder, "Human movement tracking technology," Technical Report, NSERC Hand Centered Studies of Human Movement project, available through anonymous ftp in fas.sfu.ca:/pub/cs/graphics/vmi/HMTT.pub.ps.Z., Burnab, B.C, Canada: Simon Fraser University (Jul. 1994).
Myers, et al., "Interacting at a Distance: Measuring the Performance of Laser Pointers and Other Devices," CHI 2002, Apr. 2002.
Naimark, et al., "Encoded LED System for Optical Trackers," Paper presented at Fourth IEEE and ACM International Symposium on Mixed and Augmented Reality (ISMAR 2005), Oct. 5-8, 2005, Vienna Austria (2005) (electronic version of text of paper available for download at http://www.intersense.com/pages/44/129/).
Naimark, et al., "Circular Data Matrix Fiducial System and Robust Image Processing for a Wearable Vision-Inertial Self-Tracker," IEEE International Symposium on Mixed and Augmented Reality (ISMAR 2002), Darmstadt, Germany (Sep./Oct. 2002).
Navarrette, et al., "Eigenspace-based Recognition of Faces: Comparisons and a new Approach," Paper Presented at 11th International Conference on Image Analysis and Processing (Sep. 2001).
New Strait Times Press Release, "Microsoft's New Titles," Mar. 1998, 1 page.
News Article, "New Game Controllers Using Analog Devices' G-Force Tilt to be Featured at E3", Norwood, MA (May 10, 1999) (accessed at http://www.thefreelibrary.com/ _/print/PrintArticle.aspx?id=54592268 on Jun. 17, 2010).
Nintendo Tilt Controller Ad, Electronic Gaming Monthly, 1994, 1 page.
Nintendo, Game Boy Advance SP System Instruction Booklet (2003).
Nintendo, Nintendo Game Boy Advance System Instruction Booklet (2001-2003).
Nintendo, Nintendo Game Boy Advance Wireless Adapter, Sep. 26, 2003.
Nishiyama, "A Nonlinear Filter for Estimating a Sinusoidal Signal and its Parameters in White Noise: On the Case of a Single Sinusoid," IEEE Transactions on Signal Processing, vol. 45, No, 4, pp. 970-981 (Apr. 1997).
Nishiyama, "Robust Estimation of a Single Complex Sinusoid in White Noise-H∞ Filtering Approach," IEEE Transactions on Signal Processing, vol. 47, No. 10, pp. 2853-2856 (Oct. 1999).
Odell, "An Optical Pointer for Infrared Remote Controllers," (1995) (downloaded from IEEE Xplore on Jul. 7, 2010).
Ojeda, et al., "No GPS? No Problem!" University of Michigan Develops Award-Winning Personal Dead-Reckoning (PDR) System for Walking Users, available at http://www.engin.umich.edu/research/mrl/urpr/In_Press/P135.pdf, (2004 or later).
Omelyan, "On the numerical integration of motion for rigid polyatomics: The modified quaternion approach" Computers in Physics, vol. 12 No. 1, pp. 97-103 (Jan./Feb. 1998).
Ovaska, "Angular Acceleration Measurement: A Review," Paper presented at IEEE Instrumentation and Measurement Technology Conference, St. Paul, MN, May 18-21, 1998 (1998).
Pai, et al., "The Tango: A Tangible Tangoreceptive Whole-Hand Interface," Paper presented at Joint Eurohaptics and IEEE Symposium on Haptic Interfaces for Virtual Environment and Teleoperator Systems, Pisa, Italy, Mar. 18-20, 2005 (2005).
Pajama Sam: No Need to Hide When It's Dark Outside Infogames, Sep. 6, 2002.
Paley, W. Bradford, "Interaction in 3D Graphics," SIGGRAPH Computer Graphics Newsletter, col. 32, No. 4 (Nov. 1998) (accessed at http://www.siggraph.org/publications/newsletter/v32n4/contributions/paley.html on Aug. 2, 2011).
Paradiso, et al., "Interactive Therapy with Instrumented Footwear," CHI 2004, Apr. 24-29, 2004, Vienna, Austria.
Park, Adaptive control strategies for MEMS gyroscopes (Dissertation), Univ. Cal. Berkley (Dec. 2000).
PC World, "The 20 Most Innovative Products of the Year," Dec. 27, 2006 (accessed at http://www.pcworld.com/printable/article/id,128176/printable.html on Aug. 2, 2011).
PCTracker, Technical Overview, available at http://www.est-kl.com/fileadmin/media/pdf/InterSense/PCTracker_Tech_Overview.pdf (date unknown).
Perry, Simon, "Nintendo to Launch Wireless Game Boy Adaptor," Digital Lifestyles, http://digital-lifestyles.info/2003/09/26/Nintendo-to-launch-wireless-game-boy-adaptor/, Sep. 26, 2003 (accessed on Jul. 29, 2011).
Phillips, "Forward/Up Directional Incompatibilities During Cursor Placement Within Graphical User Interfaces," Ergonomics, vol. 48, No. 6, May 15, 2005.
Phillips, "LPC2104/2105/2106, Single-chip 32-bit microcontrollers; 128 kB ISP/IAP Flash with 64 kB/32 kB/16 kB RAM," 32 pages, Dec. 22, 2004.
Phillips, "Techwatch: On the Right Track: A unique optical tracking system gives users greater freedom to explore virtual worlds," Computer Graphics World, vol. 23, Issue 4 (Apr. 2000).
Pierce, et al., "Image Plane Interaction Techniques in 3D Immersive Environments," Paper presented at 1997 symposium on Interactive 3D graphics, Providence, RI (Apr. 1997).
Pilcher, "AirMouse Remote Controls," IEEE Conference on Consumer Electronics (Jun. 1992).
Pique, "Semantics of Interactive Rotations," Interactive 3D Graphics, Proceedings of the 1986 workshop on Interactive 3D graphics, pp. 259-269 (Oct. 1986).
Piyabongkarn, "The Development of a MEMS Gyroscope for Absolute Angle Measurement," Dissertation, Univ. Minnesota, Nov. 2004 (Abstract only).
Polhemus, "Polhemus 3Space Fastrak devices" (image) (2001).

(56) References Cited

OTHER PUBLICATIONS

PowerGlove product Program Guide, Mattel, 1989 (Text of Program Guide provided from http://hiwaay.net/~lkseitz/cvtg/power_glove.shtml; the text was typed in by Lee K. Sietz; document created Aug. 25, 1988; accessed on Aug. 2, 2011).
PR Newswire, "Five New Retailers to Carry Gyration's Gyropoint Point and Gyropoint Pro," Jul. 8, 1996 (accessed at http://www.thefreelibrary.com/ _/print/PrintArticle.aspx?id=54592268 on Jun. 18, 2010).
PR Newswire, "Three-Axis MEMS-based Accelerometer From STMicroelectronics Targets Handheld Terminals," Feb. 18, 2003 (accessed at http://www.thefreelibrary.com/ _/print/PrintArticle.aspx?id=54592268 on Aug. 3, 2011).
Pryor, et al., "A Reusable Software Architecture for Manual Controller Integration," IEEE Conf. on Robotics and Automation, Univ of Texas, pp. 3583-3588 (Apr. 1997).
Raab, et al., "Magnetic Position and Orientation Tracking System," IEEE Transactions on Aerospace and Electronic Systems, vol. AES-15, No. 5, pp. 709-718 (Sep. 1979).
Radica Legends of the Lake™ Instruction Manual (2003).
Regan, "Smart Golf Clubs," baltimoresun.com, Jun. 17, 2005.
Rekimoto, "Tilting Operations for Small Screen Interfaces," Tech Note presented at 9th Annual ACM Symposium on User Interface Software and Technology (UIST'96) (Nov. 1996) (electronic copy available for download at http://www.sonycsl.co.jp/person/rekimoto/papers/uist96.pdf.
Response filed May 3, 2010 to Office Action dated Feb. 5, 2010 for U.S. Appl. No. 12/222,787, filed Aug. 15, 2008, now U.S. Pat. No. 7,774,155 (including Rule 1.132 Declaration by Steve Mayer).
Reunert, "Fiber-Optic Gyroscopes: Principles and Applications," Sensors, Aug. 1993, pp. 37-38.
Ribo, et al., "Hybrid Tracking for Outdoor Augmented Reality Applications," IEEE Computer Graphics and Applications, vol. 22, No. 6, pp. 54-63, Nov./Dec. 2002.
Riviere, et al., "Adaptive Canceling of Physiological Tremor for Improved Precision in Microsurgery," IEEE Transactions on Biomedical Engineering, vol. 45, No. 7, pp. 839-846 (Jul. 1998).
Roberts, "The Lincoln Wand," 1966 Proceedings of the Fall Joint Computer Conference (1966), available for electronic download at http://www.computer.org/portal/web/csdl/doi/10.1109/AFIPS, Apr. 1966,105.
Robinette, et al., "Implementation of Flying, Scaling, and Grabbing in Virtual Worlds," ACM Symposium (Jun. 1992).
Robinette, et al., "The Visual Display Transformation for Virtual Reality," University of North Carolina at Chapel Hill (Sep. 1994).
Roetenberg, "Inertial and magnetic sensing of human motion," Thesis, University of Twente (May 2006).
Roetenberg, et al., "Inertial and Magnetic Sensing of Human Movement Near Ferromagnetic Materials," Paper presented at Second IEEE and ACM International Symposium on Mixed and Augmented Reality, Mar. 2003 (electronic copy available at http://www.xsens.com/images/stories/PDF/Inertial%20and%20magnetic%20sensing%20of%20human%20movement%20near%20ferromagnetic%20materials.pdf.
Rolland, et al., "A Survey of Tracking Technology for Virtual Environments," University of Central Florida, Center for Research and Education in Optics Lasers (CREOL) (Jan. 2001).
Romer, Kay et al., Smart Playing Cards: A Ubiquitous Computing Game, Personal and Ubiquitous Computing, Dec. 2002, vol. 6, Issue 5-6, pp. 371-377, London, England.
Rothman, Wilson, "Unearthed: Nintendo's Pre-Wiimote Prototype," gizmodo.com, Aug. 29, 2007 (accessed at http://gizmodo.com/gadgets/exclusive/unearthed-nintendo-2001-prototype-motion+sensing-one+handed-controller-by-gyration-294642.php on Aug. 31, 2011).
Rothman, Wilson, "Wii-mote Prototype Designer Speaks Out, Shares Sketchbook," Gizmodo.com, Aug. 30, 2007 (accessed at http://gizmodo.com/gadgets/exclusive/wii+mote-prototype-designer-speaks-out-shares-sketchbook-295276.php on Aug. 31, 2011).
Sakai, et al., "Optical Spatial Filter Sensor for Ground Speed," Optical Review, vol. 2, No. 1, pp. 65-67 (Jan. 1995).
Santiago, Alves, "Extended Kalman filtering applied to a full accelerometer strapdown inertial measurement unit," M.S. Thesis, Massachusetts Institute of Technology, Dept. of Aeronautics and Astronautics, Santiago (Sep. 1992).
Satterfield, Shane, "E3 2002: Nintendo announces new GameCube games," GameSpot, http://www.gamespot.com/gamecube/action/rollorama/news/2866974/e3-2002-nintendo-announces-new-gamecube-games, May 21, 2002 (accessed on Aug. 11, 2011).
Sawada, et al., "A Wearable Attitude-Measurement System Using a Fiberoptic Gyroscope," MIT Presence, vol. 11, No. 2, pp. 109-118, Apr. 2002.
Saxena, et al., "In Use Parameter Estimation of Inertial Sensors by Detecting Multilevel Quasi-Static States," Berlin: Springer-Verlag, pp. 595-601 (2005).
Sayed, "A Framework for State-Space Estimation with Uncertain Models," IEEE Transactions on Automatic Control, vol. 46, No. 7, Jul. 2001.
Schofield, Jack, et al., Games reviews, "Coming up for airpad," the Guardian (Feb. 3, 2000) (accessed at http://www.guardian.co.uk/technology/2000/feb/03/online supplement5/print on Jun. 18, 2010).
Sega/Sports Sciences, Inc., "Batter Up, It's a Hit," Instruction Manual, Optional Equipment Manual (1994).
Sega/Sports Sciences, Inc., "Batter Up, It's a Hit," Photos of baseball bat (1994).
Selectech Airmouse, "Mighty Mouse", Electronics Today International, p. 11 (Sep. 1990).
Shoemake, Ken, "Quaternions," available online at http://campar.in.tum.de/twiki/pub/Chair/DwarfTutorial/quatut.pdf (date unknown).
Skiens, Mike, "Nintendo Announces Wireless GBA Link", Bloomberg, Sep. 25, 2003 (accessed at http://www.nintendoworldreport.com/news/9011).
Smartswing, "SmartSwing: Intelligent Golf Clubs that Build a Better Swing," http://web.archive.org/web/20040728221951/http://www.smartswinggolf.com/ (accessed on Sep. 8, 2011).
Smartswing, "The SmartSwing Learning System Overview," Apr. 26, 2004, http://web.archive.org/web/2004426215355/http://www.smartswinggolf.com/tls/index.html (accessed on Jul. 29, 2011).
Smartswing, "The SmartSwing Learning System: How it Works," 3 pages, Apr. 26, 2004, http://web.archive.org/web/20040426213631/http://www.smartswinggolf.com/t1s/how_it_works.html (accessed on Jul. 29, 2011).
Smartswing, "The SmartSwing Product Technical Product: Technical Information," Apr. 26, 2004, http://web.archive.org/web/20040426174854/http://www.smartswinggolf.com/products/technical_info.html (accessed on Jul. 29, 2011).
Smartswing, Training Aid, Austin, Texas, Apr. 2005.
Sorenson, et al., "The Minnesota Scanner: A Prototype Sensor for Three-Dimensional Tracking of Moving Body Segments," IEEE Transactions on Robotics and Animation, vol. 5, No. 4 (Aug. 1989).
Star Wars Action Figure with CommTech Chip by Hasbro (1999).
Stars Wars Episode 1 CommTech Reader Instruction Manual (1998).
Stovall, "Basic Inertial Navigation," NAWCWPNS TM 8128, Navigation and Data Link Section, Systems Integration Branch (Sep. 1997).
Sulic, "Logitech Wingman Cordless Rumblepad Review," Gear Review at IGN, Jan. 14, 2002 (accessed at http://gear.ign.com/articles/317/317472p1.html on Aug. 1, 2011).
Sutherland, "A Head-Mounted Three Dimensional Display," Paper presented at AFIPS '68 Fall Joint Computer Conference, Dec. 9-11, 1968, (1968); electronic copy of paper available at www.cise.ufl.edu/~lok/teaching/dcvef05/papers/sutherland-headmount.pdf.
Sutherland, Ivan E., "Sketchpad: A Man-Machine Graphical Communication System," Proceedings of the AFIPS Spring Joint Computer Conference, Detroit, Michigan, May 21-23, 1963, pp. 329-346 (source provided is reprinting of text accessed at http://www.guidebookgallery.org/articles/sketchpadamanmachinegraphicalcommunicationsystem on Sep. 8, 2011).
Tech Designers Rethink Toys: Make Them Fun Wall Street Journal, Dec. 17, 2001.

(56) References Cited

OTHER PUBLICATIONS

Templeman, James N., "Virtual Locomotion: Walking in Place through Virtual Environments," Presence, vol. 8, No. 6, pp. 598-617, Dec. 1999.
Timmer, "Modeling Noisy Time Series: Physiological Tremor," International Journal of Bifurcation and Chaos, vol. 8, No. 7 (1998).
Timmer, et al., "Characteristics of Hand Tremor Time Series," Biological Cybernetics, vol. 70, No. 1, pp. 75-80 (May 1993).
Timmer, et al., "Cross-Spectral Analysis of Tremor Time Series," International Journal of Bifurcation and Chaos, vol. 10, No. 11 pp. 2595-2610 (Nov. 2000); electronic text available at http://www.fdmold.uni-freiburg.de/groups/timeseries/tremor/pubs/cs_review.pdf.
Timmer, et al., "Pathological Tremors: Deterministic Chaos or Nonlinear Stochastic Oscillators?" Chaos, vol. 10, No. 1 pp. 278-288 (Mar. 2000).
Timmer, et al., Cross-Spectral Analysis of Physiological Tremor and Muscle Activity: II Application to Synchronized Electromyogram, Biological Cybernetics, vol. 78 (Jun. 1998) (copy provided obtained from http://arxiv.org/abs/chao-dyn/9805012).
Titterton, et al., "Strapdown Inertial Navigation Technology," Peter Peregrinus Ltd., pp. 1-56 and pp. 292-321 (May 1997).
Toy Designers Use Technology in New Ways as Sector Matures, WSJ.com, Dec. 17, 2001.
Traq 3D, "Healthcare,"http: //www.traq3d.com/Healthcare/Healthcare.aspx (accessed on Jan. 21, 2010).
Ulanoff, Lance, "Nintendo's Wii is the Best Product Ever," PC Magazine, Jun. 21, 2007 (accessed at http://www.pcmag.com/print_article2/0,1217,a=210070,00.asp?hidPrint=true on Aug. 1, 2011).
UNC Computer Science Department, "News & Notes from Sitterson Hall," UNC Computer Science, Department Newsletter, Issue 24, Spring 1999 (Apr. 1999) (accessed at http://www.cs.unc.edu/NewsAndNotes/Issue24/ on Jun. 18, 2010).
Urban, "BAA 96-37 Proposer Information," DARPA/ETO (1996) (accessed at http://www.fbodaily.com/cbd/archive/1996/08(August)/19-Aug-1996/Aso1001.htm on Jul. 27, 2010).
US Dynamics Corp, "Spinning Mass Mechanical Gyroscopes," Aug. 2006.
US Dynamics Corp, "The Concept of 'Rate', (more particularly, angular rate pertaining to rate gyroscopes) (rate gyro explanation)," Aug. 2006.
US Dynamics Corp, "US Dynamics Model 475 Series Rate Gyroscope Technical Brief," Dec. 2005.
US Dynamics Corp, "US Dynamics Rate Gyroscope Interface Brief (rate gyro IO)" Aug. 2006.
Van Den Bogaard, Thesis, "Using linear filters for real-time smoothing of rotational data in virtual reality application," dated Aug. 2, 2004, available at http://www.science.uva.nl/research/ias/alumni/m.sc.theses/theses/RobvandenBogaarad.pdf.
Van Laerhoven et al., "Using an Autonomous Cube for Basic Navigation and Input," Proceedings of the 5th International Conference on Multimodal interfaces, Vancouver, British Columbia, Canada, pp. 203-210, Nov. 5-7, 2003.
Van Rheeden, et al., "Noise Effects on Centroid Tracker Aim Point Estimation," IEEE Trans. on Aerospace and Electronic Systems, vol. 24, No. 2, pp. 177-185 (Mar. 1988).
Vaz, et al., "An Adaptive Estimation of Periodic Signals Using a Fourier Linear Combiner," IEEE Transactions on Signal Processing, vol. 42, No. 1, pp. 1-10 (Jan. 1994).
Verplaetse, "Inertial-Optical Motion-Estimating Camera for Electronic Cinematography," Masters Thesis, MIT, Media Arts and Sciences (Jun. 1997).
Villoria, Gerald, "Hands on Roll-O-Rama Game Cube," Game Spot, http://www.gamespot.com/gamecube/action/rollorama/news.html?sid=28684218tcom_act=convert&om_clk=newsfeatures&tag=newsfeatures;title;1&m, May 29, 2002 (accessed on Jul. 29, 2011).
Virtual Fishing, Operational Manual, 2 pages, Tiger Electronics, Inc. (1998).
Vorozcovs, et al., "The Hedgehog: A Novel Optical Tracking Method for Spatially Immersive Displays," MIT Presence, vol. 15, No. 1, pp. 108-121, Feb. 2006.
VTI, Mindflux-Vti CyberTouch, http://www.mindflux.com/au/products/vti/cybertouch.html (1996).
Wang, et al., "Tracking a Head-Mounted Display in a Room-Sized Environment with Head-Mounted Cameras," Paper presented at SPIE 1990 Technical Symposium on Optical Engineering and Photonics in Aerospace Sensing (Apr. 1990).
Ward, et al., "A Demonstrated Optical Tracker With Scalable Work Area for Head-Mounted Display Systems," Paper presented at 1992 Symposium on Interactive 3D Graphics (Mar. 1992).
Watt, Alan, 3D Computer Graphics, Chapter 1: "Mathematical fundamentals of computer graphics," 3rd ed. Addison-Wesley, pp. 1-26 (Dec. 2000).
Welch, "Hawkeye Zooms in on Mac Screens with Wireless Infrared Penlight Pointer," MacWeek, May 3, 1993 (excerpt of article accessed at http://www.accessmylibrary.com/article/print/1G1-13785387 on Jun. 18, 2010).
Welch, et al., "High-Performance Wide-Area Optical Tracking: The HiBall Tracking System," MIT Presence: Teleoperators & Virtual Environments (Feb. 2001).
Welch, et al., "SCAAT: Incremental Tracking with Incomplete Information," Paper presented at SIGGRAPH 97 Conference on Computer Graphics and Interactive Techniques (Aug. 1997), available at http://www.cs.unc.edu/~welch/media/pdf/scaat.pdf.
Welch, et al., "The HiBall Tracker: High-Performance Wide-Area Tracking for Virtual and Augmented Environments," Paper presented at 1999 Symposium on Virtual Reality Software and Technology in London, Dec. 20-22, 1999, available at http://www.cs.unc.edu/~welch/media/pdf/VRST99_HiBall.pdf.
Welch, et al., "Complementary Tracking and Two-Handed Interaction for Remote 3D Medical Consultation with a PDA," Paper presented at Trends and Issues in Tracking for Virtual Environments Workshop at IEEE Virtual Reality 2007 Conference (Mar. 2007), available at http://www.cs.unc.edu/~welch/media/pdf/Welch2007_TwoHanded.pdf.
Welch, et al., "Motion Tracking: No Silver Bullet, but a Respectable Arsenal," IEEE Computer Graphics and Applications, vol. 22, No. 6, pp. 24-38 (Nov./Dec. 2002), available at http://www.cs.unc.edu/~tracker/media/pdf/cga02_welch_tracking.pdf.
Welch, Hybrid Self-Tracker: An Inertial/Optical Hybrid Three-Dimensional Tracking System, University of North Carolina Chapel Hill Department of Computer Science, TR 95-048 (1995).
Widrow, et al., "Fundamental Relations Between the LMS Algorithm and the DFT," IEEE Transactions on Circuits and Systems, vol. CAS-34, No. 7 (Jul. 1987).
Wiley, M., "Nintendo Wavebird Review," Jun. 11, 2002, http://gear.ign.com/articles/361/361933p1.html (accessed on Aug. 1, 2011).
Williams, et al., "Physical Presence: Palettes in Virtual Spaces," Society of Photo-Optical Instrumentation Engineers (SPIE) Conference Series, vol. 3639, No. 374-384 (May 1999), available at http://www.fakespacelabs.com/papers/3639_46_LOCAL.pdf.
Williams, et al., "Implementation and Evaluation of a Haptic Playback System," vol. 3, No. 3, Haptics-e, May 2004.
Williams, et al., "The Virtual Haptic Back Project," presented at the IMAGE 2003 Conference, Scottsdale, Arizona, Jul. 14-18, 2003.
Wilson, "Wireless User Interface Devices for Connected Intelligent Environments," http://research.microsoft.com/en-us/um/people/awilson/publications/old/ubicomp%202003.pdf (Oct. 2003).
Wilson, "WorldCursor: Pointing in Intelligent Environments with the World Cursor," http://www.acm.org/uist/archive/adjunct/2003/pdf/demos/d4-wilson.pdf (2003).
Wilson, "XWand: UI for Intelligent Environments," http://research.microsoft.com/en-us/um/people/awilson/wand/default.htm, Apr. 2004.
Wilson, et al., "Demonstration of the Xwand Interface for Intelligent Spaces," UIST '02 Companion, pp. 37-38 (Oct. 2002).
Wilson, et al., "Gesture Recognition Using the Xwand," http://www.ri.cmu.edu/pub_files/pub4/wilson_daniel_h_2004_1/wilson_daniel_h_2004_1.pdf (Apr. 2004).
Wilson, et al., "Xwand: UI for Intelligent Spaces," Paper presented at CHI 2003 Conference, Ft. Lauderdale, FL, Apr. 5-10, 2003, available

(56) References Cited

OTHER PUBLICATIONS at http://research.microsoft.com/en-us/um/people/awilson/publications/WilsonCHI2003/CHI%202003%20XWand.pdf (2003).
Wired Glove, Wikipedia article, 4 pages, http://en.wikipedia.org/wiki/Wired_glove, Nov. 18, 2010.
Wormell, "Unified Camera, Content and Talent Tracking in Digital Television and Movie Production," Presented at NAB 2000, Las Vegas, NV, Apr. 8-13, 2000 (available for download at http://www.intersense.com/pages/44/116/) (2003).
Wormell, et al., "Advancements in 3D Interactive Devices for Virtual Environments," Presented at the Joint International Immersive Projection Technologies (IPT)/Eurographics Workshop on Virtual Environments (EGVE) 2003 Workshop, Zurich, Switzerland, May 22-23, 2003 (available for download at http://www.intersense.com/pages/44/123/) (2003).
Worringham, et al., "Directional Stimulus-Response Compatibility: A Test of Three Alternative Principles," Ergonomics, vol. 41, Issue 6, pp. 864-880 (Jun. 1998).
Yang, et al., "Implementation and Evaluation of 'Just Follow Me': An Immersive, VR-Based, Motion-Training System," MIT Presence: Teleoperators and Virtual Environments, vol. 11, No. 3, at 304-23 (MIT Press), Jun. 2002.
You, et al., "Hybrid Inertial and Vision Tracking for Augmented Reality Registration," http://graphics.usc.edu/cgit/pdf/papers/Vr1999.pdf (Mar. 1999).
You, et al., "Orientation Tracking for Outdoor Augmented Reality Registration," IEEE Computer Graphics and Applications, IEEE, vol. 19, No. 6, pp. 36-42 (Nov. 1999).
Youngblut, et al., "Review of Virtual Environment Interface Technology," Institute for Defense Analyses (Mar. 1996).
Yun, et al., "Recent Developments in Silicon Microaccelerometers," SENSORS, 9(10) University of California at Berkeley, Oct. 1992.
Zhai, "Human Performance in Six Degree of Freedom Input Control," Ph.D. Thesis, University of Toronto (1995).
Zhai, "User Performance in Relation to 3D Input Device Design," Computer Graphics 32(4), pp. 50-54, Nov. 1998; text downloaded from http://www.almaden.ibm.com/u/zhai/papers/siggraph/final.html on Aug. 1, 2011.
Zhou, et al., "A survey—Human Movement Tracking and Stroke Rehabilitation," Technical Report: CSM-420, ISSN 1744-8050, Dept. of Computer Sciences, University of Essex, UK, Dec. 8, 2004.
Zhu et al., "A Real-Time Articulated Human Motion Tracking Using Tri-Axis Inertial/Magnetic Sensors Package," IEEE Transactions on Neural Systems and Rehabilitation Engineering, vol. 12, No. 2, Jun. 2004.
Zowie Playsets, http://www.piernot.com/proj/zowie/ (accessed on Jul. 29, 2011).
"Kirby Tilt 'n' Tumble 2" http://www.unseen64.net/2008/04/08/koro-koro-kirby-2-kirby-tilt-n-tumble-2-gc-unreleased/, Apr. 8, 2008 (accessed on Jul. 29, 2011).
"Emerald Forest Toys" [online] [retrieved on Aug. 14, 2005], retrieved from Internet <URL:http://www.pathworks.net/print_eft.html>.
Boulanger et al., "The 1997 Mathews Radio Baton and Improvisation Modes," Music Synthesis Department, Berklee College of Music (1997).
Complainants' Petitiion for Review, dated Sep. 17, 2012.
Complainants' Response to Commission'S Request for Statements on the Public Interest, dated Oct. 10, 2012.
Complainants' Response to Respondents' Review, dated Sep. 25, 2012.
*Creative Kingdoms LLC* v. *ITC*, The United States Court of Appeals for the Federal Circuit, No. 2014-1072, dated Dec. 19, 2014.
Exintaris, et al., "Ollivander's Magic Wands : HCI Development," available at http://www.cim.mcgill.ca/~jer/courses/hci/project/2002/www.ece.mcgill.ca/%257Eeurydice/hci/notebook/final/MagicWand.pdf (2002).
Expert Report of Branimir R. Vojcic, Ph.D. on Behalf of Complainants Creative Kingdoms, LLC and New Kingdoms, LLC, dated Nov. 17, 2011.
Expert Report of Kenneth Holt on Behalf of Respondents Nintendo of America, Inc. and Nintendo Co., Ltd., dated Nov. 3, 2011.
Expert Report of Nathaniel Polish, Ph.D. on Behalf of Respondents Nintendo of America, Inc. and Nintendo Co., Ltd., dated Nov. 3, 2011.
IGN Article—Mad Catz Rumble Rod Controller, Aug. 20, 1999.
Initial Determination on Violation of Section 337 and Recommended Determination on Rememdy and Bond, dated Aug. 31, 2012.
Marrin, Teresa, "Toward an Understanding of Musical Gesture: Mapping Expressive Intention with the Digital Baton," Masters Thesis, Massachusetts Institute of Technology, Program in Media Arts and Sciences (1996).
Nintendo N64 Controller Pak Instruction Booklet, 1997.
Paradiso, et al., "Musical Applications of Electric Field Sensing", available at http://pubs.media.mit.edu/pubs/papers/96_04_cmj.pdf (1996).
Paradiso, Joseph A., "The Brain Opera Technology: New Instruments and Gestural Sensors for Musical Interaction and Performance" (Nov. 1998) (electronic copy available at http://pubs.media.mit.edu/pubs/papers/98_3_JNMR_Brain_Opera.pdf).
Petition of the Office of Unfair Import Investigations for Review-In-Part of the Final Initial Determination, dated Sep. 17, 2012.
Pre-Hearing Statement of Complainants Creative Kingdoms, LLC and New Kingdoms, LLC, dated Jan. 13, 2012.
Public Version of Commission Opinion from United States International Oct. 28, 2013. Trade Commission, dated Oct. 28, 2013.
Respondents Nintendo Co., Ltd. and Nintendo of America Inc.'s Contigent Petition for Review of Initial Determination, dated Sep. 17, 2012.
Respondents Nintendo Co., Ltd. and Nintendo of America Inc.'s Objections and Supplemental Responses to Complainants Creative Kingdoms, LLC and New Kingdoms, LLC's Interrogatory Nos. 35, 44, 47, 53, and 78, dated Oct. 13, 2011.
Respondents Nintendo Co., Ltd. and Nintendo of America Inc.'s Response to Complaints' and Staff's Petitions for Review, dated Sep. 25, 2012.
Response of the Office of Unfair Import Investigations to the Petitions for Review, dated Sep. 25, 2012.
Response to Office Action dated Sep. 18, 2009 for U.S. Appl. No. 11/404,844.
Specification of the Bluetooth System—Core v1.0b, Dec. 1, 1999.
Verplaetse,"Inertial Proprioceptive Devices: Self-Motion Sensing Toys and Tools," IBM Systems Journal, vol. 35, Nos. 3&4 (Sep. 1996).
Resnick, et al., "Digital Manipulatives: New Toys to Think With," Chi 98; Apr. 1998; pp. 281-287.

* cited by examiner

WIRELESS TOY SYSTEMS AND METHODS FOR INTERACTIVE ENTERTAINMENT

RELATED APPLICATIONS

This application is a continuation of U.S. patent application Ser. No. 14/226,127, filed Mar. 26, 2014, which is a continuation of U.S. patent application Ser. No. 12/355,489, filed Jan. 16, 2009, now U.S. Pat. No. 8,753,165, issued Jun. 17, 2014, which is a continuation of U.S. patent application Ser. No. 11/241,812, filed Sep. 30, 2005, now U.S. Pat. No. 7,488,231, issued Feb. 10, 2009, which is a continuation of U.S. patent application Ser. No. 10/045,582, filed Oct. 22, 2001, now U.S. Pat. No. 7,066,781, issued Jun. 27, 2006, which claims priority to U.S. Provisional Patent Application No. 60/241,893, filed Oct. 20, 2000, each of which is hereby incorporated herein by reference in its entirety.

BACKGROUND OF THE INVENTION

1. Field of the Invention

This invention relates in general to children's toys primarily of the stuffed-animal, doll or action figure variety, and, in particular, to a children's toy having an RFID tag or other wireless, batteryless communication/identification device associated therewith.

2. Description of the Related Art

Children's toys in the form of traditional dolls, puppets, stuffed animals and the like have been around for centuries and are an enduring favorite among children—particularly among toddler-age children. A favorite doll, stuffed animal or other similar toy can provide a much-needed imaginary friend, pet or playmate for a child who occasionally gets lonely or bored. Such "playmate" toys can also help a child to express himself or herself and to learn basic social skills that foster personality development and overall social adjustment.

Most traditional playmate toys are simple stuffed animals, puppets or molded plastic dolls and the like. Most are mass produced and distributed nationally and/or internationally via a vast network of stores, wholesalers, retailers and other distributors. Many of these toys embody, represent or are otherwise associated with a particular licensed television character or personality, such as the Sesame Street™ puppets, Barney and Friends™, or the various Disney™ characters. Thus, the familiarity and likeability of the licensed character creates demand for the licensed toy. Others are simple generic forms representing people, animals, cars, robots, friendly monsters, and/or other imaginative creations.

Some playmate toys are personalized via individual names, birth certificates, etc. For example, the once-popular Cabbage Patch Kids™ came complete with individualized facial and hair features, name and official birth certificate. Another popular toy vendor, Build 'a Bear™, takes the concept of personalization even further by allowing and encouraging children to actually pick out, stuff, dress and name their favorite stuffed-animal playmate toy. In many cases, the vendor/retailer continues to provide periodic birthday reminder cards, custom wardrobe selections, notices of special events and the like even after the toy is purchased. All of these individualized "personality" touches can make an otherwise-inanimate playmate toy seem more real and fun for a child and helps foster that certain special relationship and bond that often develops between a child and his or her favorite playmate toy.

Another recent improvement involves uniquely identifying a stuffed animal toy with a bar-code tag that is inserted into the stuffing of the toy and which can be "surgically" extracted and read using conventional bar-code technology. The internal bar code tag is useful in helping identify lost or stolen stuffed animals and to return them to their rightful owners. However, use of an internal bar code tag in this manner is inconvenient and can potentially damage the stuffed animal during surgical extraction and replacement. On the other hand, placing the bar code tag on an accessible exterior portion of the stuffed animal could impair the aesthetics and functionality of the toy, possibly posing choking hazards and/or increasing the risk that the tag becomes separated from the stuffed animal.

SUMMARY OF THE INVENTION

The present invention expands and improves upon the concept of a playmate toy or other similar children's toy by associating with the toy a unique wireless, batteryless ID tag ("tag" or "token") that can be read from and/or written to using radio-frequency waves. Because radio waves can easily penetrate solid objects, such as the outer skin of a toy and/or the like, the tag can be mounted internally within a cavity of the toy and thereby provide communication of stored information without requiring surgical removal of the tag. Thus, a stuffed animal or other toy can be quickly and easily identified non-invasively, without damaging the toy. Additional information (e.g., unique personality traits, special powers, skill levels, etc.) can also be easily stored on the tag, thus providing further personality enhancement, input/output programming, simulated intelligence and/or interactive gaming possibilities.

In accordance with one embodiment, the present invention provides a children's toy comprising a doll, puppet or stuffed animal containing therein a wireless tag/transponder configured and adapted to facilitate non-invasive electronic storage and retrieval of desired information.

In accordance with another embodiment the present invention provides an interactive play system and seemingly magical toy for enabling a trained user to electronically send and receive information to and from other toys and/or to and from various reader devices distributed throughout a play facility and/or connected to a master control system. The toy or other seemingly magical object is configured to use a send/receive radio frequency communication protocol which provides a basic foundation for a complex, interactive entertainment system to create a seemingly magic interactive play experience for play participants who possess and learn to use the magical toy.

In accordance with another embodiment the present invention provides an interactive play structure in the theme of a "magic" training center. Within the play structure, play participants train a magical bear and/or learn to use a "magic wand" and/or other tracking/actuation device. The bear or wand allows play participants to electronically and "magically" interact with their surrounding play environment simply by placing the bear or wand in a particular location to produce desired effects within the play environment. Various receivers or transceivers are distributed throughout the play structure to facilitate such interaction via wireless communications.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Figure 1:
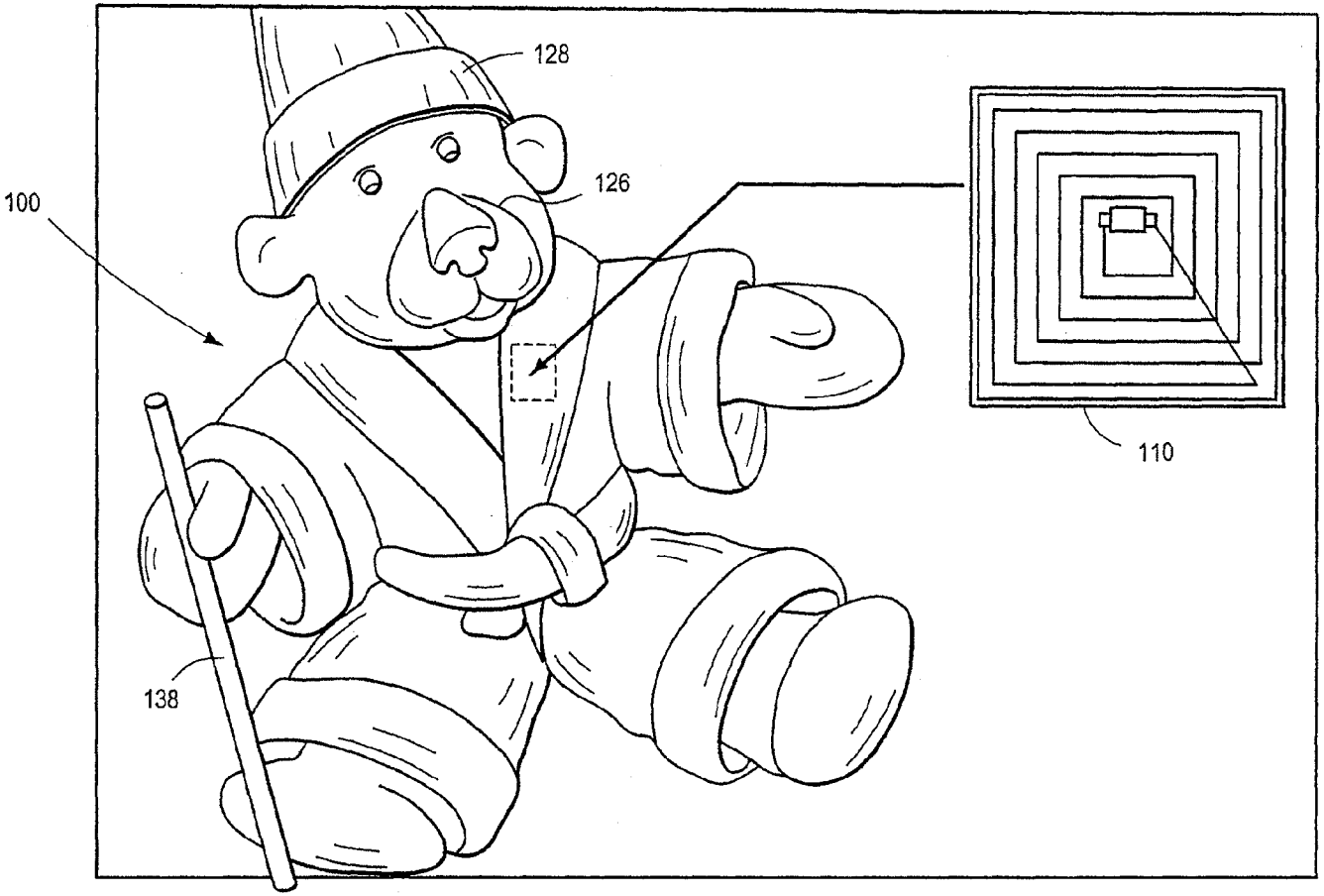
FIG. 1 is a partially-exploded schematic view of a children's toy in the form of a stuffed-animal having an RFID tag device associated therewith in accordance with one preferred embodiment of the invention.

In describing the various preferred embodiments in reference to the appended figures, similar reference numerals may sometimes be used to indicate similar structures or features of the invention. However, it is to be understood that such indicated structures or features may or may not be identical in the various described embodiments of the invention.

RFID-Tagged Toy

FIG. 1 is a partially-exploded schematic view of a children's toy 100 having an RFID tag device 110 associated therewith in accordance with one preferred embodiment of the invention. In the illustrated embodiment the toy comprises a simple stuffed "teddy bear." Of course those skilled in the art will readily appreciate that the invention is equally applicable to many other types of toys, such as, for example and without limitation: stuffed animals, dolls, puppets, action figures, robots, battery operated toys, trinkets, amusement items, jewelry, board games and board game tokens, masks, costumes, magic wands/hats/bags and the like, interactive children's books, balls, pillows, bean bags, and many other similar toys capable of carrying and/or receiving an RFID tag as described herein. Other than as described herein, the bear 100 is fabricated and constructed in any conventional fashion using known and existing materials, fabrics, stuffing and the other materials, as desired.

At least one electronic tag device—preferably a read/write, wireless, batteryless, RFID tag device 110—is inserted inside the body 126 of the bear 100, as illustrated, to create a "magic bear" toy having features and advantages of the present invention. Preferably, insertion of the tag is accomplished during manufacture of the bear at the factory or within a retail facility, in the case of a make-your-own-bear. Alternatively, the tag may be inserted into an existing stuffed-animal or other toy by surgical insertion, partial disassembly or other expedients readily apparent to those skilled in the art.

Figure 10:
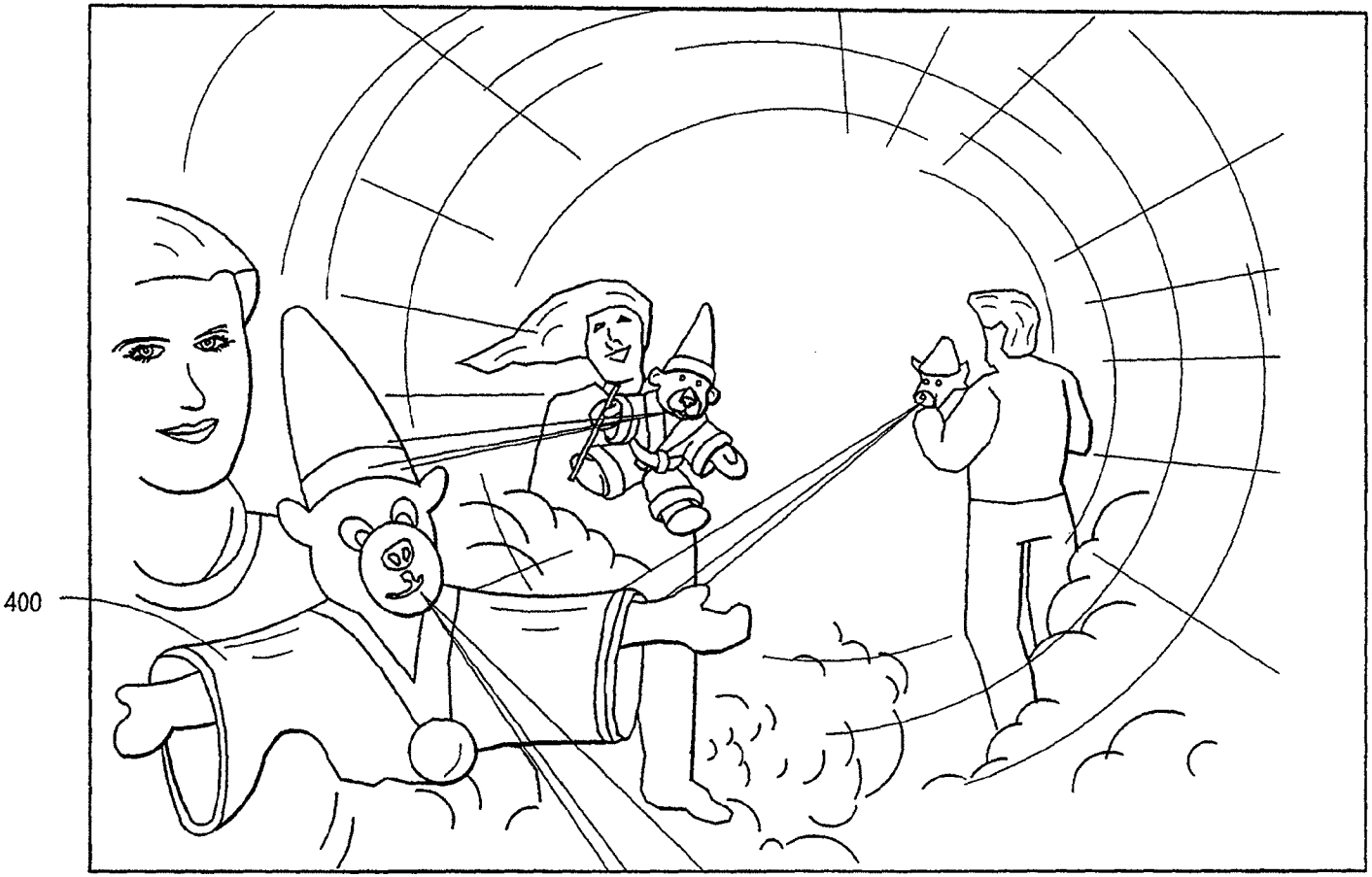

If desired, the tag may be enveloped, contained or otherwise embodied in a small heart-shaped trinket, case or other similar-shaped item as may be appropriate and fun for kids. Preferably, the tag 110 is permanently installed and contained within the body 126 of the bear such that it cannot be easily removed or become dislodged. Placement of the tag within the body 126 is preferably such that it does not interfere with or diminish the softness of the bear or expose sharp/hard surfaces that may poke or puncture the skin of the bear 100. The head and belly are preferred tag locations. Alternatively, multiple tags 110 may be inserted and placed with the body of the bear 100 at one or more different locations (e.g., hands, feet, head, belly, etc.) as desired in order to provide redundant and/or multi-functioning tag devices. Various auxiliary devices, special effects and the like may also be provided to complement the overall theme and functionality of the toy 100. For example, the bear 100 may include an LED indicator on its nose (see FIG. 10) which glows whenever the bear becomes "magically empowered" (i.e., when its tag is read and/or the bear comes within proximity of an associated reader).

The particular tag device 110 illustrated is intended to be inserted inside a children's toy 100. Alternatively and/or in addition, one or more RFID tag devices may be affixed or adhered to the toy bear 100 upon any convenient surface thereof, or it may be inserted into one or more associated articles of clothing, accessories, jewelry or other items designed to be worn/used either by the playmate toy or a child. For example, a "magic" hat 128, or wand 138 may be donned by the bear 100 for purposes of special "magic training" sessions.

Figure 2C:
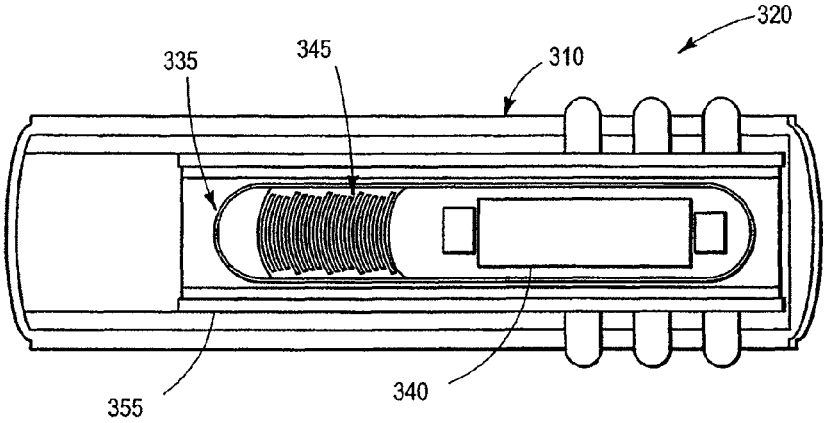
FIG. 2C is a partial cross-section detail view of the distal end or transmitting portion of the wand toy of FIG. 2A, illustrating the provision of an RFID tag device therein.
Figure 2A:
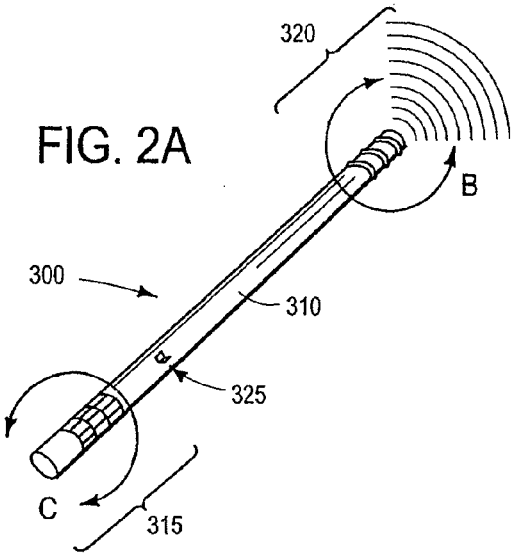
FIG. 2A is a perspective view of a children's toy in the form of a magical wand having an RFID tag device associated therewith in accordance with one preferred embodiment of the invention.

FIG. 2 illustrates in more detail the basic construction of a preferred embodiment of one such "magic" wand 300 having features and advantages in accordance with one preferred embodiment of the invention. As illustrated in FIG. 2A the wand 300 basically comprises an elongated hollow pipe or tube 310 having a proximal end or handle portion 315 and a distal end or transmitting portion 320. If desired, an internal cavity may be provided to receive one or more batteries to power optional lighting, laser or sound effects and/or to power longer-range transmissions such as via an infrared LED transmitter device or RF transmitter device. An optional button 325 may also be provided, if desired, to enable particular desired functions, such as sound or lighting effects or longer-range transmissions.

Figure 2B:
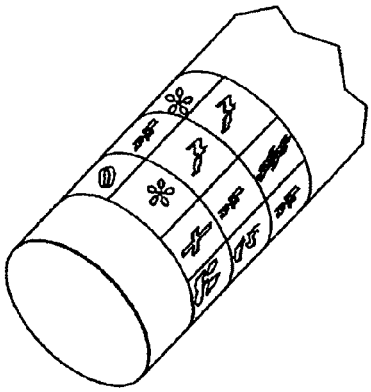
FIG. 2B is a partially exploded detail view of the proximal end or handle portion of the wand toy of FIG. 2A, illustrating the optional provision of combination wheels having features and advantages in accordance with the present invention.

FIG. 2B is a partially exploded detail view of the proximal end 315 of the magic wand toy 300 of FIG. 2A. As illustrated, the handle portion 315 is fitted with optional combination wheels having various symbols and/or images thereon. Preferably, certain wand functions may require that these wheels be rotated to produce a predetermined pattern of symbols such as three owls, or an owl, a broom and a moon symbol. Those skilled in the art will readily appreciate that the combination wheels may be configured to actuate electrical contacts and/or other circuitry within the wand 300 in order to provide the desired functionality. Alternatively, the combinations wheels may provide a simple security measure to prevent unauthorized users from actuating the wand.

RFID Tag/Transponder

FIG. 2C is a partial cross-section detail view of the distal end of magic wand toy 300 of FIG. 2A. As illustrated, the distal end 320 is fitted with an RFID (radio frequency identification device) transponder 335 that is operable to provide relatively short-range RF communications (<60 cm). This transponder basically comprises a passive (non-battery-operated) RF transmitter/receiver chip 340 and an antenna 345 provided within an hermetically sealed vial 350. A protective silicon sheathing 355 is preferably inserted around the sealed vial 350 between the vial and the inner wall of the tube 310 to insulate the transponder from shock and vibration.

At its most basic level, RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either unidirectionally (read only) or, more preferably, bi-directionally (read/write). One suitable RFID transponder is the 134.2 kHz/123.2 kHz, 23 mm Glass Transponder available from Texas Instruments, Inc. (http://www.tiris.com, Product No. RI-TRP-WRHP).

Figure 3:
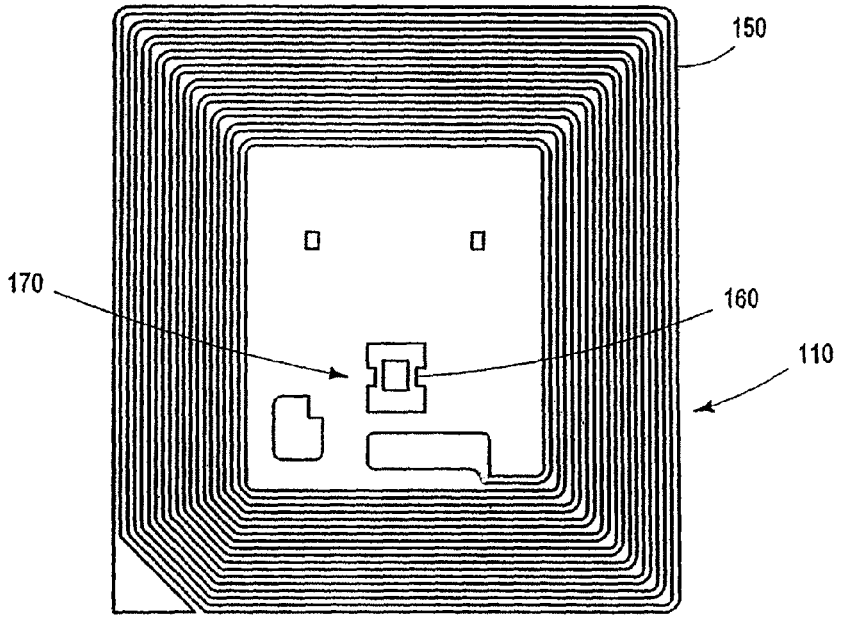
FIG. 3 is a detailed schematic view of one embodiment of an RFID tag device for use with the toy of FIG. 1 and having features and advantages in accordance with the present invention.

FIG. 3 is a detailed schematic view of an alternative embodiment of an RFID tag device 110 for use with the toy bear of FIG. 1. The tag 110 in the preferred embodiment illustrated preferably comprises a radio frequency tag pre-programmed with a unique bear identifier number ("UBIN"). Other stored information (either pre-programmed or programmed later) may include, for example, the bear's name, its owner's name and age, the bear's rank or level, total points accumulated, tasks completed, facilities visited, etc. The tag 110 generally comprises a spiral wound antenna 150, a radio frequency transmitter chip 160 and various electrical leads and terminals 170 connecting the chip 160 to the antenna 150.

The tag may be a passive tag 110 or battery-powered, as expedience and costs dictate. Preferably, the tag 110 is passive (requires no batteries) so that it is inexpensive to purchase and maintain. Such tags and various associated readers and other accessories are commercially available in a wide variety of configurations, sizes and read ranges. RFID tags having a read range of between about 10 cm to about 100 cm are particularly preferred, although shorter or longer read ranges may also be acceptable. The particular tag 110 illustrated is the 13.56 mHz tag sold under the brand name Tagit™ available from Texas Instruments, Inc. (http://www.tiris.com, Product No. RI-103-110A). The tag 110 has a useful read/write range of about 25 cm and contains 256-bits of on-board memory arranged in 8×32-bit blocks which may be programmed (written) and read by a suitably configured read/write device. If a longer read/write range (e.g., 1-100 meters) and/or more memory (e.g., 1-100 Mb) is desired, optional battery-powered tags may be used instead, such as the AXCESS active RFID network system available from AXCESS, Inc. and/or various other RF-based asset and people tracking applications known to those skilled in the art.

Figure 4A:
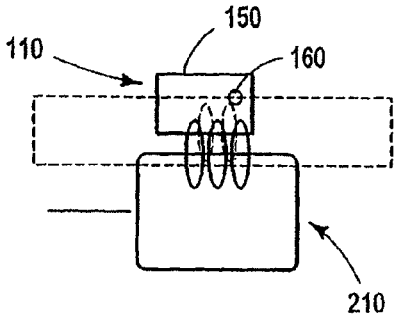
FIGS. 4A and 4B are schematic diagrams illustrating typical operation of the RFID tag device of FIG. 3.
Figure 4B:
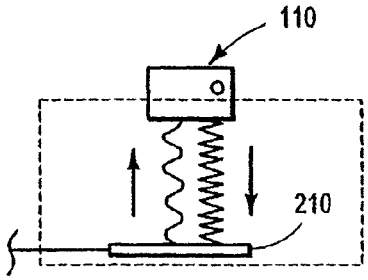

FIG. 4 is a simplified block diagram illustrating the basic organization and function of the electronic circuitry comprising the radio frequency transmitter chip 160 of the RFID tag device 110 of FIG. 2. The chip 160 basically comprises a central processor 230, Analogue Circuitry 235, Digital Circuitry 240 and on-board memory 245. On-board memory 245 is divided into read-only memory (ROM) 250, random access memory (RAM) 255 and non-volatile programmable memory 260, which is available for data storage. The ROM-based memory 250 is used to accommodate security data and the tag operating system instructions which, in conjunction with the processor 230 and processing logic deals with the internal "house-keeping" functions such as response delay timing, data flow control and power supply switching. The RAM-based memory 255 facilitates temporary data storage during transponder interrogation and response. The non-volatile programmable memory 260 may take various forms, electrically erasable programmable read only memory (EEPROM) being typical. It is used to store the transponder data and is preferably non-volatile to ensure that the data is retained when the device is in its quiescent or power-saving "sleep" state.

Various data buffers or further memory components (not shown), may be provided to temporarily hold incoming data following demodulation and outgoing data for modulation and interface with the transponder antenna 150. Analog Circuitry 135 provides the facility to direct and accommodate the interrogation field energy for powering purposes in passive transponders and triggering of the transponder response. Analog Circuitry also provides the facility to accept the programming or "write" data modulated signal and to perform the necessary demodulation and data transfer processes. Digital Circuitry 240 provides certain control logic, security logic and internal microprocessor logic required to operate central processor 230.

Advantageously, the UBIN stored on each tag 110 may be used to wirelessly identify and track individual bears 100 within a retail facility, park, hotel/resort/restaurant and/or anywhere else around the world. Optionally, each tag 110 may also include a unique kid identifier number ("UKIN") which may be used to match one or more bears with an individual kid-owner. If desired, the tag 110 may be covered with an adhesive paper label (not shown) for surface adhesion to a toy, clothes, or any other tag bearing surface. More preferably, the tag 110 may be molded and/or embedded into a relatively stiff plastic sheet substrate and/or transponder cylinder which holds and supports the tag 110. Optionally, the sheet substrate, transponder or other support structure may be shaped as a heart, a medallion, a high-tech gizmo or any other fanciful shape, as desired. The resulting structures may be inserted into the bear 100 (e.g., a heart), or they may be worn externally by either the bear 100 and/or its kid-owner (e.g., as a bracelet, necklace, key chain trinket, etc.).

Reader/Writer Devices

In operation, various RFID reader (and/or reader/writer) devices are provided and may be distributed throughout a hotel/resort, retail facility, play facility, theme park, family entertainment center or any other "magic bear" compatible environment. These readers are able to read the information stored on each tag 110 when the associated bear 100 is brought into suitable proximity of the reader (1 to 100 cm). Advantageously, because radio waves can easily penetrate solid objects, such as the outer skin of a toy and/or the like, the tag 110 can be mounted internally within a cavity of the toy, thereby providing communication of stored information without requiring surgical extraction of the tag. Thus, the UBIN and UKIN information can be conveniently read non-invasively, without damaging the toy. This information may be easily communicated to a cash-register display, computer monitor, interactive game control system, display system or other tracking, recording or displaying device for purposes of identifying, logging and creating a record of each bear's experience. Additional information (e.g., unique personality traits, special powers, skill levels, etc.) can also be easily stored on the tag, thus providing further personality enhancement, input/output programming, simulated intelligence and/or interactive gaming possibilities.

Information may also be conveniently used to identify a bear's name, birthday, and owner, calculating point totals from various gaming experiences, tracking and/or locating lost bears/children, verifying whether or not a bear/child is inside a facility, photo capture and retrieval, and/or many other useful purposes as will be readily obvious and apparent to those skilled in the art. Optionally, various updated information may be written to the tag 110, such as new point totals, rank, enhanced "magic" powers and skills.

Figure 6:
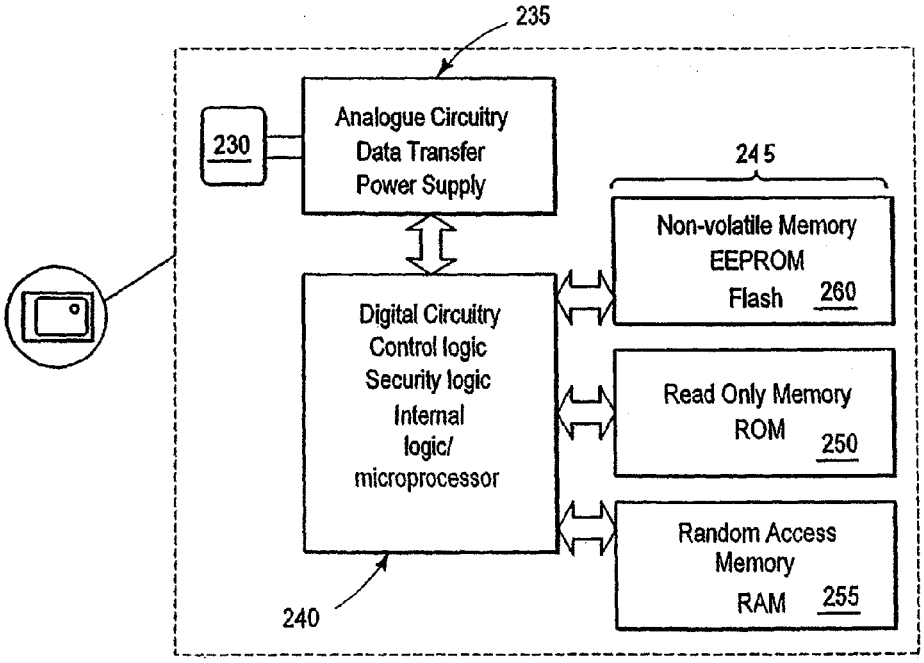
FIG. 6 is a simplified block diagram illustrating the basic organization and function of the electronic circuitry comprising the RFID tag device of FIG. 3.
Figure 5:
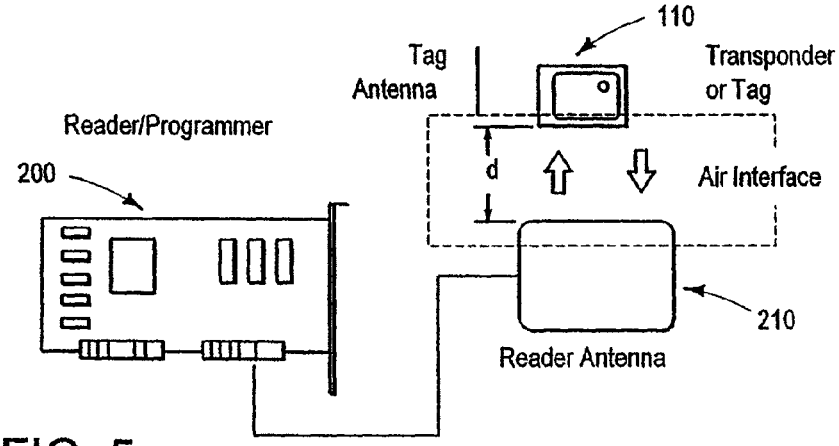
FIG. 5 is simplified schematic diagram of an RFID read/write system for use with the RFID tag device of FIG. 3 and having features and advantages in accordance with the present invention.

FIGS. 5 and 6 are simplified schematic illustrations of tag and reader operation. The tag 110 is initially activated by a radio frequency signal broadcast by an antenna 210 of an adjacent reader or activation device 200. The signal impresses a voltage upon the antenna 150 by inductive coupling which is then used to power the chip 160 (see, e.g., FIG. 3). When activated, the chip 160 transmits via radio frequency a unique identification number preferably corresponding to the UBIN and/or UKIN described above (see, e.g., FIG. 3 and associated discussion). The signal may be transmitted either by inductive coupling or, more preferably, by propagation coupling over a distance "d" determined by the range of the tag/reader combination. This signal is then received and processed by the associated reader 200 as described above. If desired, the RFID tag or transponder 110 may also be configured for read/write communications with an associated reader/writer. Thus, the unique tag identifier number (UBIN or UKIN) and any other stored information can be read, changed or other information may be added.

As indicated above, communication of data between a tag and a reader is by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care should be taken in the placement and orientation of the various readers 200 so as to minimize the probability of such data transmission errors. Preferably, the readers are placed at least 30-60 cm away from any metal objects, power lines or other potential interference sources. Those skilled in the art will also recognize that the write range of the tag/reader combination is typically somewhat less (~10-15% less) than the read range "d" and, thus, this should also be taken into account in determining optimal placement and positioning of each reader device 200.

Typical RFID data communication is asynchronous or unsynchronized in nature and, thus, particular attention should be given in considering the form in which the data is to be communicated. Structuring the bit stream to accommodate these needs, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are well know to those skilled in the art and will not be further discussed herein. The choice of carrier wave frequency is also important in determining data transfer rates. Generally speaking the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular application.

Master Control System

Figure 7:
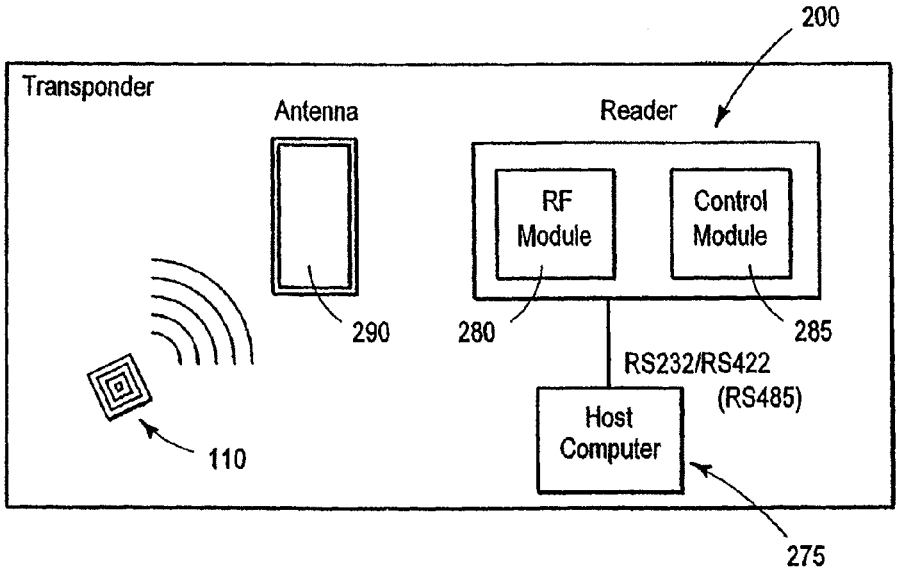
FIG. 7 is a simplified schematic diagram of an RF reader and master control system for use with the RFID-tagged toys of FIGS. 1 and 2 and having features and advantages in accordance with the present invention.

Depending upon the degree of complexity desired and the amount of information sharing required, some or all of the various reader/writer devices 200 may be connected to a master control system or central server 275 as illustrated in FIG. 7. For example, various electronic interactive play elements may be disposed throughout a play facility and which allow play participants to create desired "magical" effects. These may include interactive elements such as projectile accelerators, cannons, interactive targets, fountains, geysers, cranes, filter relays, and the like for amusing and entertaining play participants and/or for producing various desired visual, aural or tactile effects. These may be actuated manually by play participants or, more desirably, "magically" electronically by appropriately "training" one's bear in various magic skills. Some interactive play elements may have simple immediate effects, while others may have complex and/or delayed effects. Some play elements may produce local effects while others may produce remote effects. Each play participant within the facility, or sometimes a group of play participants working together, preferably must experiment with the various play elements and using their magic bears in order to discover how to create the desired effect(s). Once one play participant figures it out, he or she can use the resulting play effect to surprise and entertain other play participants. Yet other play participants will observe the activity and will attempt to also figure it out in order to turn the tables on the next group. Repeated play on a particular play element can increase the bear's magic skills to repeatedly produce a desired effect or increase the size or range of such effects. Optionally, play participants can have their bears compete with one another using the various interactive play elements to see which player's bear can create bigger, longer, more accurate or more spectacular magical effects.

In the case of an interactive play facility with a master control system preferably each RFID tag 110 is configured to electronically send and receive information to and from each reader/writer 200 distributed throughout the play facility using a send receive radio frequency ("SRRF") communication protocol. This communications protocol provides the basic foundation for a complex, interactive entertainment system which creates a seemingly magic interactive play experience for participants whose bears learn to use the seemingly "magical" powers they are imbued with via the RFID tag technology.

In the most refined embodiments, a participant may use his or her "magic bear" or other similar toy to electronically send and receive information to and from other bears/toys and/or to and from a master control system located within and/or associated with any of a number of play environments. This network of SRRF-compatible play environments provides a complex, interactive play and entertainment system that creates a seamless magical interactive experience that transcends conventional physical and temporal boundaries.

SRRF may generally be described as an RF-based communications technology and protocol that allows pertinent information and messages to be sent and received to and from two or more SRRF compatible devices or systems. While the specific embodiments described herein are specific to RF-based communication systems, those skilled in the art will readily appreciate that the broader interactive play concepts taught herein may be realized using any number of commercially available 2-way and/or 1-way medium range wireless communication devices and communication protocols such as, without limitation, infrared-, digital-, analog, AM/FM-, laser-, visual-, audio-, and/or ultrasonic-based systems, as desired or expedient.

In a preferred embodiment, a play facility is configured with SRRF technology to provide a master control system 275 for an interactive entertainment play environment using SRRF-compatible magic bears, magic wands and/or other SRRF compatible toys. A typical play facility provided with SRRF technology may allow 300-400 or more users to more-or-less simultaneously send and receive electronic transmissions to and from the master control system using the bear, a magic wand and/or other SRRF-compatible toys.

The SRRF system preferably uses a software program and database that can track the locations and activities of up to a hundred or more participants. This information is then used to adjust the play/ride experience for the user based on "knowing" where the user/player has been, what objectives that player (or group of players in a ride vehicle) has accomplished and how many points or levels have been reached. The system can then send messages to the users throughout the ride experience. For example, the system can allow or deny access to a secret passage based on how many points or levels reached by that participant's bear and/or based on what objectives the bear has accomplished or helped accomplish. It can also indicate, via sending a message to the user the amount of points or specific objectives necessary to complete a "mission" or enter the next level of play. The master control system may log events into a data base for later retrieval and use in applications, such as:

- Identifying a guest with a name, address and personal data (birthday, favorite color, bear's name, etc.)
- Locating the bear and child
- Triggering an event or special effect
- Allowing passage into a secret or magical place
- Recording activities completed, giving points for those achievements which then can be used for future redemption
- Storing information to create a storybook of each child's adventures
- Using bear/tag as a debit charge to purchase snacks, gift items, etc.

The master control system can also preferably send messages to the user from other users. Optionally, the system may be suitably configured to allow multiple users to interact with each other adjusting the master control system. The master system can also preferably interface with digital imaging and/or video capture so that the users can be visually tracked. Any user can locate another user either through the video capturing system or by sending a message to another device. At the end of a visit, participants are informed of their activities and the system interfaces with photo-printout capabilities. For example, as each participant enters a specific "game zone" within the facility, a reader reads data stored on the tag 110 embedded with the participant's bear or other SRRF-compatible toy. This information is communicated to the master system which logs/tracks the guest's progress through the facility while interfacing with other interactive systems within the venue. For example, upon receipt of an activation message received from a first game zone, the master system may trigger a digital camera focused on that area, thus capturing a digital image of the player and/or his or her bear. This photo image is electronically time-stamped and stored with identifying UBIN and UKIN for later retrieval. In this manner the SRRF technology allows the master control system to uniquely identify and track bears and people as they interact with various games and activities in a semi-controlled play environment.

Theming/Storyline

The present invention may be carried out using a wide variety of suitable themed environments, storylines and characters, as will be readily apparent to those skilled in the art. The following specific example is provided for purposes of illustration and for better understanding of the invention and should not be taken as limiting the invention in any way:

EXAMPLE

In a special spot of the world exists an incredible place made of magic. In the most amazing and enchanting forest lives an amazing wizard who has spent his life making cuddly critters who posses unusual abilities. These critters look like ordinary teddy bears or stuffed animals; cute and cuddly ready to become a child's best friend. But behind the fluff and stuffing this one-of-kind bear is Magical. Each and every bear was carefully created by this Wizard, has made thousands of unique stuffed creatures with the gift to become magical. However, these creations do not start off with magic powers. Only when the bear and its human mate are brought together the magic is sparked. But even then the bear is not yet able to use all of its magic powers until it is properly taught. It is the responsibility of the human to take the bear on a magic journey through the Enchanted Forest where the magic teachings begin. Then, for days to follow the bear is able to practice its magic powers in all sort of "normal" places. When the training and practice is complete, the bear is given its magic inductions and diploma (a hat, wand, etc., as appropriate) and is able to practice level-one magic. The magic bear's owner can then choose from a big selection of special clothing, accessories and other magical items to customize their new friend. New and improved magic skills can be learned by the magic bear and its human mate on its next journey to the enchanted forest.

The "MagicMate" is a specially designed stuffed animal that has "smart" ability (RFID tag/transponder), which makes it possible to be tracked and trigger effects throughout a special bear training facility (e.g., retail store, hotel/resort, family entertainment center, etc.). The facility can track and send signals to the bear from the time it is purchased and continuing even after the bear leaves the training facility. To the child/owner the bear is truly magical; making effects happen whenever the bear comes into contact with a magic-bear compatible device. In addition, the bear seems to be magically watched by the Wizard who seems to always know where the bear is and what it is doing.

For example, the bear training center may be located within a family hotel/resort. The experience begins when the guest (or the guests parents) reserve a room at the resort. They are given a special invitation to become a special owner to a magic bear who needs their help to become magical. They are given a basic background of the experience and the story behind Magic Mates. Guests who choose to participate would be assigned a specially designed magic-ready hotel room. Guests can also choose to partake any time they are staying at the resort. Of course, visitors not staying at the hotel may also purchase a magic-mate.

Figure 8:
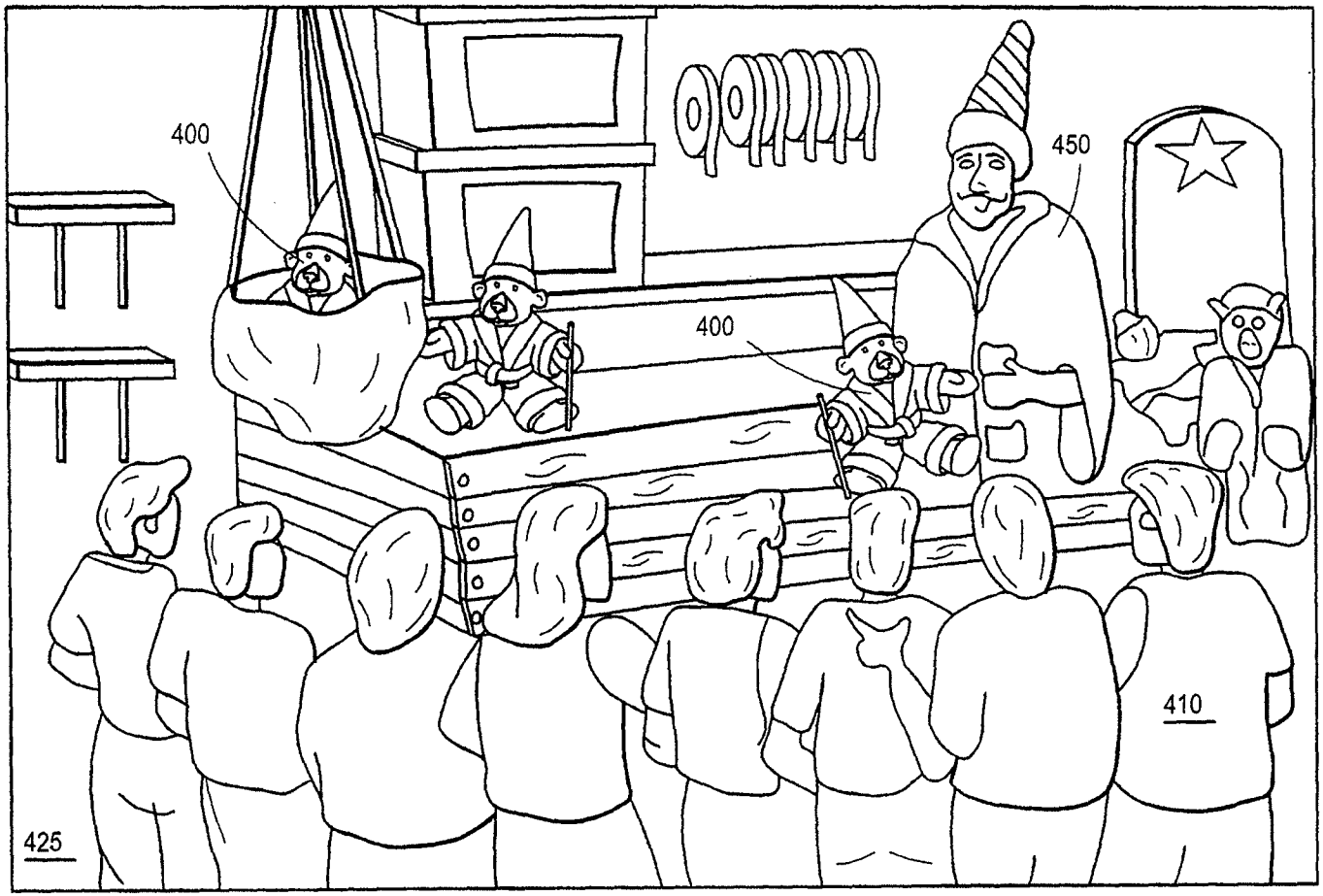
FIGS. 8-23 are various illustrations of a resort-based "magic bear" training facility having features and advantages of the present invention.
Figure 9:
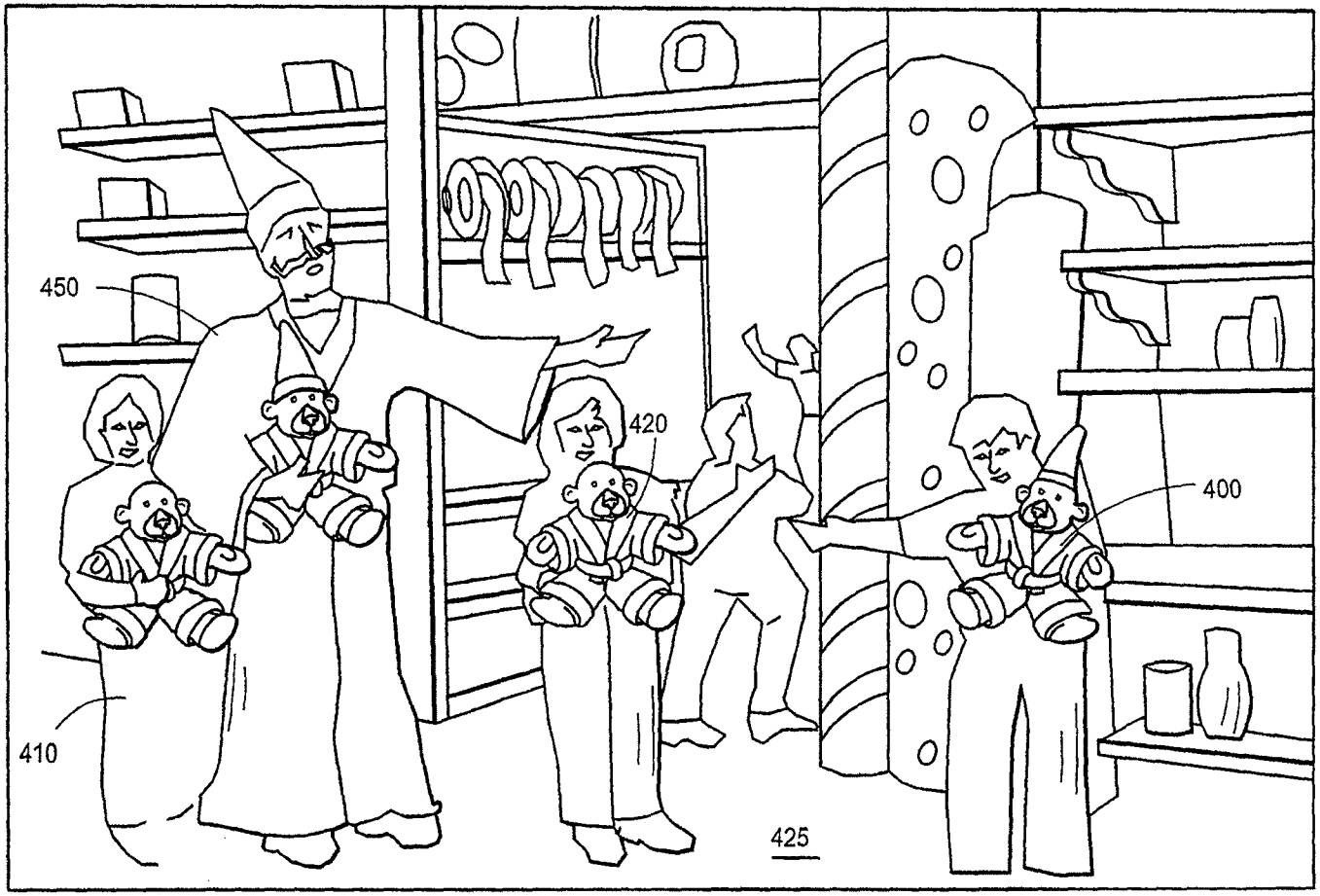

Once guests 410 arrive at the resort they select a time in which they will meet the Wizard 450 at his workshop 425 and finally are joined with their new magical friend 400 (FIGS. 8-9). When the guest arrives at this The Wizard Workshop 425 they are greeted by a Wizard 450 or two who lead them into the Wizard Workshop where they carefully select their magic mate 400. The guests are led into the workshop by a masterful Wizard who introduces them to his special creations. The Wizard also tells guests about his magical workshop and how he created these special bears for over 200 years and then helps the guests select their new magic-mate. Guests are asked to sign official adoption papers (initial identification process: name, address, bear name, etc.) and told how to care for their magic bear. The Wizard performs a special trick that "sparks" the bears magic so that it can begin its magic training with its new owner.

Figure 11:
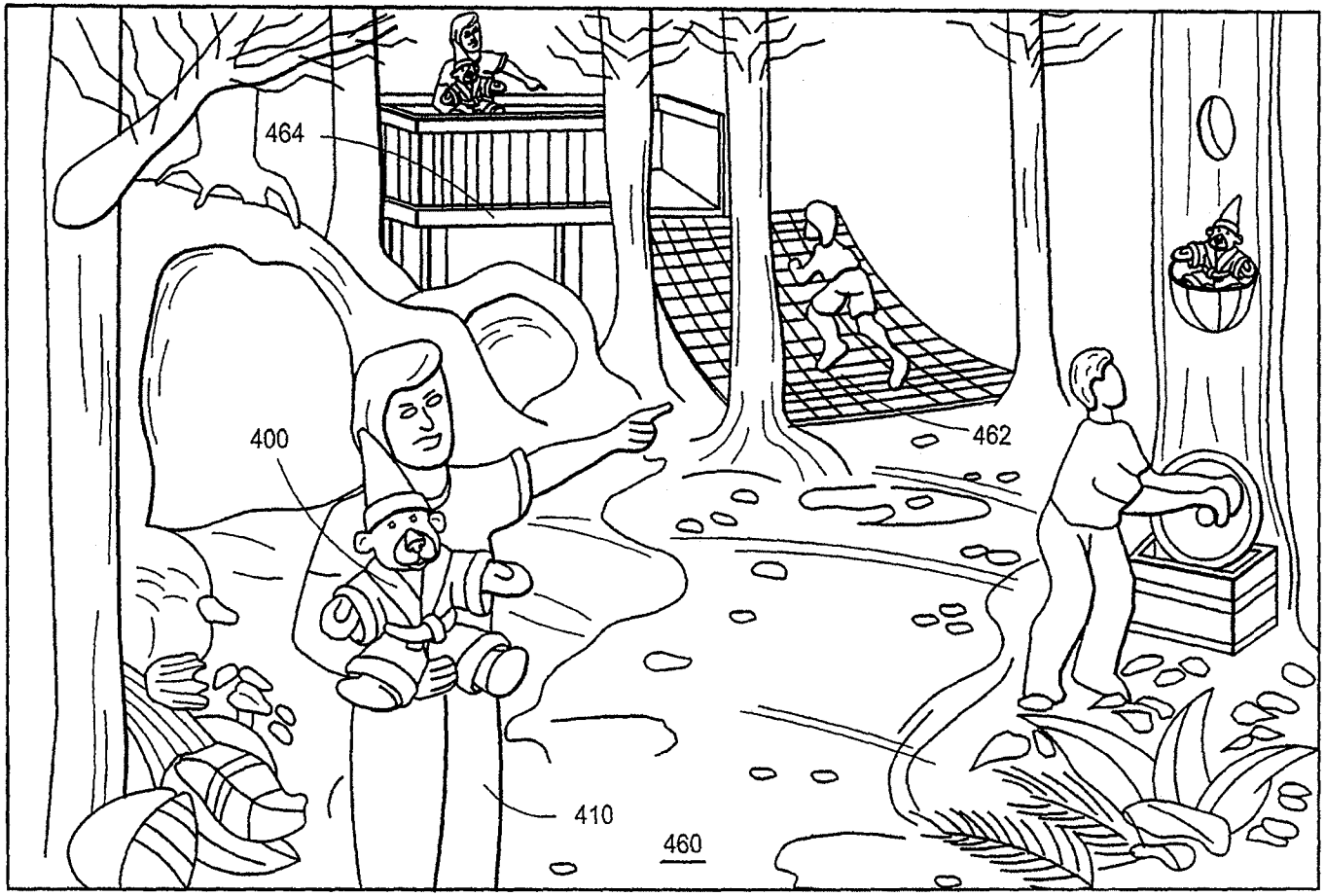
Figure 12:
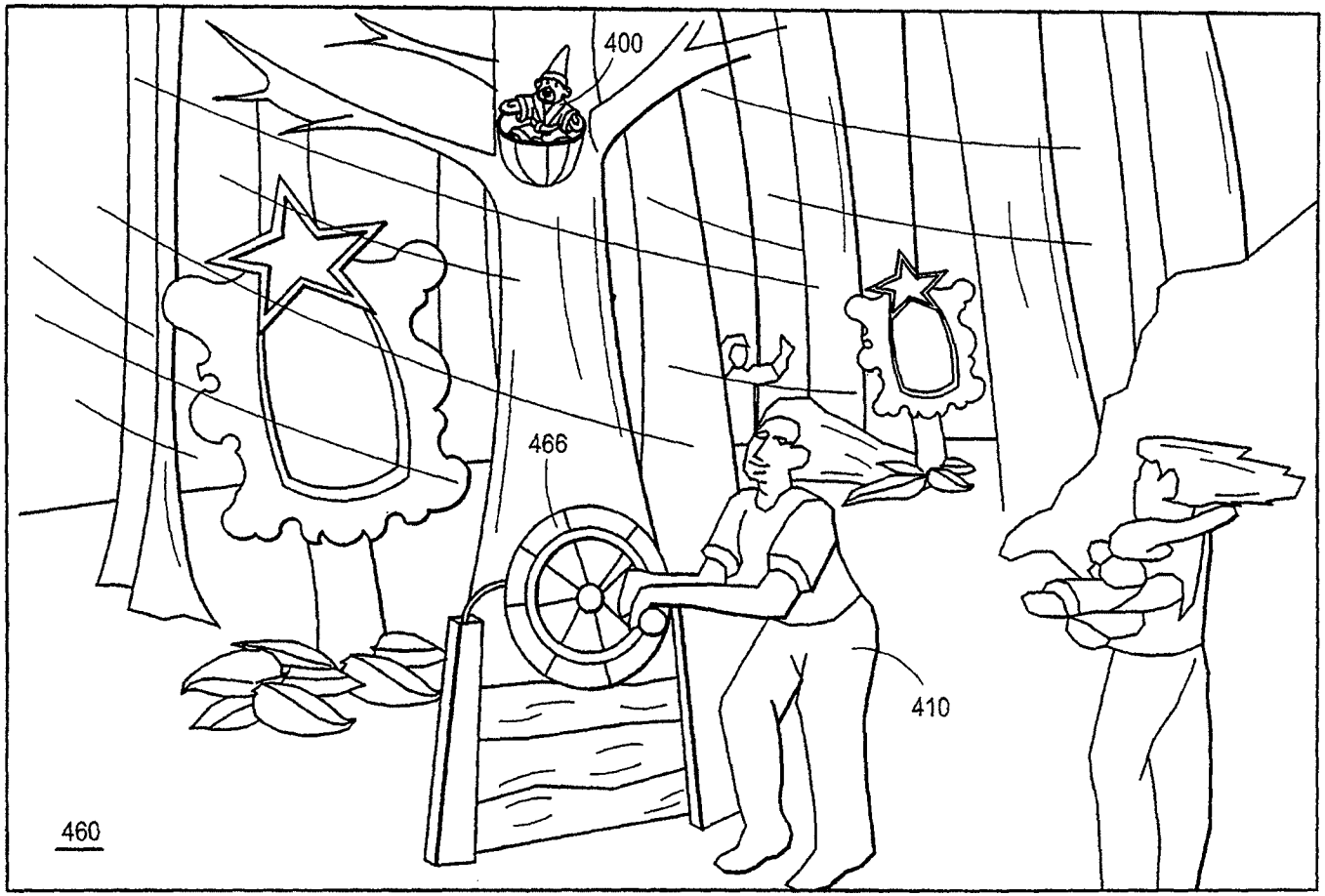
Figure 13:
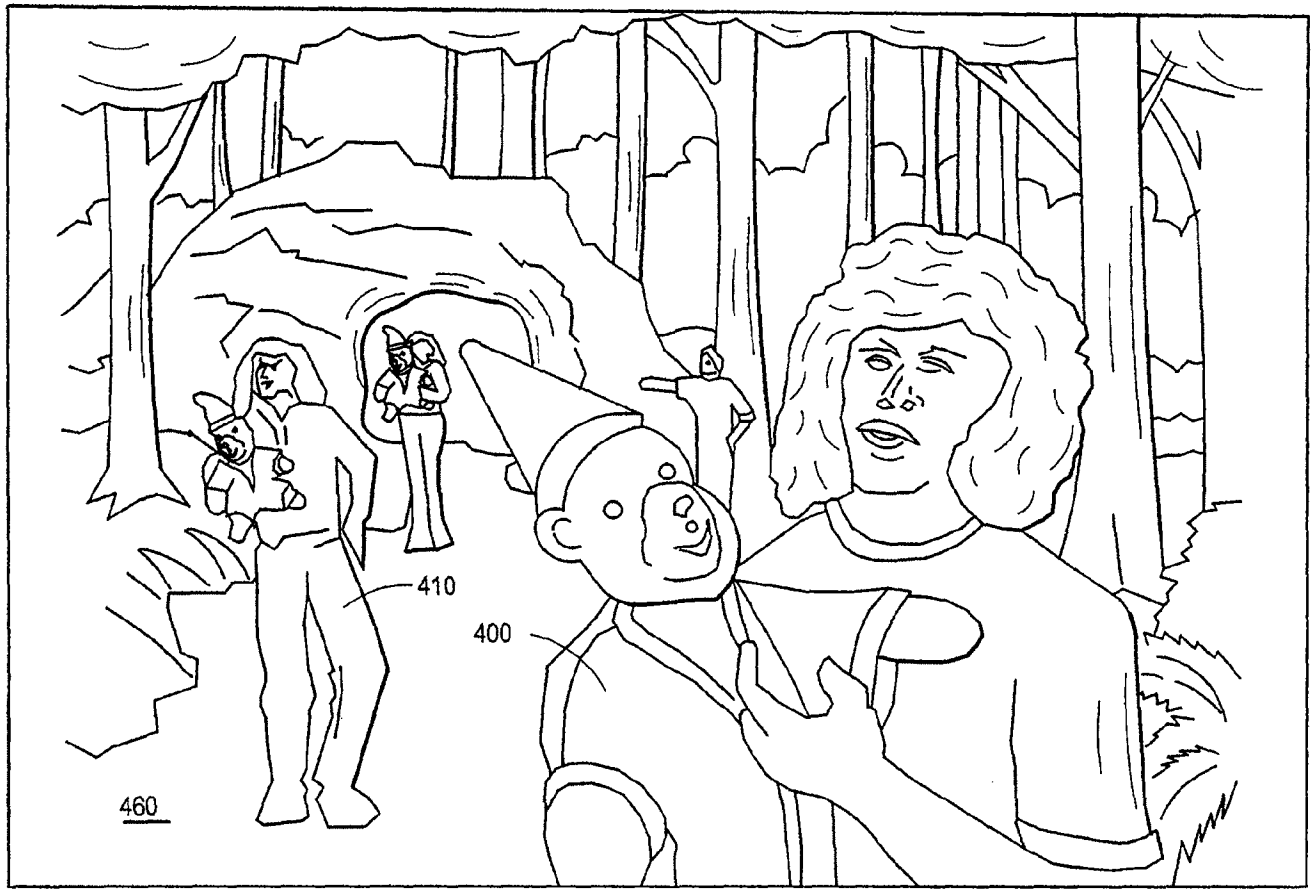

After guests choose their mate they are given official adoption papers, name their bear and the "story" (tracking) of the bear begins. They are then led through a hidden door, through a magical tunnel (FIG. 10) which takes them into the Enchanted Forest 460 where the magic training commences. The Enchanted Forest is an interactive maze of physical and hands on challenges, such as climbing nets 462, rope bridges 464, bear elevators 466, and the like (FIGS. 11-13). The bear 400 is taken by its owner through a series of magical lessons and fun experiences which will teach the bear and the guest how to use their magic powers. Magic is truly created and the bear 400 is able to set off a series of special effects as well as respond to various signals. Guests work their way through various caves, trees and bridges to different magic stations that help them teach their bear new skills. Each station is outfitted with a reader/writer device that logs and activates an effect after the bear completes a certain skill. For example, the bear's owner must teach the bear a magic saying. When this magic saying is done in a specific way (hold your bear to the sky and say, "Swish, Swirl, Bluster and Blow, Make the winds gust and grow!"), the bear's light will glow and powerful winds (high-powered fans) blow at the guests.

Figure 14:
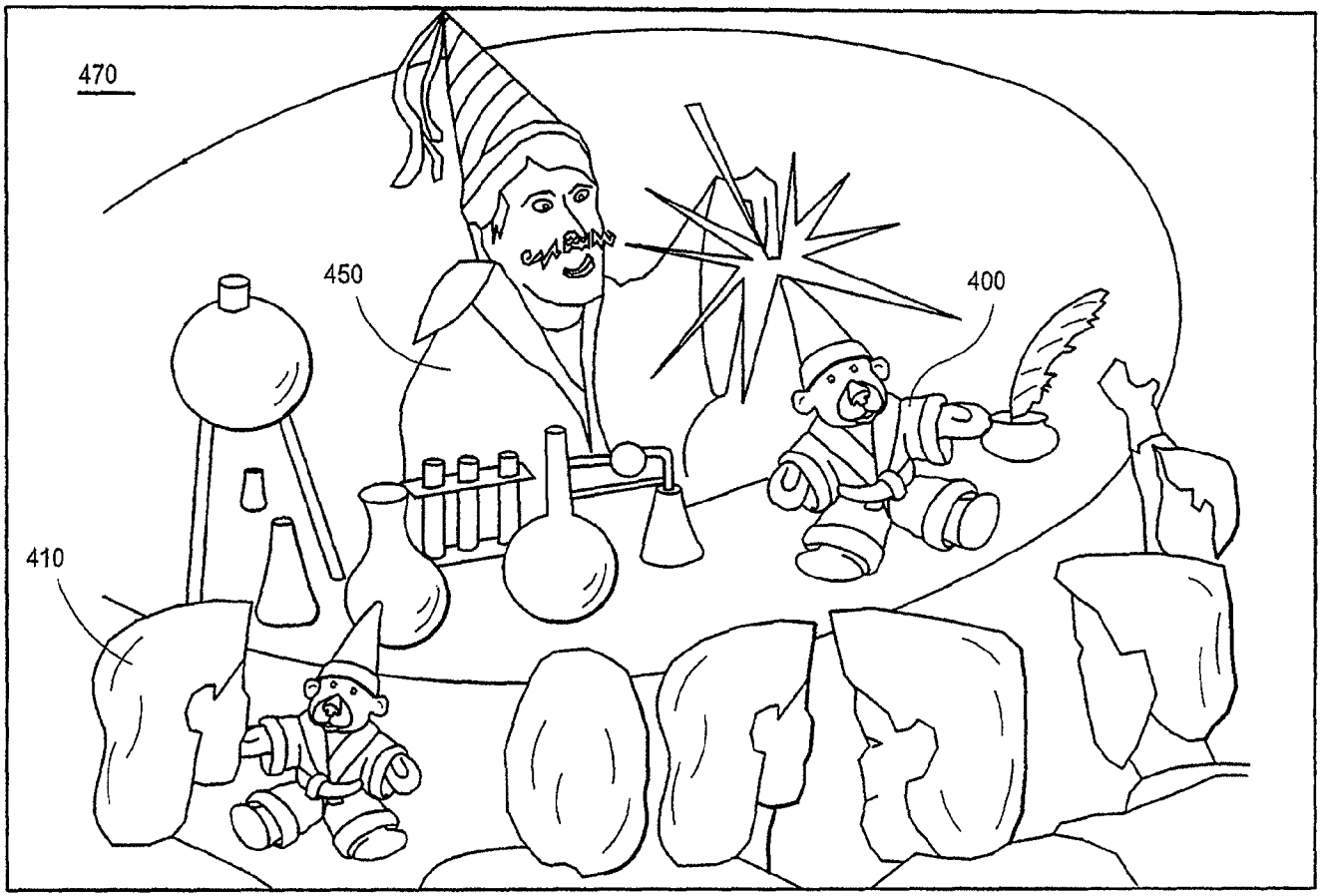
Figure 15:
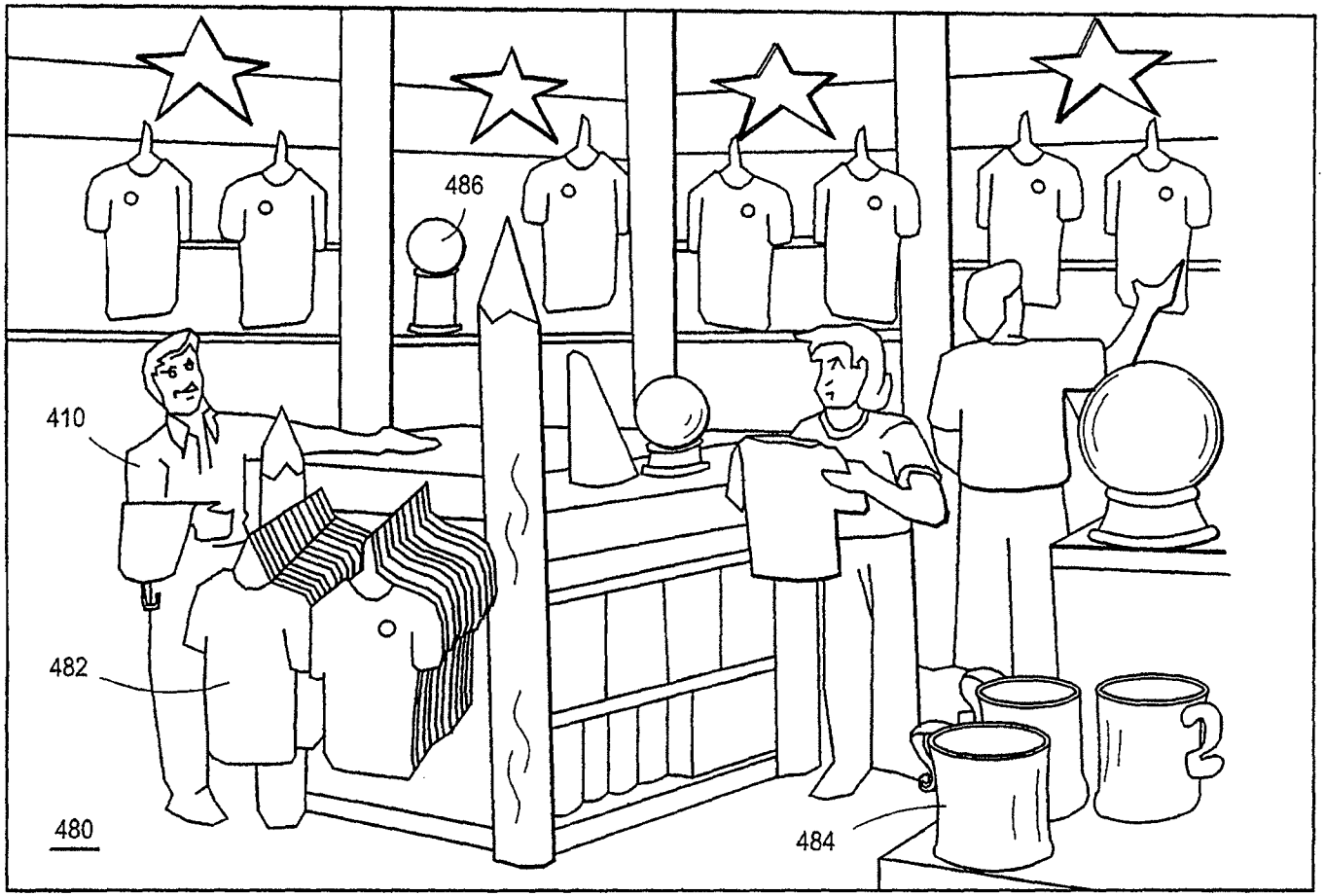

Once they make it through the Enchanted Forest they are then taken to a Wizard's Cove 470 (FIG. 14) where the Wizard 450 tests the bear's magic skills and official ceremonies are conducted. If they pass, they will be dubbed by the Wizard to have Level One Magic Powers. This area is actually a small theatre that uses a projected image of the Wizard and special effects. The bear will respond to signals that are integrated into the show. The guest then exits into a WizardWear shop 480 (FIG. 15) where he or she is able to select from dozens of outfits 482, accessories 484 and magical items 486.

Their magic experience doesn't end once guests exit the attraction area. Actually, the real experience begins. Various areas throughout the resort or equipped to track the bear and trigger events. Guests staying and paying for the Magic Mate Adventure have rooms that are outfitted with receivers that will cause specific events such as turn lights on and off and receive messages through the television. In addition, hallways, point portals (guest does an activity at a computer station and receives points for future redemption prizes), the restaurant and any other area at the resort have hidden receivers which will track the bear everywhere it goes. It will record the guest's activities as well as trigger effects such as talking pictures, sound and music effects.

Figure 16:
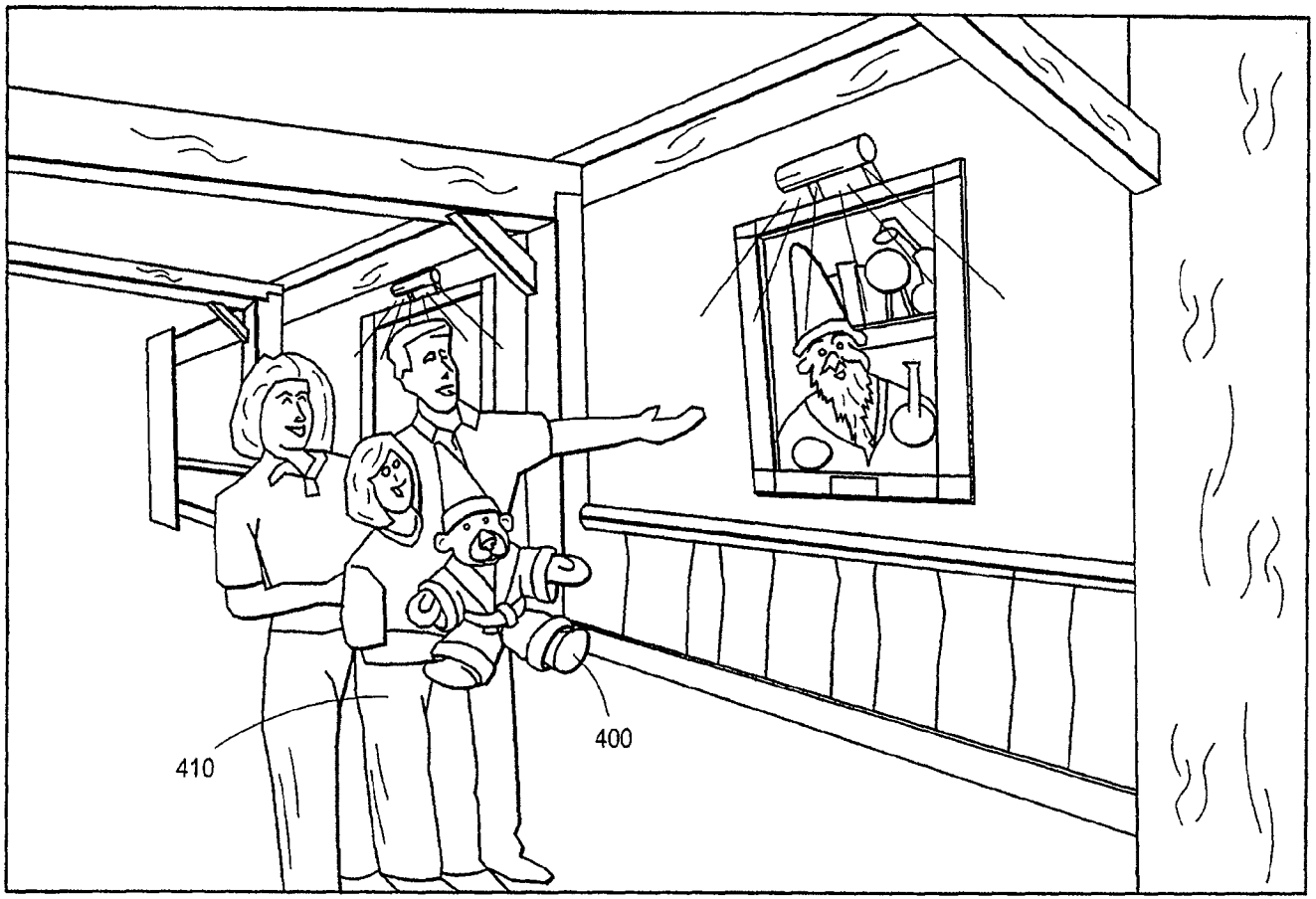
Figure 17:
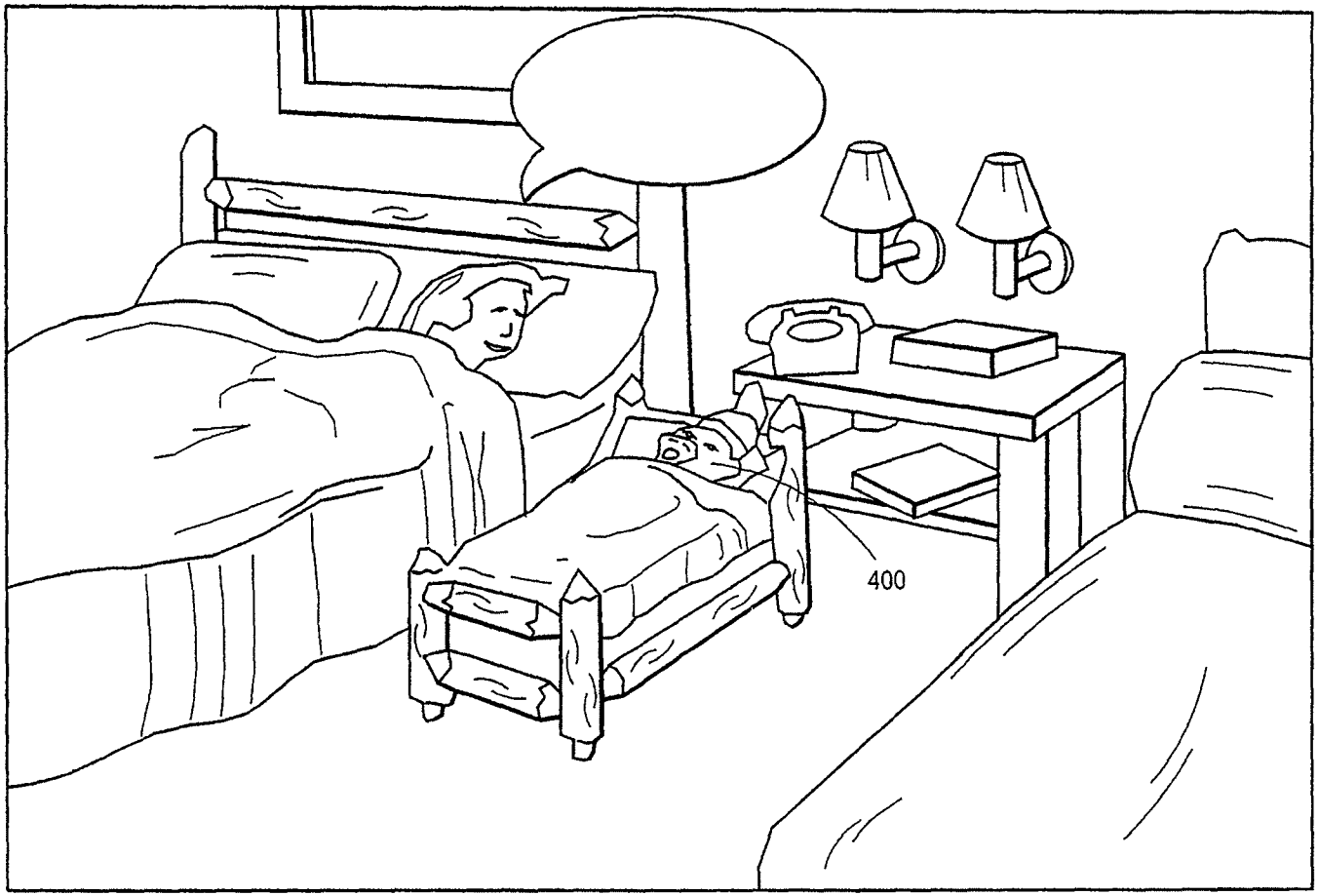
Figure 18:
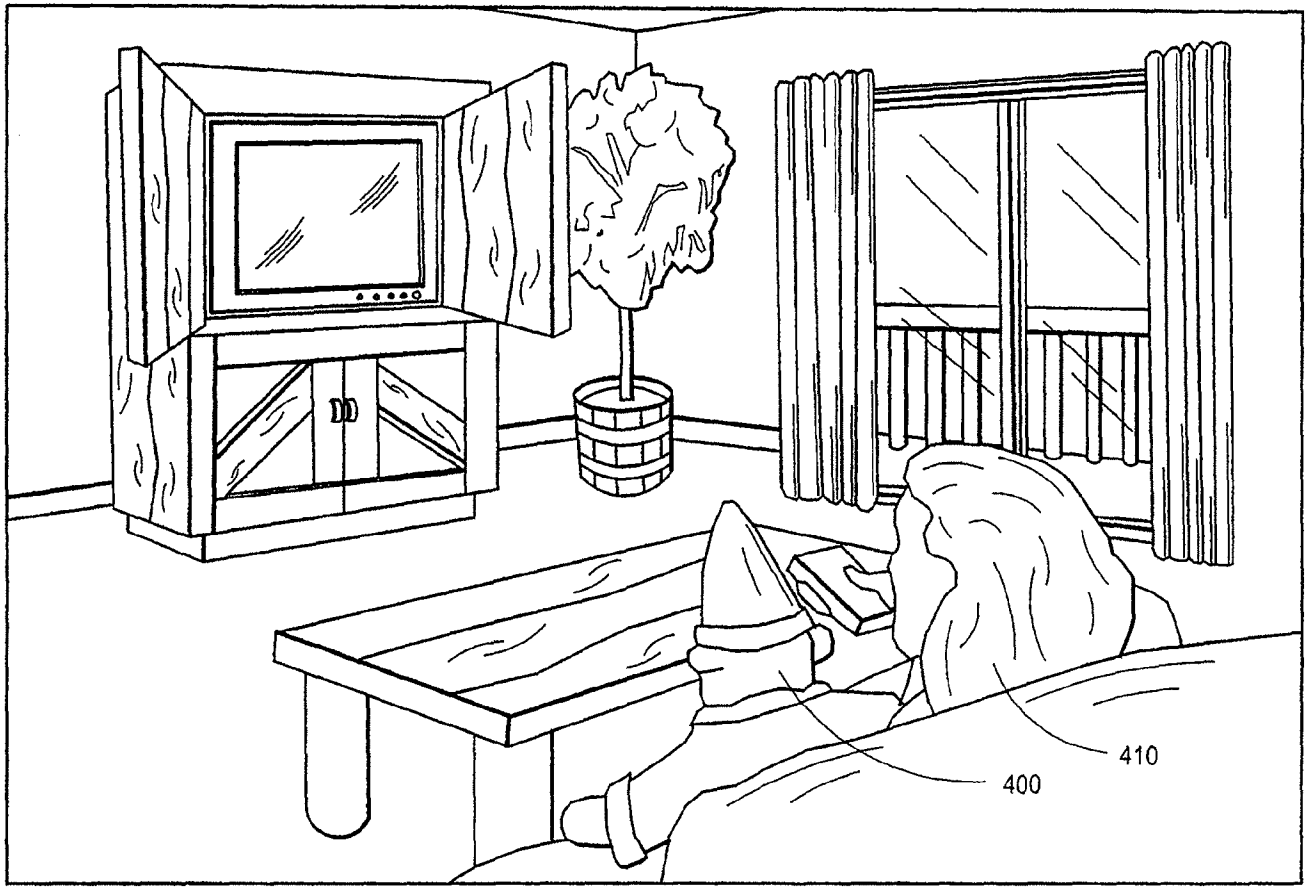

Throughout the resort are magic moments in which the bear will either set off a special effect, be asked to conduct a magic trick, take part in a photo opportunity, a story, event, party, game, etc. For example, as the guest walks down a hallway of the resort, pictures magically light up with magical images that address and speak to the bear (FIG. 16). In addition each of the guests staying at the hotel are given a room that has a special bed, telephone and toiletries for the bear. The room is also equipped and linked to the master system for special wake-up calls and magic tricks (FIGS. 17-18).

Figure 19:
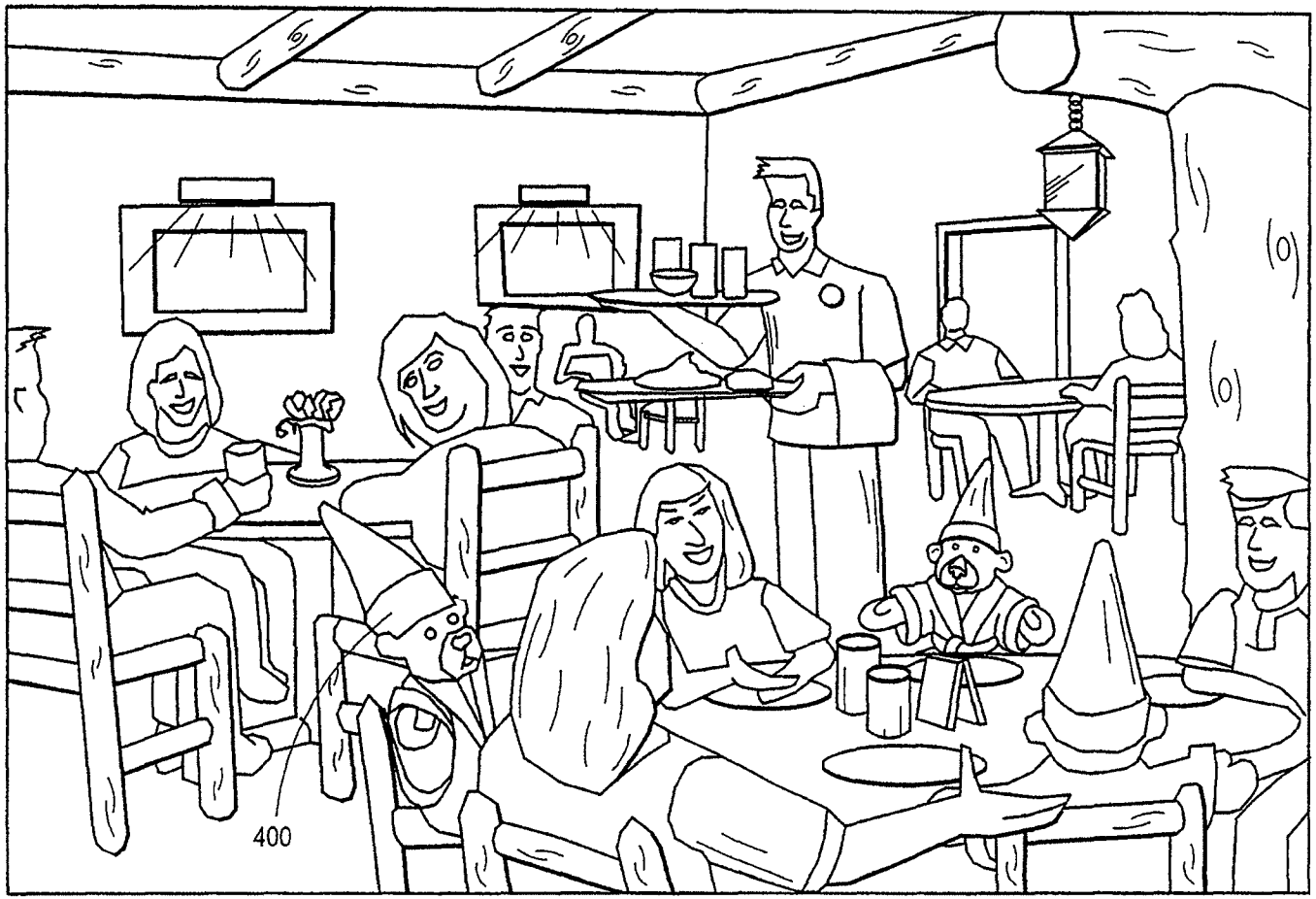
Figure 20:
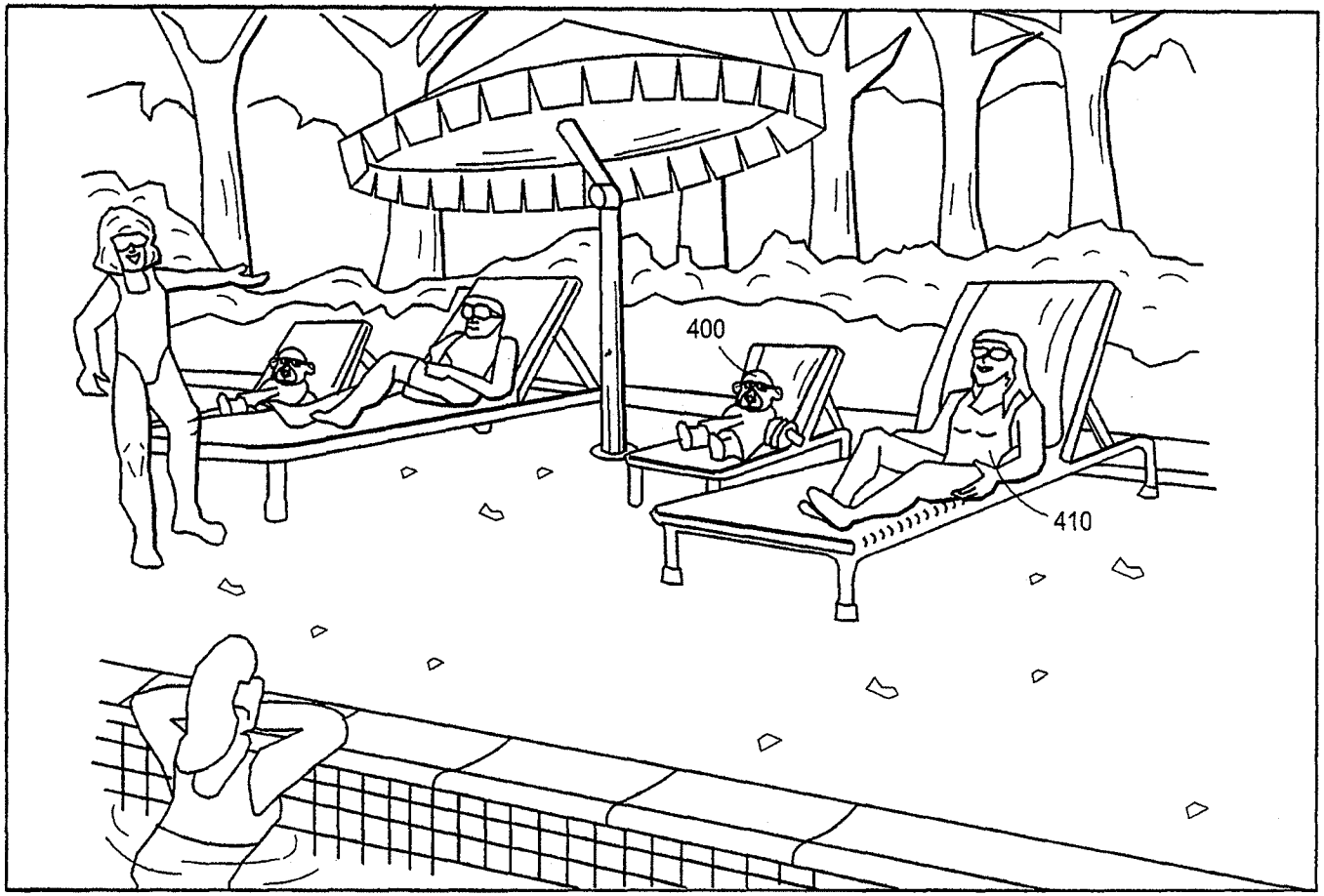
Figure 21:
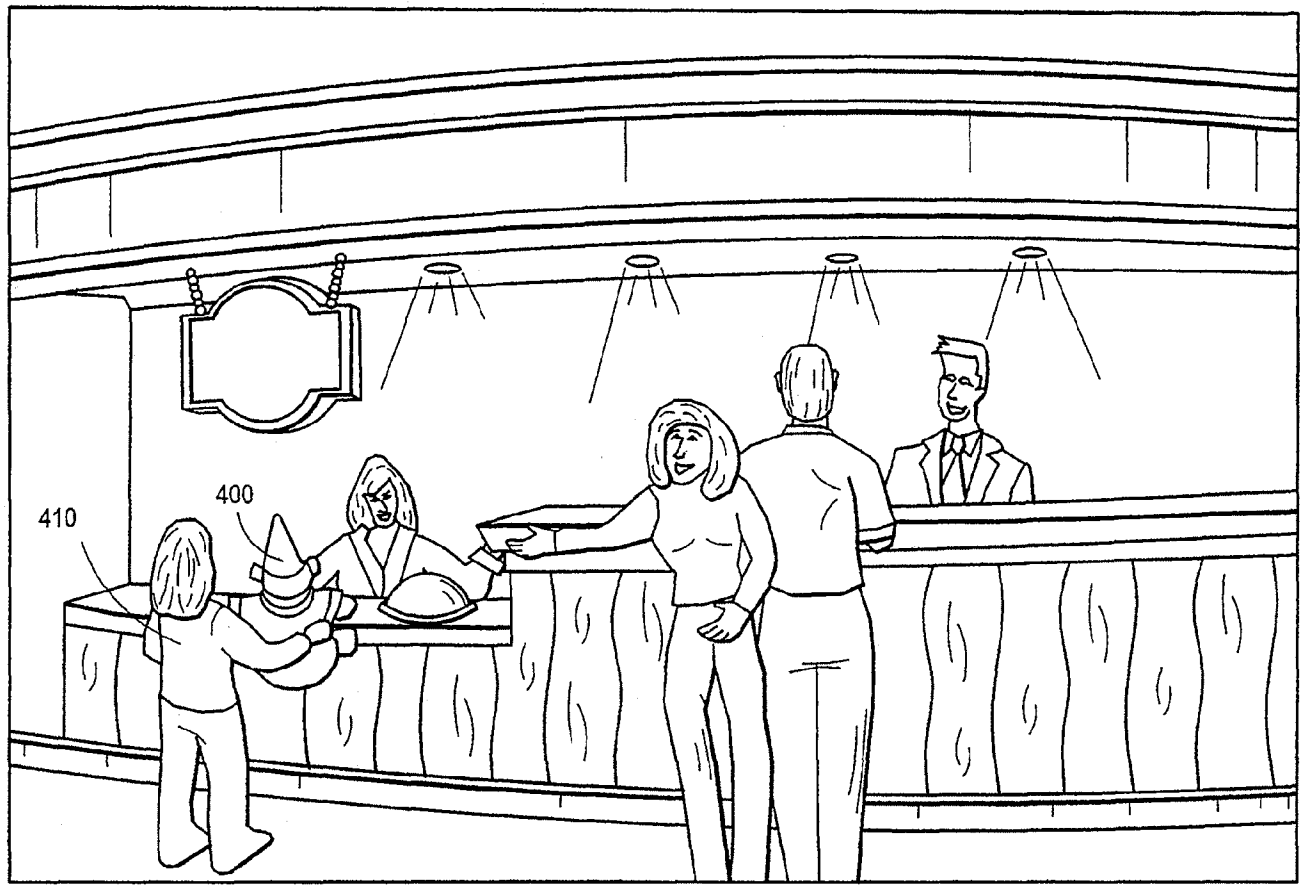

Other areas of the resort cater to the magic bear and the guest. The restaurant would have special seating for bears, a menu and special effects (FIG. 19). This would hold true for the pool with small lounge chairs for bears, a concierge desk for the bears and daily events for human and bear mates (FIGS. 20-21).

Figure 22:
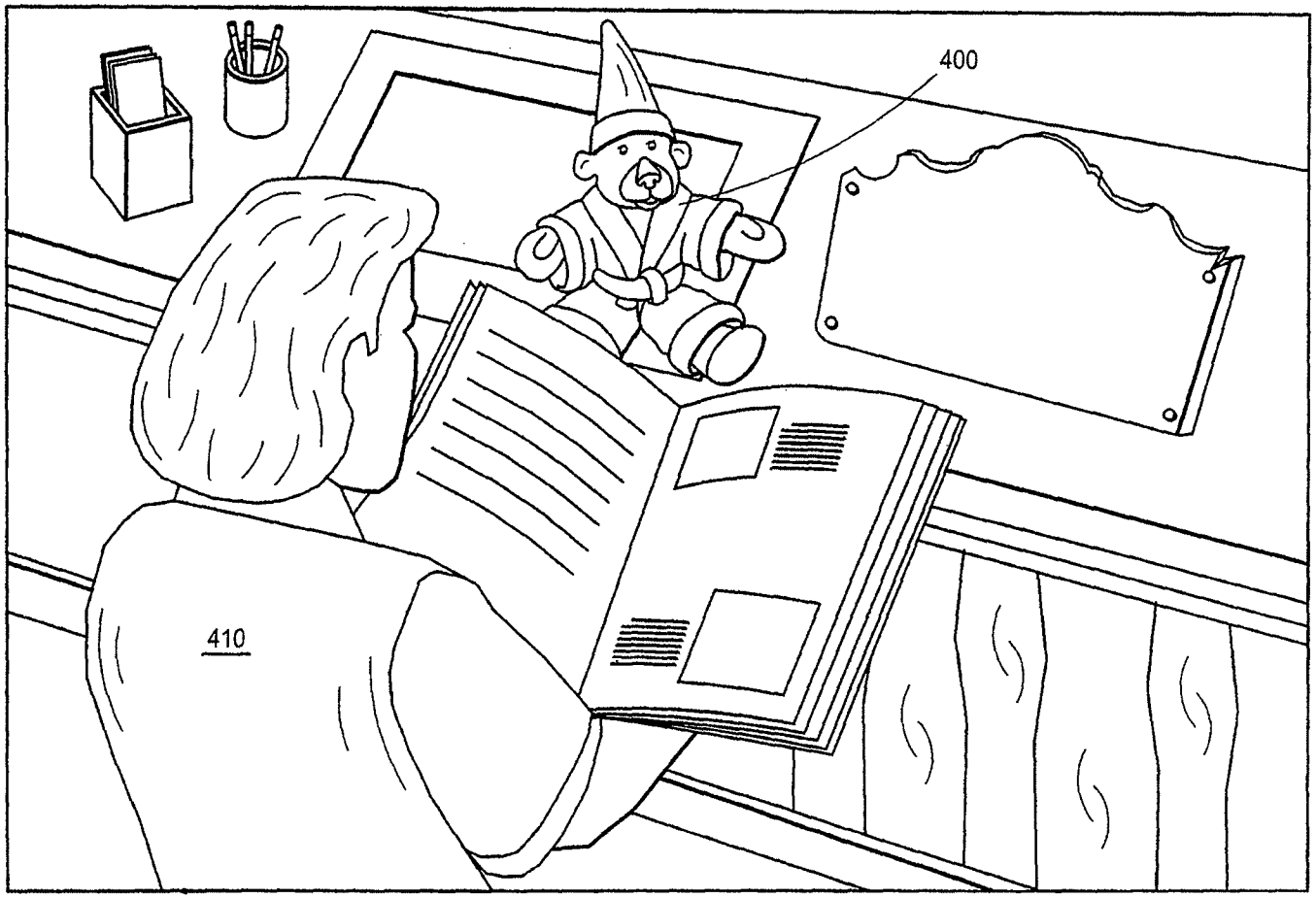
Figure 23:
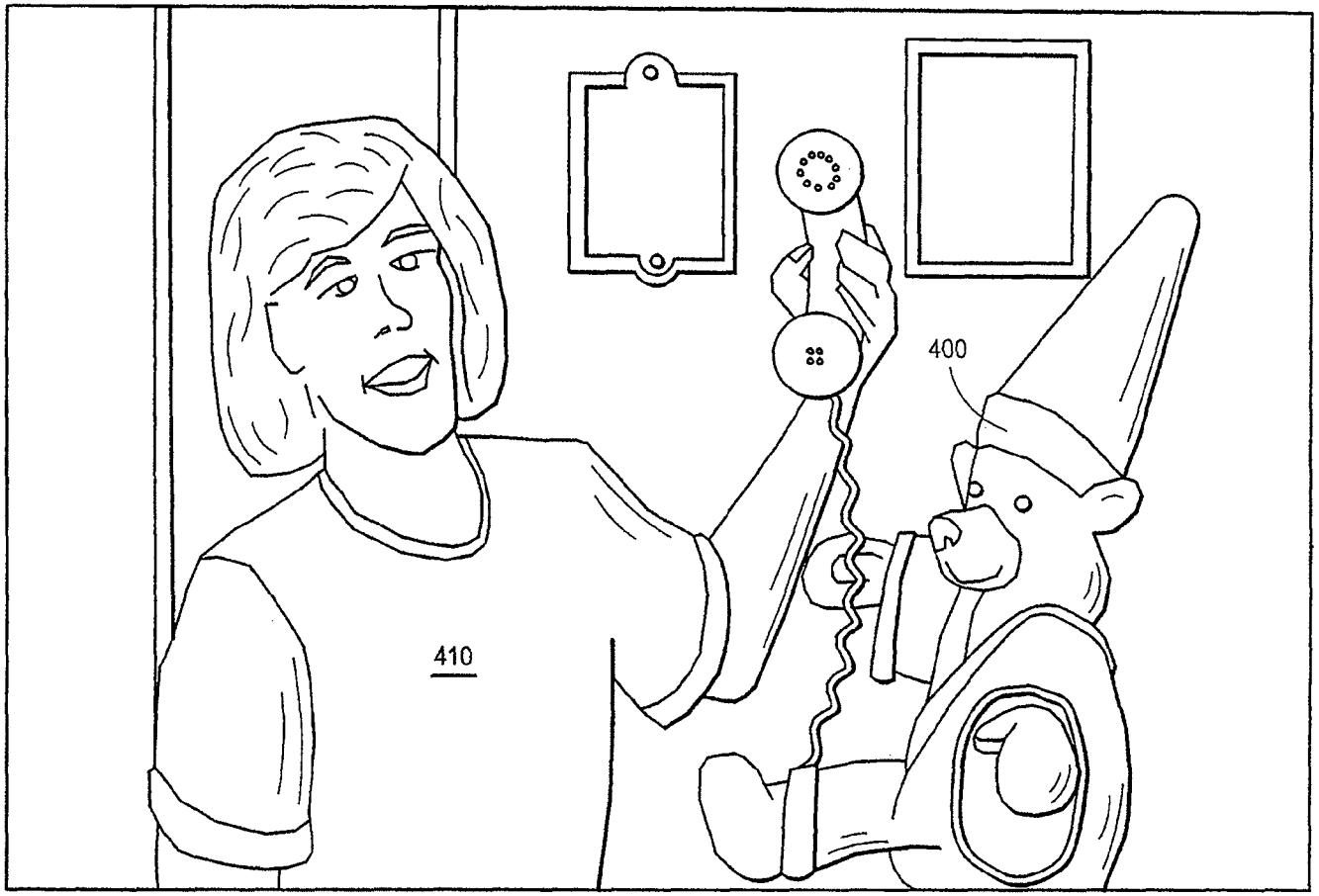

Overall, a magical story is created by tracking the guest and his or her bear throughout their stay. It will turn their events (their magical journey, when they go to dinner, play in the waterplay area, etc) at the resort into an imaginative story and give them a special book that recorded their memorable experiences. It is possible to include photo capturing or designated specific points as "photo-op" for their storybook. At check out the bear and its owner are presented with a printed photo-scrapbook 490 of their magical experience at the resort (FIG. 22). Other possibilities for continuing magic include:

- Visits to other facilities to increase magic skills and reach new levels
- Special events and festivals for the bear to attend
- New magic levels the bear must obtain in order for it to reach its fullest potential
- Catalogs with new clothing to purchase
- Magic can also come to the home through telephone calls, Internet, etc.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A stuffed toy for playing a wireless interactive game, said stuffed toy comprising:

a fabric material defining an outer skin or covering of said stuffed toy;

a stuffing material disposed within said outer skin or covering;

a passive radiofrequency identification ("RFID") tag hermetically sealed within a plastic support structure and affixed to or disposed within said outer skin or covering in such a manner that it cannot be easily removed from the stuffed toy and does not expose any sharp surfaces that could otherwise poke or puncture said outer skin or covering;

said RFID tag comprising: i) a microprocessor, ii) a unique identifier configured to uniquely identify said stuffed toy within said wireless interactive game, iii) non-volatile programmable memory configured to store game-relevant information, and iv) a transceiver and associated antenna configured to provide two-way wireless communications with a compatible RFID reader via inductive coupling; and wherein said game-relevant information comprises at least: i) a first selection of information comprising one or more traits, powers or skills associated with said stuffed toy, ii) a second selection of information comprising progress information relevant to said wireless interactive game, and iii) a third selection of information configured to be selected by a game participant.

2. The stuffed toy of claim 1, wherein said wireless interactive game comprises an electronic role-play game played by said game participant and wherein said stuffed toy represents a character in said electronic role-play game.

3. The stuffed toy of claim 1, wherein said plastic support structure comprises a plastic sheet substrate and wherein said RFID tag is molded or embedded in said plastic sheet substrate.

4. The stuffed toy of claim 1, wherein said second selection of information comprises points or achievements earned in said wireless interactive game.

5. The stuffed toy of claim 1, wherein said third selection of information comprises a name of said stuffed toy selected by said game participant.

6. The stuffed toy of claim 1, further comprising at least one accessory item configured to be selectively worn by, attached to, or assembled with, said stuffed toy, and wherein said at least one accessory item comprises a second passive RFID tag comprising a second unique identifier configured to uniquely identify said at least one accessory item within said wireless interactive game.

7. The stuffed toy of claim 6, wherein said at least one accessory item comprises a hat, clothing or jewelry configured to be attached to or worn by said stuffed toy.

8. A playmate toy for playing a wireless interactive game, said playmate toy comprising:

a body in the form of a doll, an action figure, or a stuffed character, said body comprising a first material defining an outer skin of said playmate toy and a second material substantially filling an inner cavity of said body defined by said outer skin;

a support structure disposed within said inner cavity, said support structure formed from a third material comprising a molded plastic substrate;

a radiofrequency identification ("RFID") tag affixed to or embedded in said support structure in such a manner that said RFID tag cannot be easily removed from said playmate toy and does not expose any sharp surfaces that could poke or puncture said outer skin;

said RFID tag comprising: i) a microprocessor, ii) a unique identifier configured to uniquely identify said playmate toy within said wireless interactive game, iii) non-volatile programmable memory configured to store game-relevant information, a iv) a transceiver configured to provide two-way wireless communications with a compatible RFID reader device, and v) a spiral-wound antenna electrically coupled to said transceiver and configured to be energized by inductive coupling with said compatible RFID reader device for powering said RFID tag; and wherein said game-relevant information comprises: i) a first selection of information comprising one or more powers or abilities associated with said playmate toy, ii) a second selection of information comprising progress information relevant to said wireless interactive game, and iii) a third selection of information comprising a personalized name of said playmate toy.

9. The playmate toy of claim 8, wherein said wireless interactive game comprises an electronic role-play game configured to be played by a game participant using said playmate toy and wherein said playmate toy represents a character in said electronic role-play game.

10. The playmate toy of claim 8, wherein said wireless interactive game comprises a competition game wherein said playmate toy competes with one or more compatibly-configured wireless interactive toys to produce one or more desired effects.

11. The playmate toy of claim 8, wherein said second selection of information comprises points or achievements earned in said wireless interactive game.

12. The playmate toy of claim 8, further comprising at least one accessory item configured to be selectively worn by, attached to, or assembled with, said body, and wherein said at least one accessory item comprises a second RFID tag comprising a second unique identifier configured to uniquely identify said at least one accessory item within said wireless interactive game.

13. The playmate toy of claim 12, wherein said at least one accessory item comprises a hat, clothing or jewelry configured to be attached to or worn by said playmate toy.

14. A stuffed character toy for playing an interactive game, said stuffed character toy comprising:

a body representing a character from said interactive game, said body comprising a first material defining an outer skin of said stuffed character toy and a second material defining an inner filling or stuffing of said stuffed character toy;

a passive radiofrequency identification ("RFID") tag affixed to or disposed within said body in such a manner that it cannot be easily removed from said body and does not expose sharp edges that could otherwise poke or puncture said outer skin;

said RFID tag comprising: i) a microprocessor, ii) a unique identifier configured to uniquely identify said stuffed character toy within said interactive game, iii) non-volatile programmable memory configured to store game-relevant information, and iv) a transceiver and associated antenna configured to provide two-way wireless communications with a compatible RFID reader via inductive coupling; and wherein said game-relevant information comprises: i) a first selection of information comprising one or more traits, powers or skills associated with said stuffed character toy, ii) a second selection of information comprising progress information relevant to said interactive game, and iii) a third selection of information configured to be selected by a game participant.

15. The stuffed character toy of claim 14, wherein said interactive game comprises a competition game wherein said stuffed character toy competes with one or more compatibly-configured wireless interactive toys to produce one or more desired effects.

16. The stuffed character toy of claim 14, wherein said RFID tag is hermetically sealed within a support structure comprising a molded plastic substrate.

17. The stuffed character toy of claim 14, wherein said second selection of information comprises points or achievements earned in said interactive game.

18. The stuffed character toy of claim 14, wherein said third selection of information comprises a name of said stuffed character toy selected by said game participant.

19. The stuffed character toy of claim 14, further comprising at least one accessory item configured to be selectively worn by, attached to, or assembled with, said body, and wherein said at least one accessory item comprises a second passive RFID tag comprising a second unique identifier configured to uniquely identify said at least one accessory item within said interactive game.

20. The stuffed character toy of claim 19, wherein said at least one accessory item comprises a hat, clothing or jewelry configured to be attached to or worn by said stuffed character toy.

* * * * *